US007657212B2

(12) United States Patent
Deguchi et al.

(10) Patent No.: US 7,657,212 B2
(45) Date of Patent: Feb. 2, 2010

(54) DEVELOPER CONTAINER FOR STORING A DEVELOPER USED FOR ELECTROPHOTOGRAPHIC IMAGE FORMATION

(75) Inventors: Masanobu Deguchi, Kashiba (JP); Takeshi Satoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 393 days.

(21) Appl. No.: 11/520,004

(22) Filed: Sep. 13, 2006

(65) Prior Publication Data

US 2007/0059046 A1 Mar. 15, 2007

(30) Foreign Application Priority Data

Sep. 14, 2005 (JP) ..... P2005-267502

(51) Int. Cl.
*G03G 15/08* (2006.01)

(52) U.S. Cl. ..... 399/262; 399/263

(58) Field of Classification Search ..... 399/258, 399/260–263

See application file for complete search history.

(56) References Cited

U.S. PATENT DOCUMENTS

2004/0240908 A1 12/2004 Deguchi et al.
2005/0058471 A1 3/2005 Nagahama et al.

FOREIGN PATENT DOCUMENTS

EP 0 807 867 A2 11/1997
JP 6-102758 4/1994
JP 6-348127 A 12/1994
JP 7-20705 A 1/1995
JP 8-339115 A 12/1996
JP 2004317592 A * 11/2004
JP 2004-354638 12/2004
JP 2005-077728 3/2005

OTHER PUBLICATIONS

English translation of Deguchi, et al., JP publication 2004-317592, published Nov. 11, 2004.*

* cited by examiner

*Primary Examiner*—David M Gray
*Assistant Examiner*—Geoffrey T Evans
(74) *Attorney, Agent, or Firm*—Nixon & Vanderhye P.C.

(57) ABSTRACT

A developer container includes a cylindrical container main body, a supporting member, a sheet-like developer guiding member, and an adhesion eliminating portion. The container main body has a concavity forming a storage space, has a discharge hole, and conveys the stored developer toward the discharge hole by rotating about its axial line. The supporting member covers a portion including the concavity and the discharge hole over circumferences thereof to support the container main body so as to be rotatable about the axial line, and has a leading through hole for leading the developer discharged from the discharge hole of the container main body to the outside. The developer guiding member guides the developer discharged from the discharge hole of the container main body to the leading through hole. The adhesion eliminating portion eliminates developer adhering to the developer guiding member through rotation of the container main body.

13 Claims, 39 Drawing Sheets

DEVELOPER CONTAINER FOR STORING A DEVELOPER USED FOR ELECTROPHOTOGRAPHIC IMAGE FORMATION

BACKGROUND

1. Field

The present disclosure relates to a developer container that stores a developer used for electrophotographic image formation.

2. Description of the Related Art

FIGS. 38A and 38B are views illustrating a first related art toner bottle 1. FIG. 38A is a cross section view of the toner bottle 1. FIG. 38B is a perspective view of the toner bottle 1. The toner bottle 1 is formed into a cylindrical shape whose both ends are closed, and has an opening portion 3 formed on one end wall 2 so that a diameter thereof is smaller than a diameter of the cylindrical main body. Part of an inner face of a shoulder portion of an end face 4 on which the opening-portion 3 is formed is made to project from the inner face of the shoulder portion to an edge of the opening portion 3, whereby a projecting portion 5 for lifting toner is formed. An inner face of a periphery wall of the bottle connected to the projecting portion 5 in a circumferential direction is made to project from the edge of the opening portion 3 toward a rotation center line L1 of the bottle, whereby an in-opening projecting portion 6 is formed.

The toner bottle 1 is placed almost horizontally on a bottle holder of a toner supplying device in a state where the opening portion 3 faces sideways, and the toner bottle rotates in this state, thereby lifting toner existing in a lower part of the cylindrical main body to the opening portion 3 and discharging it (for example, refer to Japanese Unexamined Patent Publication JP-A 7-20705 (1995)).

FIG. 39 is a perspective view illustrating a second related art developer supplying container 10. The developer supplying container 10 is formed into a cylindrical shape whose both ends are closed, and has a storing space for storing toner. The developer supplying container 10 has a first projection piece 13 that protrudes inwardly in a radial direction and extends helically about an axial line L10 from an axial one end portion 11 toward an axial center portion 12, and a second projection piece 15 that protrudes inwardly in the radial direction and extends helically about the axial line L10 from an axial other end portion 14 toward the axial center portion 12. On the axial center portion 12 of the developer supplying container 10 is formed a through hole 16 that passes through in the radial direction to make the storing space communicate with a space outside the developer supplying container 10.

The developer supplying container 10 is coupled to an image forming apparatus main body that is not illustrated so that the axial line L10 becomes parallel to a horizontal direction and the axial center portion 12 faces a toner supply opening disposed to the image forming apparatus main body so as to be open upwardly. In this state, the developer supplying container 10 is rotated about the axial line L10 by a driving force from a driving section disposed to the image forming apparatus main body. Consequently, the toner stored in the storing space of the developer supplying container 10 is carried to the axial center portion 12 by the respective projection pieces 13 and 15. When the through hole 16 reaches a position facing the toner supply opening, the toner is supplied to the toner supply opening via the through hole 16 (for example, refer to Japanese Unexamined Patent Publication JP-A 8-339115 (1996)).

FIGS. 40A and 40B are perspective views for describing a third related art toner supplying device. FIG. 40A is a perspective view illustrating a toner cartridge 20 of the toner supplying device. FIG. 40B is an exploded perspective view illustrating a toner cartridge holding portion 21 of the toner supplying device. The toner supplying device has the toner cartridge 20 having a cylindrical shape whose both ends are sealed, and the toner cartridge holding portion 21 that holds the toner cartridge. The toner cartridge 20 is composed of a cylindrical container 22 and a gear 24 disposed to one end of the cylindrical container 22, and holds toner inside the cylindrical container 22.

On a cylindrical surface of the cylindrical container 22 is formed an opening 23 for discharging the toner held inside the cylindrical container 22. The toner cartridge holding portion 21 has a cylindrical shape, and has a toner falling hole 25 formed on a bottom portion of a cylindrical surface thereof and a driving gear 26 for rotating the toner cartridge 20 as an electrophotographic recording apparatus performs a recording operation. The toner cartridge 20 is axially supported so as to be rotatable in the toner cartridge holding portion 21.

A driving mechanism of the toner cartridge holding portion 21 is driven by a driving source of an electrophotographic recording apparatus main body, and a driving force thereof is transmitted to the gear 24 of the toner cartridge 20, whereby the toner cartridge 20 rotates about a cylindrical shaft c in the toner cartridge holding portion 21. Since the toner cartridge 20 rotates in the toner cartridge holding portion 21, the toner held in the toner cartridge 20 is conveyed to the opening 23 of the toner cartridge 20. When the opening 23 fits the toner falling hole 25 formed on the bottom portion of the cylindrical surface of the toner cartridge holding portion 21, and a hole where the toner falls is formed, the toner is supplied to a developing device through the opening 23 and the toner falling hole 25 (for example, refer to Japanese Unexamined Patent Publication JP-A 6-348127 (1994)).

In the configuration of the toner bottle 1 disclosed in JP-A 7-20705, when the toner bottle 1 is nearly full of toner, the toner level is located above the opening portion 3. Therefore, there is a case where the toner flows out from the opening portion 3 and the toner is excessively supplied to the toner supplying device. On the contrary, when the fill quantity of the toner is small, the upper face of the toner is located below the opening portion. Therefore, the quantity of the toner lifted by the in-opening projecting portion 6 is small, so that the quantity of the discharged toner is small. Thus, with the configuration of the toner bottle 1, the quantity of the discharged toner varies depending on the fill quantity of the toner. Since there is a need to change the number of rotations of the toner bottle 1 depending on the fill quantity of the toner, there is a problem that it is difficult to regulate the quantity supplied and it is impossible to keep the quantity of the discharged toner constant.

With the configurations of the developer supplying container 10 disclosed in JP-A 8-339115 and the toner supplying device disclosed in JP-A 6-348127, toner is discharged when the through hole 16 and the opening 23 are located below the upper face of the toner. However, each of the configurations has a problem that when the container stops in a state where the through hole 16 or the opening 23 is located below the upper face of the toner, the toner inside the container flows out in large quantities, which leads to a problem that it is impossible to keep the quantity of the discharged toner constant.

SUMMARY

In an aspect, a developer container that can keep the quantity of discharged developer constant is provided.

An example embodiment provides a developer container attachably/detachably mounted in an image forming apparatus, comprising:

a container main body formed into a cylindrical shape to store developer used for image formation, the container main body having a concavity depressed inwardly in a radial direction thereof to form a storage space, on an outer periphery portion thereof, and a discharge hole for discharging the developer to the storage space, and conveying the stored developer toward the discharge hole by rotating about an axial line thereof;

a supporting member that supports the container main body so as to be rotatable about the axial line by covering a part of the container main body including at least the concavity and the discharge hole over circumferences thereof from outside in the radial direction, the supporting member being provided with a leading through hole that is formed so as to face a moving path of the concavity which is formed when the container main body rotates, and that leads the developer discharged from the discharge hole of the container main body to the outside;

a developer guiding member that is formed like a sheet, extends up stream in a rotation direction from the leading through hole, and guides the developer discharged from the discharge hole of the container main body to the leading through hole; and an adhesion eliminating portion for eliminating developer adhering to the developer guiding member through rotation of the container main body.

According to an example embodiment, when the container main body is rotated about the axial line, the stored developer is conveyed toward the discharge hole, and discharged from the discharge hole to the storage space. Since the part including at least the concavity and the discharge hole of the container main body is covered by the supporting member over circumferences thereof from outside in the radial direction, the developer discharged from the discharge hole to the concavity is retained in the storage space. The developer retained in the storage space is guided to the leading through hole by the developer guiding member. Thus, the developer discharged from the discharge hole of the container main body is not directly discharged from the developer container but retained once in the storage space formed between the container main body and the supporting member, so that it is possible to keep the quantity of the developer discharged from the leading through hole constant.

Moreover, in a case where the developer adheres to the developer guiding member, the developer adhering to the developer guiding member is eliminated by the adhesion eliminating portion. Consequently, it is possible to prevent that a supply path for supplying the developer from the developer guiding member to the leading through hole is narrowed by the developer, and prevent that the quantity of the developer guided to the leading through hole is reduced, so that it is possible to keep the quantity of the developer discharged from the leading through hole constant.

It may be preferable that the adhesion eliminating portion executes an eliminating operation plural times while the container main body rotates once.

According to an example embodiment, the adhesion eliminating portion executes the eliminating operation plural times, so that it is possible to securely eliminate the developer adhering to the developer guiding member. Consequently, it is possible to securely prevent that the quantity of the developer guided to the leading through hole is reduced, and it is possible to keep the quantity of the developer discharged from the leading through hole constant.

It may be preferable that the adhesion eliminating portion eliminates the adhering developer by making the developer guiding member collide with the container main body or the supporting member.

According to an example embodiment, the developer guiding member is made to collide with the container main body or the supporting member, whereby it is possible to eliminate the developer adhering to the guiding member by an inertial force. Thus, it is possible to keep the quantity of the developer discharged from the leading through hole constant with a simple configuration. Moreover, since it is possible to resolve the developer by impact at the time of collision, it is possible to securely eliminate even if the developer adhering to the developer guiding member is in the aggregated state. Accordingly, it is possible to securely prevent the leading through hole from being narrowed by the developer, so that it is possible to keep the quantity of the developer discharged from the leading through hole constant.

Still further, it may be preferable that the container main body is provided with a depressed portion depressed inwardly in the radial direction, and the adhesion eliminating portion has an inner wall portion on an upstream side in the rotation direction which defines the depressed portion.

According to an example embodiment, the container body is provided with a depressed portion depressed inwardly in the radial direction, and the adhesion eliminating portion has the inner wall portion on the upstream side in the rotation direction which defines the depressed portion. The developer guiding member collides with the inner wall portion on the upstream side in the rotation direction of the depressed portion, and makes an angular displacement along the inner wall portion. When the developer guiding member starts an angular displacement along the inner wall portion, and when the developer guiding member finishes the angular displacement, the developer adhering to the developer guiding member is separated from the developer guiding member by the inertial force. Consequently, the developer adhering to the developer guiding member is eliminated, and it is possible to keep the quantity of the developer discharged from the leading through hole constant.

Still further, it may be preferable that the discharge hole is formed on a downstream inner wall portion in the rotation direction of the concavity, and the depressed portion is disposed from a position close to the concavity to a position away from the concavity so as to oppose a part where the discharge hole is formed on the inner wall portion, from downstream in the rotation direction.

According to an example embodiment, the discharge hole is formed on the downstream inner wall portion in the rotation direction of the concavity, and the depressed portion is disposed from the position close to the concavity to the position away from the concavity so as to oppose the part where the discharge hole is formed on the inner wall portion, from downstream in the rotation direction. Since the depressed portion is depressed inwardly in the radial direction of the container main body, it is possible to form a projection that protrudes inwardly in the radial direction, in a position close to the discharge hole and opposing the part where the discharge hole is formed on the inner wall portion from downstream in the rotation direction. Consequently, it is possible to prevent that the developer spreads downstream in the rotation direction from the discharge hole and aggregates, so that the developer is easily discharged to the storage space from the discharge hole.

Moreover, of a space inside the container main body, a space around the discharge hole is small because the projection is formed. Consequently, even when the fluidity of the developer is high, it is prevented that the quantity of the developer discharged into the storage space from the discharge hole becomes too much, and so-called avalanche discharge of the developer is suppressed, whereby a proper quantity of developer is retained in the storage space. Consequently, the developer guiding member can thoroughly execute a guiding operation of guiding the developer from the storage space to the leading through hole, and can keep the quantity of the developer discharged from the leading through hole constant.

Moreover, since the projection is formed by disposing the depressed portion, there is no need to newly form a protruding portion on the downstream side in the rotation direction of the discharge hole, and it is possible to realize a developer container that can keep the quantity of the developer discharged from the leading through hole constant with a simple configuration.

Still further, it may be preferable that the developer container further comprises a spring force generating portion for applying a spring force to the developer guiding member so that an upstream end portion in the rotation direction of the developer guiding member resiliently abuts on an outer periphery face of the concavity of the container main body.

According to an example embodiment, the developer guiding member is formed like a sheet. Therefore, for example, there is a possibility that the developer guiding member causes plastic deformation by abutting on the outer periphery face of the container main body rotating about the axial line. However, even if the developer guiding member causes plastic deformation, the spring force generating portion applies a spring force to the upstream end portion in the rotation direction of the developer guiding member so as to resiliently abut on the outer periphery face of the concavity of the container main body. Consequently, the upstream end portion in the rotation direction of the developer guiding member resiliently abuts on the outer periphery face of the concavity of the container main body with security, thereby scraping the developer retained in the storage space off the outer periphery face of the concavity and guiding to the leading through hole. Accordingly it is possible to keep the quantity of the developer discharged from the leading through hole constant for a long period.

BRIEF DESCRIPTION OF THE DRAWINGS

Other and further objects, features, and advantages will be explained further from the following detailed description taken with reference to the drawings wherein:

FIGS. 31A and 30B are views for describing the operation that the developer inside the third container segment of the container main body is guided to the leading through hole of the supporting member while the container main body is rotating in the rotation direction R about the rotation axial line;

DETAILED DESCRIPTION

Figure 1:
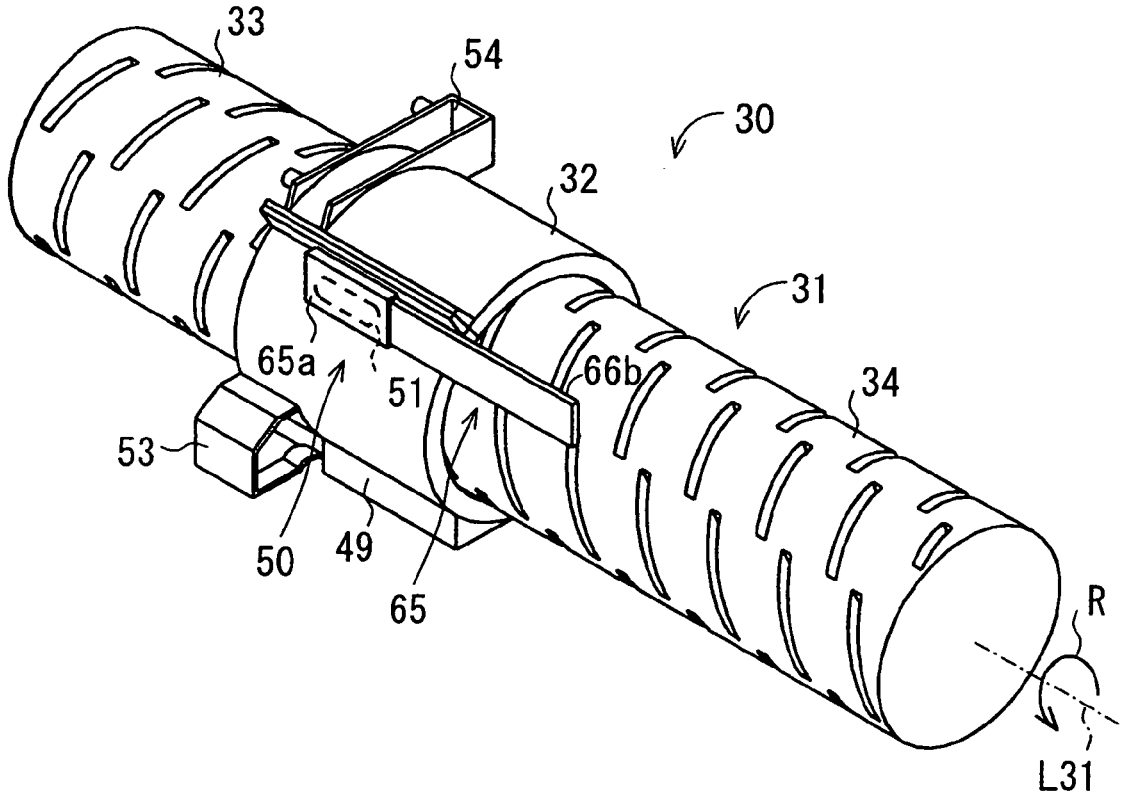
FIG. 1 is a perspective view illustrating a developer container according to an example embodiment.

Now referring to the drawings, example embodiments of the invention are described below.

Figure 2:
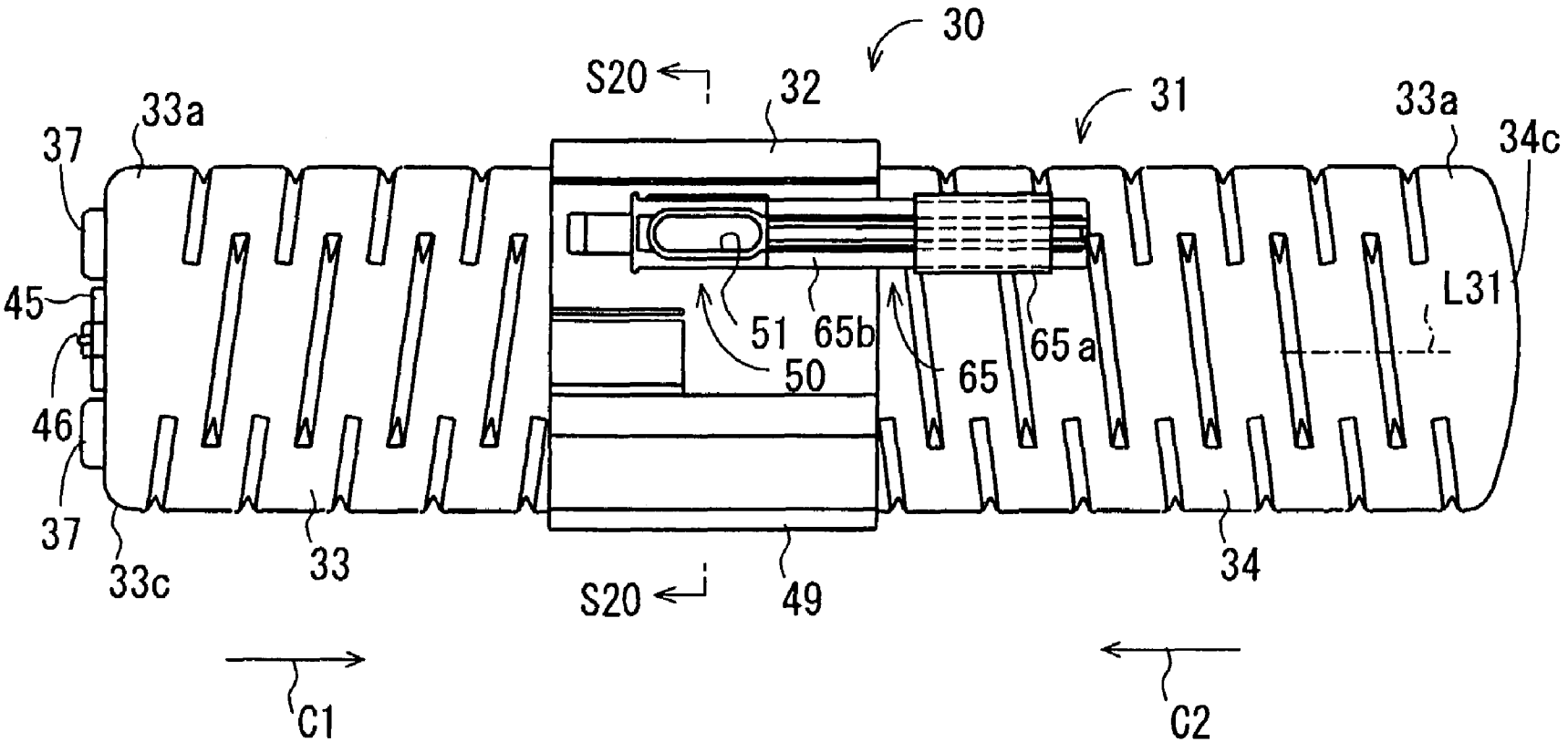
FIG. 2 is a front view illustrating the developer container.
Figure 3:
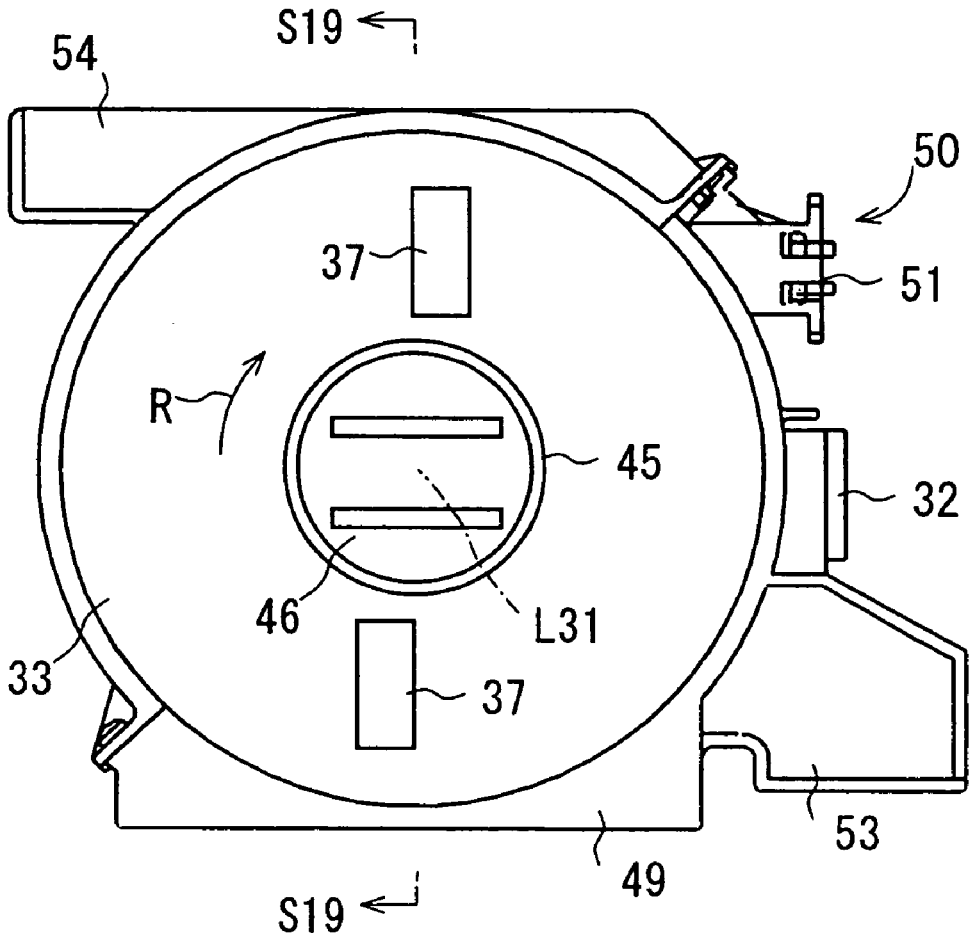
FIG. 3 is a left side view illustrating the developer container.

FIG. 1 is a perspective view illustrating a developer container 30 according to an example embodiment. FIG. 2 is a front view illustrating the developer container 30. FIG. 3 is a left side view illustrating the developer container 30. The developer container 30 comprises a container main body 31 and a supporting member 32. The container main body 31 is formed into a substantially cylindrical shape, and stores toner of a two-component developer such as coloring toner used for electrophotographic image formation, for example. The supporting member 32 supports the container main body 31 so as to be rotatable about an axial line L31 thereof. The developer container 30 is capable of storing, for example, 1400 gram of developer. Hereafter, the axial line L31 of the container main body 31 may be expressed as the rotation axial line L31. In the present embodiment, the container main body 31 rotates about the rotation axial line L31 at the number of revolutions of, for example, 2 rev/min.

Figure 4:
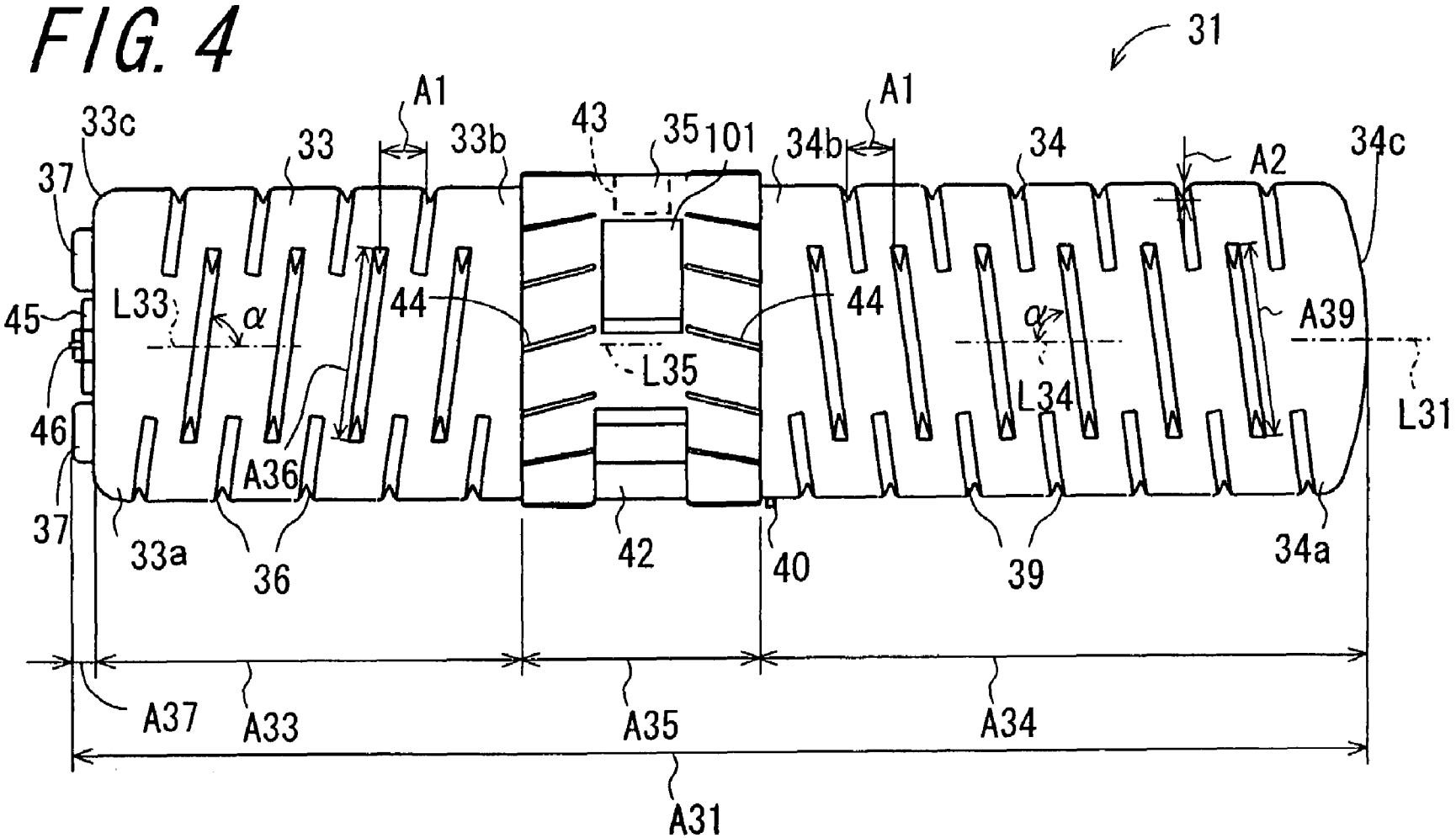
FIG. 4 is a front view illustrating a container main body.
Figure 5:
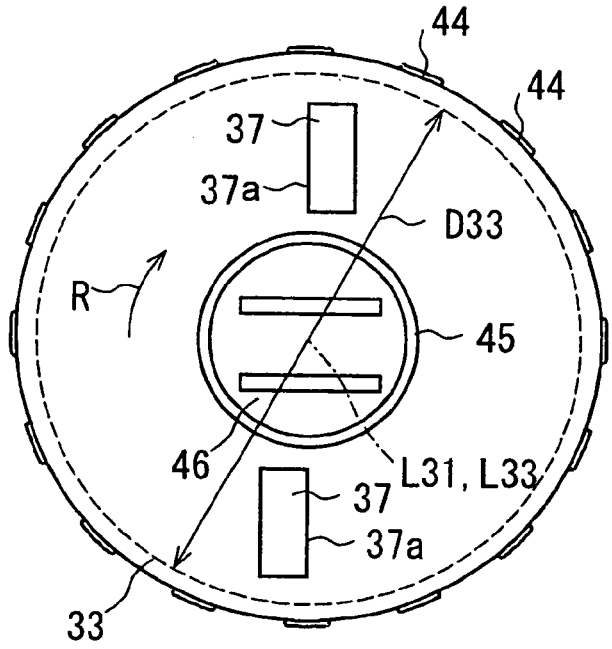
FIG. 5 is a left side view illustrating the container main body.
Figure 6:
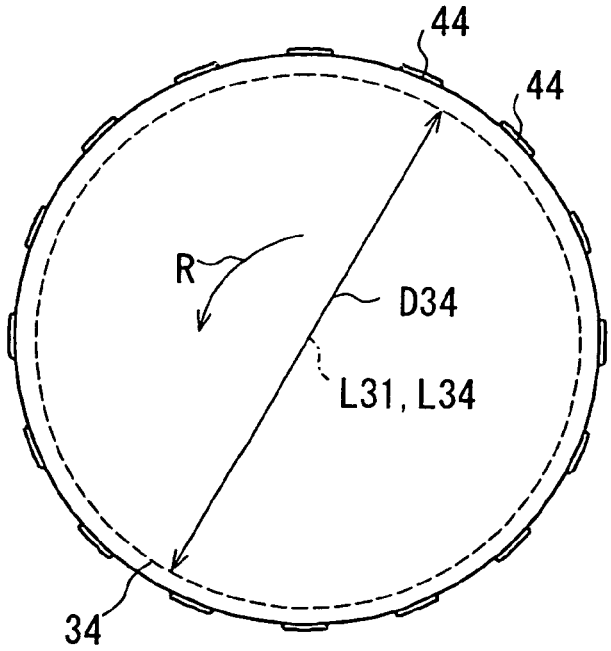
FIG. 6 is a right side view illustrating the container main body.

FIG. 4 is a front view illustrating the container main body 31. FIG. 5 is a left side view illustrating the container main body 31. FIG. 6 is a right side view illustrating the container main body 31. The container main body 31 includes a first container segment 33, a second container segment 34 and a third container segment 35. A length A31 along the axial line L31 of the container main body 31 can be arbitrarily set, and may be 458 mm, for example.

The first container segment 33 is formed into a cylindrical shape with a bottom. An axial length A33 of the first container segment 33 can be arbitrarily set, and may be 160 mm, for example. On an inner periphery portion of the first container segment 33 is formed carrying means for carrying developer along the axial line L31 when the container main body is driven to rotate about the axial line. As illustrated in FIG. 4, the carrying means has first projection pieces 36, which are a plurality of carrying portions that extend in a first extending direction across a circumferential direction and protrude inwardly in a radial direction. The first projection pieces 36 are formed apart in the circumferential and axial directions. Describing in detail, each of the first projection pieces 36 is formed extending along an arc, in a state where a downstream end portion in a rotation direction thereof inclines so as to be located closer to a bottom portion 33*a* than an upstream end portion in the rotation direction thereof.

As illustrated in FIGS. 4 and 5, a convex fit 37 serving as a coupling portion protruding in a direction from an opening end portion 33*b* toward the bottom portion 33*a*, and a replenishment port 45 are formed on the bottom portion 33*a* of the first container segment 33. A plurality of convex fits, in the present embodiment, two convex fits 37 are formed. The replenishment port 45 is formed so as to pass through a middle portion of the bottom portion 33*a* of the first container segment 33 along the rotation axial line L31 and so as to be open like a circle coaxial with an axial line L33 of the first container segment 33. A replenishment lid 46 that is formed so as to fit a shape of the replenishment port 45 and to be attachable to and detachable from the replenishment port is attached to the replenishment port 45 while sealing the replenishment port. 45 so as not to be detached through rotation of the container main body 31. By detaching the replenishment lid 46 from the replenishment port 45, spaces inside and outside the container main body 31 communicate with each other, and in this state, it is possible to replenish developer to the container main body 31.

Describing in detail, the convex fits 37 are located outwardly in the radial direction from the replenishment port 45 so as to be substantially symmetrical with each other with respect to the axial line L33 of the first container segment 33. Describing in more detail, as illustrated in FIG. 5, each of the convex fits 37 is formed so that an upstream portion 37*a* in a rotation direction R, which is a rotation direction clockwise about the rotation axial line L31 when seen from the bottom portion 33*a* of the first container segment 33, has a plane extending perpendicularly to the circumferential direction. A downstream portion in the rotation direction R of the convex fit 37 is formed so as to incline to an axial other end portion as it goes downstream in the rotation direction R. A protrusion amount A37 along the axial line L33 of the convex fit 37 from the remaining portion of the bottom portion 33*a* can be arbitrarily set, and may be 8 mm, for example. The convex fit 37 is attachable to and detachable from a main body-side coupling portion 83 disposed to an image forming apparatus 70 described later (refer to FIG. 37).

Further, a face 33*c* where an outer periphery face and an end face are connected at the bottom portion 33*a* of the first container segment 33 is formed into a curved shape inclining inwardly in the radial direction as it goes from the opening end portion 33*b* to the bottom portion 33*a* as illustrated in FIG. 4.

The second container segment 34 is formed into a cylindrical shape with a bottom. An axial length A34 of the second container segment 34 can be arbitrarily set, and may be 210 mm, for example. On an inner periphery portion of the second container segment 34 is formed carrying means for carrying developer along the axial line L31 when the container main body is driven to rotate about the axial line. As illustrated in FIG. 4, the carrying means has second projection pieces 39, which are a plurality of carrying portions that extend in a second extending direction across the circumferential direction but different from the first extending direction and protrude inwardly in the radial direction. The second projection pieces 39 are formed apart in the circumferential and axial directions. Describing in detail, each of the second projection pieces 39 is formed extending along an arc in a state where a downstream end portion in the rotation direction thereof inclines so as to be located closer to a bottom portion 34*a* than an upstream end portion in the rotation direction thereof.

The axial length A34 of the second container segment 34 is set so as to be longer, for example, longer by 30 mm or more than the axial length A33 of the first container segment 33. As described before, the axial length A33 of the first container segment 33 can be arbitrarily set and may be 150 mm, for example, and the axial length A34 of the second container segment 34 can be arbitrarily set and may be 215 mm, for example. An inner diameter D33 of the inner periphery portion of the first container segment 33 excluding the first projection pieces 36, and an inner diameter D34 of the inner periphery portion of the second container segment 34 excluding the second projection pieces 39 can be arbitrarily set, and may be 105 mm, for example. An interval A1 between a pair of first projection pieces 36 and between a pair of second projection pieces 39 adjacent in the axial direction can be arbitrarily set, and may be 15 mm, for example.

A length A36 in the first extending direction of the first projection piece 36 and a length A39 in the second extending direction of the second projection piece 39 are about 1/16 or more and 3/8 or less the inner circumference of the first container segment 33 and the inner circumference of the second container segment 34. In a case where the length A36 in the first extending direction of the first projection piece 36 and the length A39 in the second extending direction of the second projection piece 39 are shorter than 1/16 the inner circumference of the first container segment 33 and the inner circumference of the second container segment 34, an ability to carry developer is low. In a case where the length A36 in the first extending direction of the first projection piece 36 and the length A39 in the second extending direction of the second projection piece 39 are longer than 3/8 the inner circumference of the first container segment 33 and the inner circumference of the second container segment 34, the strength of the container main body 31 is low, which is unfavorable. In a case where the carrying ability of the first projection piece 36 and the second projection piece 39 is too high, the developer may aggregate around a discharge hole 43, which is also unfavorable.

In the present embodiment, the length A36 in the first extending direction of the first projection piece 36 and the length A39 in the second extending direction of the second projection piece 39 can be arbitrarily set, and may be 60 mm, for example. Moreover, an interval between a pair of first projection pieces 36 adjacent in the circumferential direction and an interval between a pair of second projection pieces adjacent in the circumferential direction can be arbitrarily set, and may be 50 mm, for example.

Further, an inward protrusion amount A2 in the radial direction of each of the first and second projection pieces 36 and 39 from the remaining portion of the inner periphery portions of the first and second container segments 33 and 34 can be about 1 mm or more and 10 mm or less. In the case of the protrusion amount A2 larger than 10 mm, an ability to carry the developer of the first projection pieces 36 and the second projection pieces 39 is high, but an excessively high carrying ability may cause the developer to aggregate near the discharge hole. Moreover, in the case of the protrusion amount A2 larger than 10 mm, such a problem occurs that it is difficult to form the first projection pieces 36 and the second projection pieces 39 by blow molding. On the contrary, in the case of the protrusion amount A2 less than 1 mm, the developer carrying ability is low, and it is difficult to carry a necessary and sufficient quantity of developer to the discharge hole. In the present embodiment, the inward protrusion amount A2 in the radial direction of each of the first and second projection pieces 36 and 39 from the remaining portion of the inner periphery portions maybe 6 mm, for example. Furthermore, the larger the number of the first and second projection pieces 36 and 39 is, the higher the carrying ability is. In the present embodiment, the number of the first projection pieces 36 may be 26, and the number of the second projection pieces 39 may be 38.

Furthermore, an angle a formed by a tangent line of the first projection piece 36 and a tangent line in the circumferential direction of the first container segment 33 and an angle a formed by a tangent line of the second projection piece 39 and a tangent line in the circumferential direction of the second container segment 34 can be 2 degrees or more and 45 degrees or less, more preferably, 5 degrees or more and 30 degrees or less. In the present embodiment, the angle a may be about 9 degrees, for example. The developer carrying ability of the container main body 31 is determined by geometric conditions of the first projection pieces 36 and the second projection pieces 39 as described before, and determined so that a proper quantity can be discharged from the discharge hole 43 at all times from the time when the container main body 31 is filled with the developer to the time just before the developer is completely exhausted.

At the bottom portion 34*a* of the second container segment 34, at least a face where an outer periphery face and an end face are connected is formed into a curved shape inclining inwardly in the radial direction as it goes from an opening end portion 34*b* to the bottom portion 34*a*. Describing in detail, an end face 34*c* of the bottom portion 34*a* of the second container segment 34 is formed into a partly spherical shape that middle portion of the end face protrudes in a direction from the opening end portion 34*b* to the bottom portion 34*a*. On the outer periphery portion of the second container segment 34, in positions spaced from an end face of the opening end portion 34*b* toward the bottom portion 34*a*, a plurality of guiding projection pieces 40, in the present embodiment, two guiding projection pieces 40 protruding outwardly in the radial direction are disposed spaced in the circumferential direction. An axial size of each of the guiding projection pieces 40 can be arbitrarily set, and may be 2.5 mm, for example.

Figure 7:
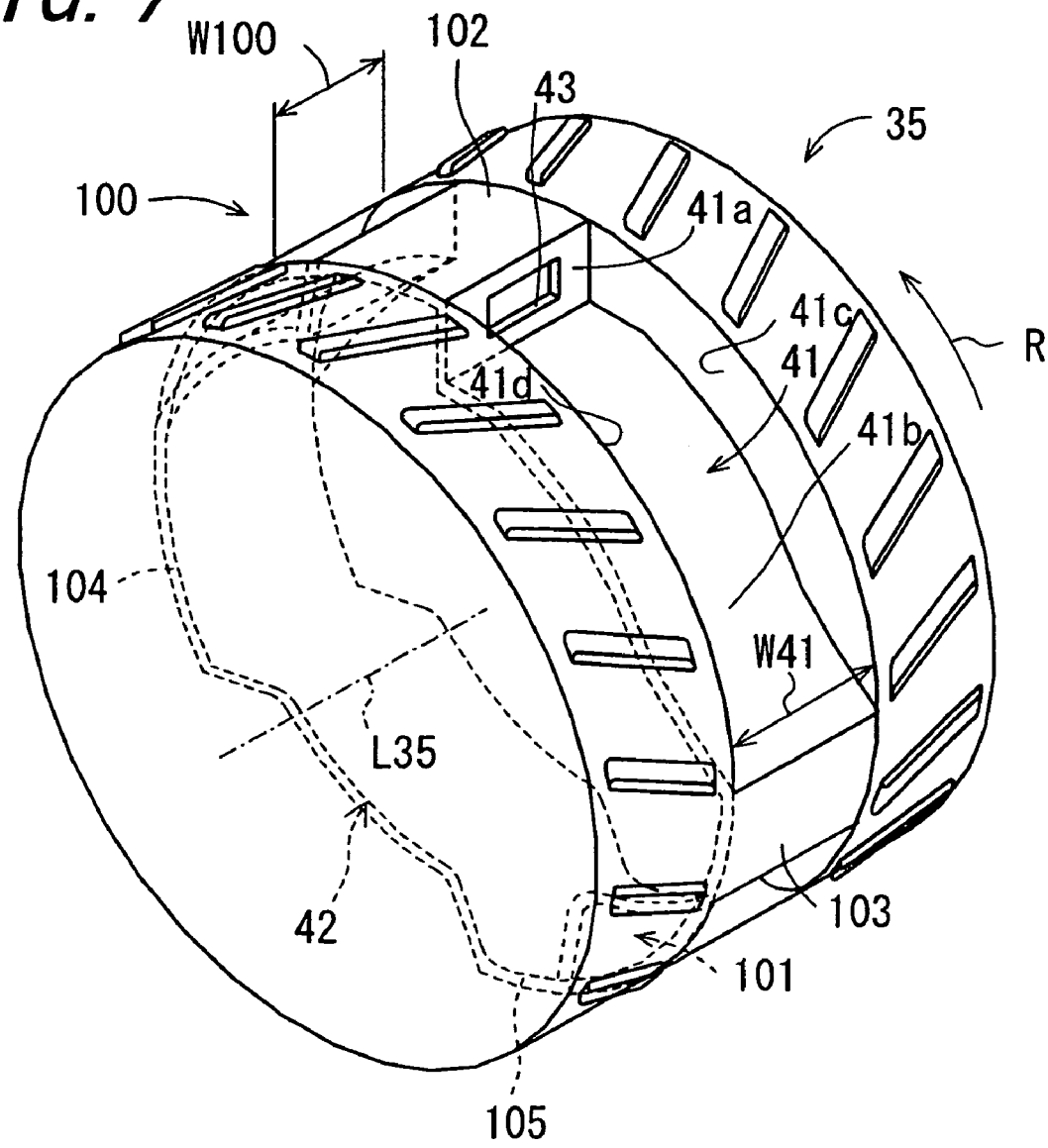
FIG. 7 is a perspective view illustrating a third container segment.
Figure 8:
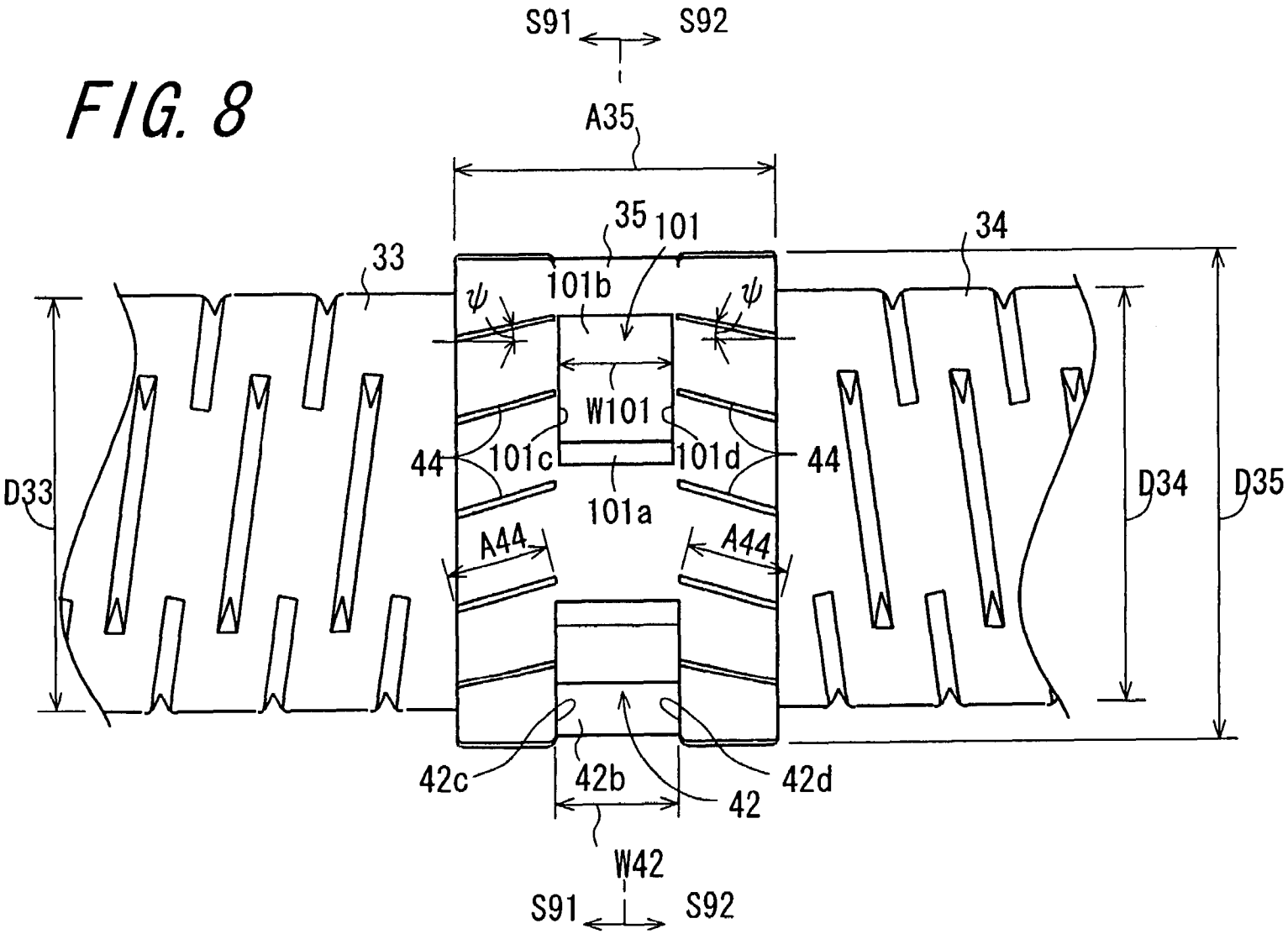
FIG. 8 is a magnified front view illustrating an area around the third container segment.
Figure 9A:
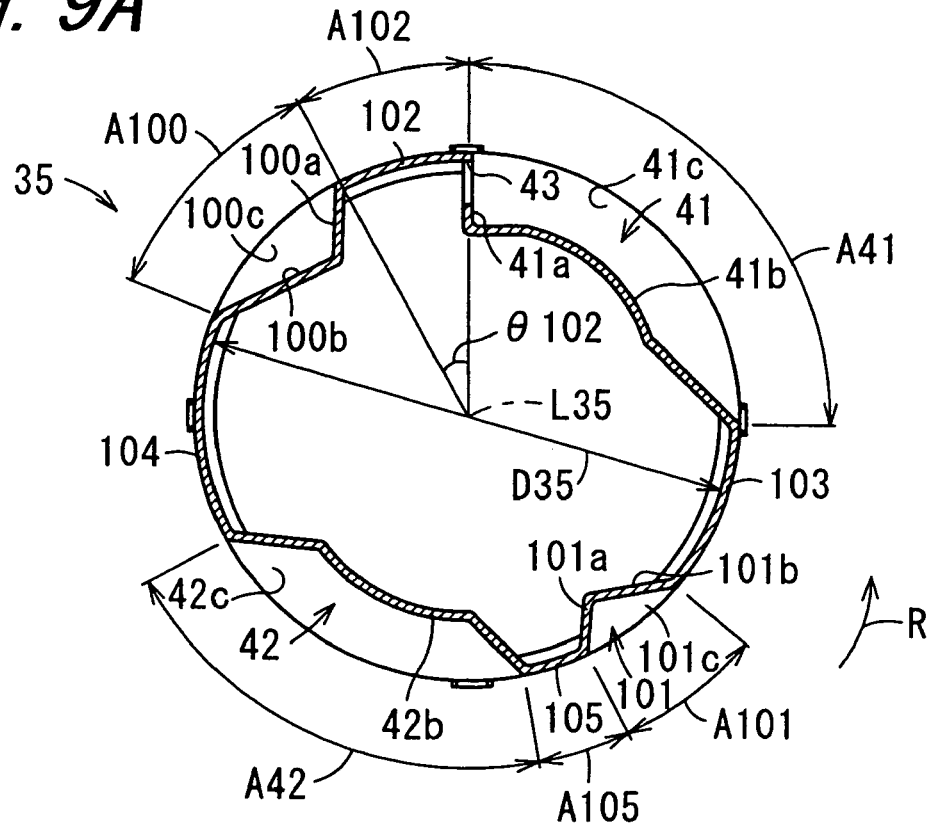
FIG. 9A is a cross section taken on a cutting plane line S91-S91 of FIG. 8.
Figure 9B:
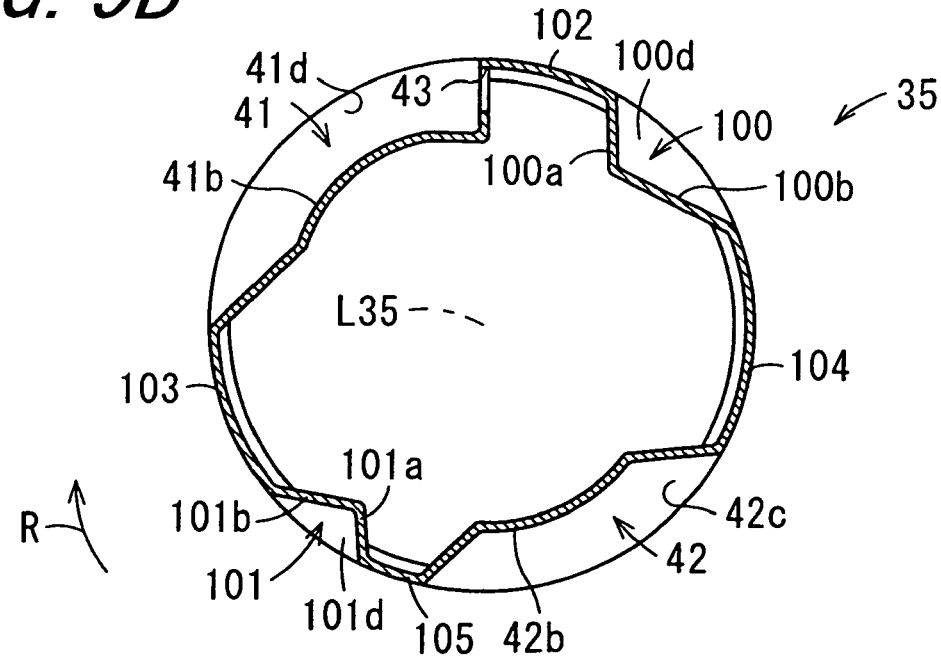
FIG. 9B is a cross section view taken on a cutting plane line S92-S92 of FIG. 4.

FIG. 7 is a perspective view illustrating the third container segment 35. FIG. 8 is a magnified front view illustrating an area around the third container segment 35. FIG. 9A is a cross section view taken on a cutting plane line S91-S91 of FIG. 8, and FIG. 9B is a cross section view taken on a cutting plane line S92-S92 of FIG. 8. FIG. 4 will be also referred to. The third container segment 35 is formed into a substantially cylindrical shape. Describing in detail, the third container segment 35 has, at an axial middle portion of an outer periphery portion thereof, a first concavity 41 and a second concavity 42 that are depressed portions depressed inwardly in the radial direction, and has the discharge hole 43 formed on the first concavity 41 to discharge the developer. The container main body 31 is provided with an adhesion eliminating portion for eliminating developer adhering to a developer guiding member 38 through rotation of the container main body 31. In the present embodiment, the adhesion eliminating portion is, in specific, a first depressed portion 100 and a second depressed portion 101 that are disposed to part of the outer periphery portion of the third container segment 35 and depressed inwardly in the radial direction.

An axial length A35 of the third container segment 35 may be 80 mm, for example. An inner diameter D35 of the third container segment 35 excluding the concavities 41, 42 and the depressed portions 100, 101 is set so as to be larger than the inner diameters D33 and D34 of the first and second container segments 33 and 34, which are the remaining part. The inner diameter D35 of the outer periphery portion of the third container segment 35 can be arbitrarily set, and may be 110 mm, for example.

The first concavity 41 is formed extending in the rotation direction R so that an axial size W41 thereof is smaller than a size A41 in the rotation direction R thereof, and has an end wall portion 41*a* crossing the rotation direction R at an end portion of an inner wall portion on the downstream side in the rotation direction R. The discharge hole 43 is formed at part of the end wall portion 41*a* on the downstream side in the rotation direction of the first concavity 41. The second concavity 42 is formed extending in the rotation direction R so that an axial size W42 thereof is smaller than a size A42 in the rotation direction R thereof.

The first depressed portion 100 and the second depressed portion 101 are each formed into a substantially L-letter shape in cross section perpendicular to an axial line L35. The first depressed portion 100 is formed extending in the rotation direction R so that an axial size W100 thereof is smaller than a size A100 in the rotation direction R thereof, for example. The first depressed portion 100 has an end wall portion 100*a* crossing the rotation direction R at an upstream end portion in the rotation direction R of an inner wall thereof. The size A100 in the rotation direction R of the first depressed portion 100 is set so as to be smaller than the sizes A41 and A42 in the rotation direction R of the first and second concavities 41 and 42.

The second depressed portion 101 is formed extending in the rotation direction R so that an axial size W101 thereof is smaller than a size A101 in the rotation direction R thereof, for example. The second depressed portion 101 has an end wall portion 101*a* crossing the rotation direction R at an upstream end portion in the rotation direction R of an inner wall thereof. The size. A101 in the rotation direction R of the second depressed portion 101 is set so as to be smaller than the sizes A41 and A42 in the rotation direction R of the first and second concavities 41 and 42.

The concavities 41, 42 and the depressed portions 100, 101 are arranged apart in the circumferential direction so that the concavities alternate with the depressed portions. In specific, the first concavity 41, the first depressed portion 100, the second concavity 41 and the second depressed portion 101 are arranged in this order, apart in the circumferential direction toward the downstream side in the rotation direction R. Consequently, a first outer periphery portion 102 is formed between the first depressed portion 100 and the first concavity 41 on the outer periphery portion of the third container segment 35, and a second outer periphery portion 103 is formed between the first concavity 41 and the second depressed portion 101 on the outer periphery portion of the third container segment 35. Moreover, a third outer periphery portion 104 is formed between the second concavity 42 and the first depressed portion 100 on the outer periphery portion of the third container segment 35. Furthermore, a fourth outer periphery portion 105 is formed between the second depressed portion 101 and the second concavity 42 on the outer periphery portion of the third container segment 35.

It is desired that the sum of the sizes A41, A100 and A102 in the rotation direction R of the first concavity 41, the first depressed portion 100 and the first outer periphery portion 102 is ¼ or more and less than ½ the outer circumference of the third container segment 35 excluding the concavities 41, 42 and the depressed portions 100, 101. The size A41 in the rotation direction R of the first concavity 41 may be 120 mm, for example, and the axial size W41 thereof may be 30 mm, for example.

The first depressed portion 100 is disposed from a position close to the first concavity 41 to a position away from the first concavity 41 toward downstream in the rotation direction R so as to oppose the end wall portion 41*a* of the first concavity 41 provided with the discharge hole 43 from downstream in the rotation direction. In specific, the first depressed portion 100 is disposed so that the outer circumference A102 of the first outer periphery portion 102 is 1/36 or more and 1/18 or less the outer circumference of the third container segment 35 excluding the concavities 41, 42 and the depressed portions 100, 101. In more specific, the first depressed portion 100 is disposed so that, on a virtual plane perpendicular to the axial line L35, about a center where the virtual plane crosses the axial line L35, a line joining one end portion of the first outer periphery portion 102 and the center and a line joining the other end of the first outer periphery portion 102 and the center form a first angle θ102 of 10 degrees or more and 20 degrees or less. The size A100 in the rotation direction R of the first depressed portion 100 may be 60 mm, for example, and the axial size W100 thereof may be 30 mm, for example.

It is desired that the sum of the sizes A42, A101 and A105 in the rotation direction R of the second concavity 42, the second depressed portion 101 and the fourth outer periphery portion 105 is ¼ or more and less than ½ the outer circumference of the third container segment 35 excluding the concavities 41, 42 and the depressed portions 100, 101. The outer circumference A105 of the fourth outer periphery portion 105 is determined so as to be 1/36 or more and less than 1/18 the outer circumference of the third container segment 35 excluding the concavities 41, 42 and the depressed portions 100, 101. The size A42 in the rotation direction R of the second concavity 42 may be 120 mm, for example, and the axial size W41 thereof may be 30 mm, for example. Moreover, the size A100 in the rotation direction R of the first depressed portion 100 may be 60 mm, for example, and the axial size W100 thereof may be 30 mm, for example.

Describing in detail, the first concavity 41 further has a bottom wall portion 41*b*, a first side wall portion 41*c* and a second side wall portion 41*d* as the inner wall portion. The bottom wall portion 41*b* of the first concavity 41 extends in the rotation direction R. A downstream end portion in the rotation direction R thereof is connected to an inward portion in the radial direction of the end wall portion 41*a*, and an upstream end portion in the rotation direction R thereof is smoothly connected to the second outer periphery portion 103.

A middle portion in the rotation direction R between the downstream end portion in the rotation direction R and the upstream end portion in the rotation direction R of the bottom wall portion 41*b* of the first concavity 41 is located more inwardly in the radial direction than the third container segment 35 excluding the concavities 41, 42 and the depressed portions 100, 101. The middle portion is formed in to a partly cylindrical shape centering on the axial line L35 of the third container segment 35 substantially. The radius of curvature of an outer periphery portion of the middle portion in the rotation direction R of the bottom wall portion 41*b* of the first concavity 41 can be arbitrarily set, and may be 49 mm, for example.

The first side wall portion 41*c* of the first concavity 41 is located on the side of an axial one end portion of the first concavity 41, and extends in the rotation direction R. A downstream end portion in the rotation direction R thereof is connected to an axial one end portion of the end wall portion 41*a*, an inward portion in the radial direction thereof is connected to an axial one end portion of the bottom wall portion 41*b*, and an outward portion in the radial direction thereof is connected to an outer periphery portion of an axial one end portion of the third container segment 35 excluding the first concavity 41 and the second concavity 42.

The second side wall portion 41*d* of the first concavity 41 is located on the side of an axial other end portion of the first concavity 41, and extends in the rotation direction R. A downstream end portion in the rotation direction R thereof is connected to an axial other end portion of the end wall portion 41*a*, an inward portion in the radial direction thereof is connected to an axial other end portion of the bottom wall portion 41*b*, and an outward portion in the radial direction thereof is connected to an outer periphery portion of an axial other end portion of the third container segment 35 excluding the concavities 41, 42 and the depressed portions 100, 101. The first side wall portion 41*c* and the second side wall portion 41*d* of the first concavity 41 are disposed upright outwardly in the radial direction from the bottom wall portion 41*b*. The bottom wall portion 41*b* and the first side wall portion 41*c* are substantially perpendicular, and the bottom wall portion 41*b* and the second side wall portion 41*d* are substantially perpendicular.

The discharge hole 43 is formed at an axial middle portion of the end wall portion 41*a* of the first concavity 41, outwardly in the radial direction, so as to be open like a rectangular shape whose longitudinal direction is the axial direction. Therefore, the discharge hole 43 is open on the end wall portion 41*a* of the first concavity 41, more outwardly in the radial direction than the downstream end portion in the rotation direction R of the bottom wall portion 41*b* of the first concavity 41, closer to the axial other end portion than the downstream end portion in the rotation direction R of the first side wall portion 41*c*, and closer to the axial one end portion than the downstream end portion in the rotation direction R of the second side wall portion 41*d*. Describing in more detail, an outward face in the radial direction of the discharge hole 43 is smoothly connected to the inner periphery face of the third container segment 35 excluding the concavities 41, 42 and the depressed portions 100, 101, on the downstream side in the rotation direction R of the first concavity 41.

Describing in detail, the second concavity 42 has a bottom wall portion 42*b*, a first side wall portion 42*c* and a second side wall portion 42*d* as the inner wall portion. The bottom wall portion 42*b* of the second concavity 42 extends in the rotation direction R. The bottom wall portion 42*b* of the second concavity 42 is formed so that an upstream end portion in the rotation direction R is smoothly connected to the third outer periphery portion 104. The bottom wall portion 42*b* of the second concavity 42 is formed so that a downstream end portion in the rotation direction R is smoothly connected to the fourth outer periphery portion 105. A middle portion in the rotation direction R between the downstream end portion in the rotation direction R and the upstream end portion in the rotation direction R of the bottom wall portion 42*b* of the second concavity 42 is located more inwardly in the radial direction than the third container segment 35 excluding the concavities 41, 42 and the depressed portions 100, 101, and formed into a partly cylindrical shape centering on the axial line L35 of the third container segment 35 substantially. The radius of curvature of an outer periphery portion of the middle portion in the rotation direction R of the bottom wall portion 42*b* of the second concavity 42 can be arbitrarily set, and may be 49 mm, for example.

The first side wall portion 42*c* of the second concavity 42 is located on the side an axial one end portion of the second concavity 42, and extends in the rotation direction R. An inward portion in the radial direction thereof is connected to an axial one end portion of the bottom wall portion 42*b*, and an outward portion in the radial direction is connected to an outer periphery portion of the axial one end portion of the third container segment 35 excluding the first concavity 41 and the second concavity 42.

The second side wall portion 42*d* of the second concavity 42 is located on the side of an axial other end portion of the second concavity 42. An inward portion in the radial direction thereof is connected to an axial other end portion of the bottom wall portion 42*b*, and an outward portion in the radial direction thereof is connected to an outer periphery portion of the axial other end portion of the third container segment 35 excluding the first concavity 41 and the second concavity 42. The first side wall portion 42*c* and the second side wall portion 42*d* of the second concavity 42 are disposed upright outwardly in the radial direction from the bottom wall portion 42*b*. The bottom wall portion 42*b* and the first side wall portion 42*c* are substantially perpendicular, and the bottom wall portion 42*b* and the second side wall portion 42*d* are substantially perpendicular.

Describing in detail, the first depressed portion 100 further has a bottom wall portion 100*b*, a first side wall portion 100*c* and a second side wall portion 100*d* as the inner wall portion. The bottom wall portion 100*b* of the first depressed portion 100 extends in the rotation direction R. An upstream end portion in the rotation direction R thereof is connected to an inward portion in the radial direction of the end wall portion 100*a*, and a downstream end portion in the rotation direction R thereof is connected to the third outer periphery portion 104. In the present embodiment, an outward surface in the radial direction (may be referred to as "outer periphery face" hereafter) of each of the side wall portion 100*a* and the bottom wall portion 100*b* of the first depressed portion 100 is formed into a rectangular plane.

The first side wall portion 100*c* of the first depressed portion 100 is located on the side an axial one end portion of the first depressed portion 100, and extends in the rotation direction R. An inward portion in the radial direction thereof is connected to an axial one end portion of the bottom wall portion 100*b*, and an outward portion in the radial direction thereof is connected to the outer periphery portion of the axial one end portion of the third container segment 35 excluding the concavities 41, 42 and the depressed portions 100, 101. The second side wall portion 100*d* of the first depressed portion 100 is located on the side of an axial other end portion of the first depressed portion 100. An inward portion in the radial direction thereof is connected to an axial other end portion of the bottom wall portion 100*b*, and an outward portion in the radial direction thereof is connected to the outer periphery portion of the axial other end portion of the third container segment 35 excluding the concavities 41, 42 and the depressed portions 100, 101. The first side wall portion 100*c* and the second side wall portion 100*d* of the first depressed portion 100 are disposed upright outwardly in the radial direction from the bottom wall portion 100*b*. The bottom wall portion 100*b* and the first side wall portion 100*c* are substantially perpendicular, and the bottom wall portion 100*b* and the second side wall portion 100*d* are substantially perpendicular.

The end wall portion 100*a* of the first depressed portion 100 is formed so as to steeply rise outwardly in the radial direction from the bottom wall portion 100*b*. In specific, the end wall portion 100*a* of the first depressed portion 100 is formed so as to steeply rise outwardly in the radial direction, as compared with the upstream end portions in the rotation direction R of the bottom wall portions 41*b* and 42*b* of the first and second concavities 41 and 42.

Describing in detail, the second depressed portion 101 further has a bottom wall portion 101*b*, a first side wall portion 101*c* and a second side wall portion 101*d* as the inner wall portion. The bottom wall portion 101*b* of the second depressed portion 101 extends in the rotation direction R. An upstream end portion in the rotation direction R thereof is connected to an inward portion in the radial direction of the end wall portion 101*a*, and a downstream end portion in the rotation direction R thereof is connected to the second outer periphery portion 103. In the present embodiment, an outer periphery face of each of the side wall portion 101*a* and the bottom wall portion 101*b* of the second depressed portion 101 is formed into a rectangular plane.

The first side wall portion 101*c* of the second depressed portion 101 is located on the side of an axial one end portion of the second depressed portion 101, and extends in the rotation direction R. An inward portion in the radial direction thereof is connected to an axial one end portion of the bottom wall portion 101*b*, and an outward portion in the radial direction thereof is connected to the outer periphery portion of the axial one end portion of the third container segment 35 excluding the concavities 41, 42 and the depressed portions 100, 101. The second side wall portion 101*d* of the second depressed portion 101 is located on the side of an axial other end portion of the second depressed portion 101. An inward portion in the radial direction thereof is connected to an axial other end portion of the bottom wall portion 101*b*, and an outward portion in the radial direction thereof is connected to the outer periphery portion of the axial other end portion of the third container segment 35 excluding the concavities 41, 42 and the depressed portions 100, 101. The first side wall portion 101*c* and the second side wall portion 101*d* of the second depressed portion 101 are disposed upright outwardly in the radial direction from the bottom wall portion 101*b*. The bottom wall portion 101*b* and the first side wall portion 101*c* are substantially perpendicular, and the bottom wall portion 101*b* and the second side wall portion 101*d* are substantially perpendicular.

The end wall portion 101*a* of the second depressed portion 101 is formed so as to steeply rise outwardly in the radial direction from the bottom wall portion 101*b*. In specific, the end wall portion 100*a* of the second depressed portion 101 is formed so as to steeply rise outwardly in the radial direction, as compared with the upstream end portions in the rotation direction R of the bottom wall portions 41*b* and 42*b* of the first and second concavities 41 and 42.

As illustrated in FIG. 8, on the outer periphery portions of the axial one and other end portions of the third container segment 35 excluding the concavities 41, 42 and the depressed portions 100, 101, a plurality of discharge guide pieces 44 protruding outwardly in the radial direction are located and formed apart from each other in the circumferential direction, at equal intervals in the circumferential direction. Describing in detail, the discharge guide pieces 44 formed at the axial one end portion of the third container segment 35 incline in the rotation direction R as they go from the axial other end portion to the axial one end portion. Describing in detail, the discharge guide pieces 44 formed at the axial other end portion of the third container segment 35 incline in the rotation direction R as they go from the axial one end portion to the axial other end portion. An outward protrusion amount in the radial direction of the discharge guide piece 44 from the outer periphery portion of the third container segment 35 excluding the concavities 41, 42 and the depressed portions 100, 101 may be 1 mm, for example. A longitudinal size of the discharge guide piece 44 may be 24 mm, and an angle ψ formed by a longitudinal direction of the discharge guide piece 44 and a width direction of the third container segment 35 may be 30 degrees, for example.

The container main body 31 is formed in one body by coupling the axial one end portion of the third container segment 35 and the opening end portion 33*b* of the first container segment 33 and coupling the axial other end portion of the third container segment 35 and the opening end portion 34*b* of the second container segment 34. The container main body 31 may be produced by blow molding of a synthetic resin such as polyethylene, for example. Consequently, it is possible to easily produce the container main body 31, and it is possible to reduce components of the developer container 30. Moreover, since the first angle θ102 is selected within a range of 20 degrees or less, the end wall portion 100*a* of the first depressed portion 100 is formed in the vicinity of the discharge hole 43, which is a parting position where a die for a blow molding process opens, and it is possible to easily form the end wall portion 100*a* so as to steeply rise outwardly in the radial direction.

The bottom portion 33*a* of the first container segment 33 is the axial one end portion 33*a* of the container main body 31, and the bottom portion 34*a* of the second container segment 34 is the axial other end portion 34*a* of the container main body 31. Thus, the first container segment 33, the second container segment 34 and the third container segment 35 are coupled so that the respective axes L33, L34 and L35 thereof are coaxial, whereby the container main body 31 is formed. In this state, the third container segment 35 is located in an axial middle position of the container main body 31 excluding both the axial end portions 33*a* and 34*a*. Therefore, the first container concavity 41, the second container concavity 42 and the discharge hole 43 of the third container segment 35 are located in the axial middle position of the container main body 31 excluding both the axial end portions 33*a* and 34*a*. The axial line L31 of the container main body 31 is composed of the axial line L33 of the first container segment 33, the axial line L34 of the second container segment 34 and the axial line L35 of the third container segment 35. In the present embodiment, the concavities 41, 42 and the depressed portions 100, 101 are formed on the third container segment 35 so that, as illustrated in FIGS. 9A and 9B, cross sections in the axial middle position of the third container segment 35 perpendicular to the axial line L35 are substantially symmetrical with respect to a point.

Figure 10:
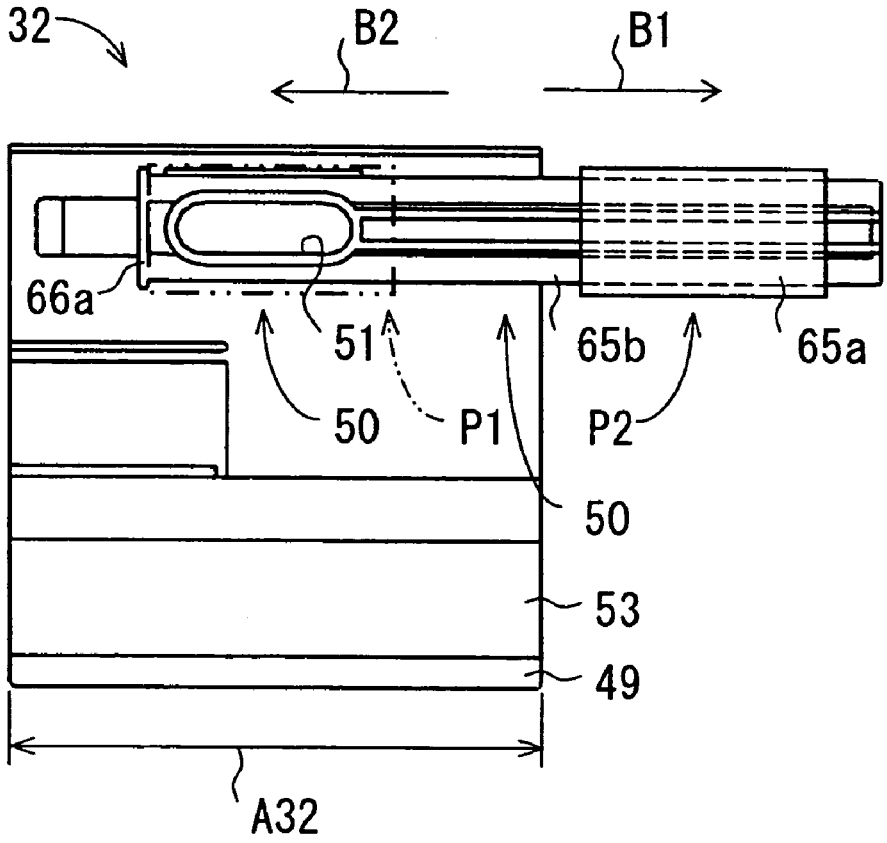
FIG. 10 is a front view illustrating a supporting member.
Figure 11:
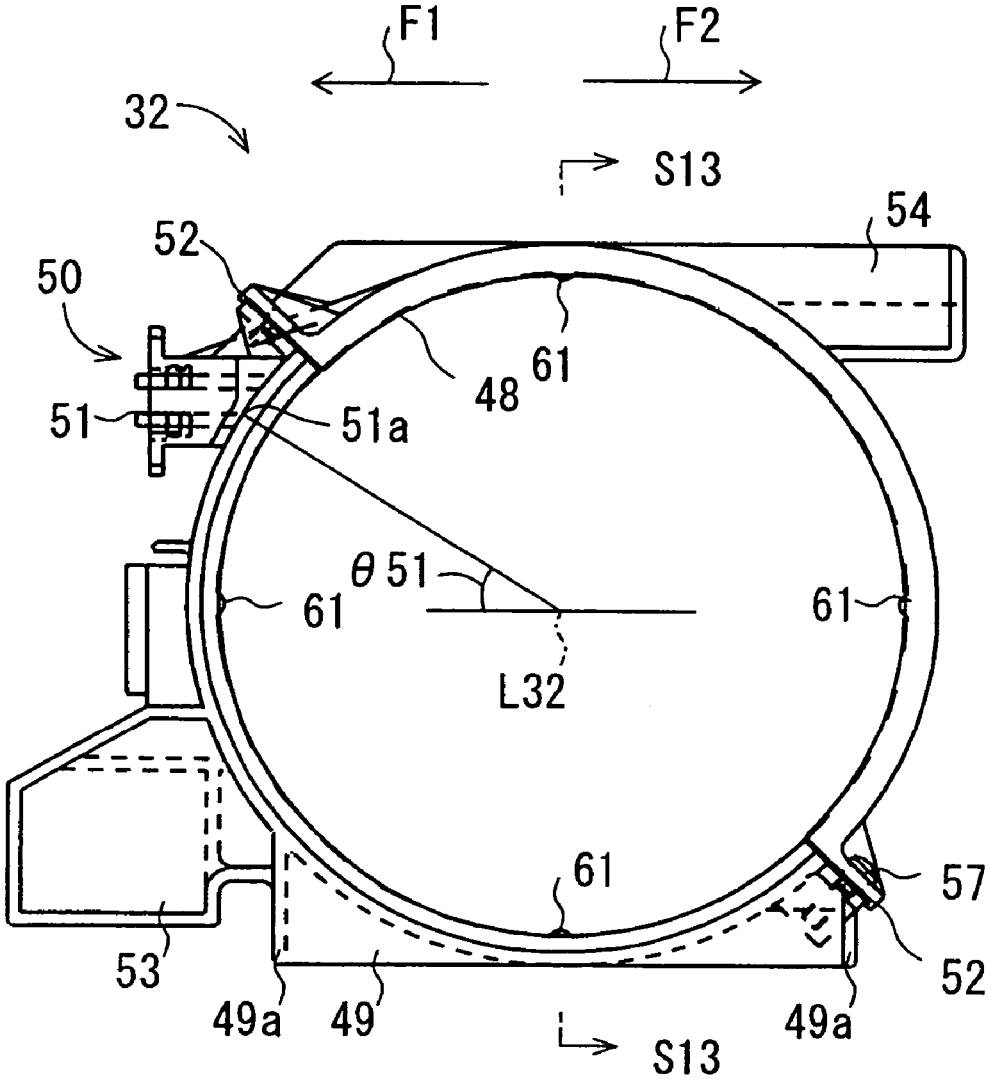
FIG. 11 is a right side view illustrating the supporting member.

FIG. 10 is a front view illustrating the supporting member 32. FIG. 11 is a right side view illustrating the supporting member 32. The supporting member 32 has an inner periphery portion 48 that is formed into a substantially cylindrical shape and that supports a part including at least the third container segment 35 of the container main body 31 configured as described before over circumferences thereof from outside in the radial direction. The inner periphery portion 48 has a cylindrical inner periphery face about the axial line L32. The supporting member 32 includes a supporting base 49 having at least three or more abutment portions 49*a* on a virtual plane parallel to the axial line 122. The abutment portions 49*a* of the supporting base 49 may be formed into two rectangular planes whose longitudinal direction is a direction parallel to the axial line L32, for example. By making the abutment portions 49*a* of the supporting base 49 abut on a horizontal plane, it is possible to place so as to make an axial line L32 of the inner periphery portion 48 of the supporting member 32 parallel to the horizontal plane. An axial length A32 of the supporting member 32 is set so as to be larger than the axial length A35 of the third container segment 35. The axial length A32 of the supporting member 32 can be arbitrarily set, and may be 100 mm, for example.

In a state where the supporting base 49 is placed on the horizontal plane, the supporting member 32 is provided with, at an upper portion thereof, a discharge portion 50 that protrudes in one first horizontal direction F1, which is one direction of one horizontal direction. The discharge portion 50 is provided with, at a middle portion thereof along the axial line of the supporting member 32, a leading through hole 51 that passes through along the one first horizontal direction F1 and is open like an ellipse shape extending in a direction parallel to the axial line L32 of the supporting member. A longitudinal inner diameter of the leading through hole 51 is set so as to be equal to or larger than the axial size W41, the axial size W42, the axial size W100 and the axial size W101 of the first concavity 41, the second concavity 42, the first depressed portion 100 and the second depressed portion 101 of the container main body 31.

With respect to the leading through hole 51, it is preferred that a downstream opening end 51*a* in the rotation direction R of the leading through hole 51 on the side of the inner periphery portion 48 is disposed in such a position that a line connecting the opening end 51*a* and a center where the axial line L32 and the first horizontal direction F1, F2 cross, and a line of the first horizontal direction F1, F2 including the axial line L32 form a seventh angle θ51 of 30 degrees or more and 70 degrees or less. In a case where the seventh angle θ51 is less than 30 degrees, the more the quantity of developer stored in the container main body 31 is, the more the quantity of the developer discharged from the leading through hole 51 is. In a case where the seventh angle θ51 is more than 70 degrees, the less the quantity of the developer stored in the container main body 31 is, the less the quantity of the developer discharged from the leading through hole is. Therefore, by selecting the seventh angle θ51 within the a fore mentioned range, it is possible to keep the quantity of the developer discharged from the leading through hole 51 constant regardless of the quantity of developer stored in the container main body 31.

The discharge portion 50 of the supporting member 32 is provided with a shutter portion 65 that switches an opening of the leading through hole 51 on a downstream side in the one first horizontal direction F1, between an opened state and a closed state. The shutter portion 65 includes a shutter 65*a* and a shutter guide 65*b*. The shutter guide 65*b* extends in a second horizontal direction that is a horizontal direction perpendicular to the first horizontal direction. At an end portion of the shutter guide on an upstream side in one second horizontal direction B1, the leading through hole 51 is open. The shutter 65*a* is supported by the shutter guide 65*b* so as to freely slidingly move in the one second horizontal direction B1 and in the other second horizontal direction B2 opposite to the one second horizontal direction B1.

The shutter 65*a* slidingly moves along the shutter guide 65*b*, whereby the shutter can be placed in a closing position P1 to close the opening of the leading through hole 51 on the downstream side in the one first horizontal direction F1, which is illustrated with a two-dotted chain line in FIG. 10, and an opening position P2 to open the opening of the leading through hole 51 on the downstream side in the one first horizontal direction F1. Moreover, the shutter 65*a* is restrained from slidingly moving more downstream in the other second horizontal direction B2 than the closing position P1, and also restrained from slidingly moving more in the one second horizontal direction B1 than an end portion of the shutter guide 65*b* on the downstream side in the one second horizontal direction B1. That is to say, the opening position P2 is more downstream in the one second horizontal direction B1 than the closing position P1, and more upstream in the one second horizontal direction B1 than the end portion of the shutter guide 65*b* on the downstream side in the one second horizontal direction B1. Thus, the shutter 65*a* is placed in the opening position P2 by slidingly moving in the one second horizontal direction B1 from the closing position P1, and placed in the closing position P1 by slidingly moving in the other second horizontal direction B2 from the opening position P2. Moreover, the supporting member 32 is provided with two coupling protruding portions 52 that protrude outwardly in the radial direction. One of the coupling protruding portions 52 is located above the discharge portion 50 when the supporting base 49 is placed on the horizontal plane, and the other coupling protruding portion 52 is located symmetrically with the one coupling protruding portion 52 with respect to the axial line L32. Furthermore, in a state where the supporting base 49 is placed on the horizontal plane, the supporting member 32 is provided with a first guide piece 53 located below the discharge portion 50, protruding in the one first horizontal direction F1 and extending in parallel to the axial line L32. Besides, in a state where the supporting base 49 is placed on the horizontal plane, the supporting member 32 is provided with a second guide piece 54 placed above the discharge portion 50, protruding in the other first horizontal direction F2 opposite to the one first horizontal direction F1 and extending in parallel to the axial line L32.

Figure 12:
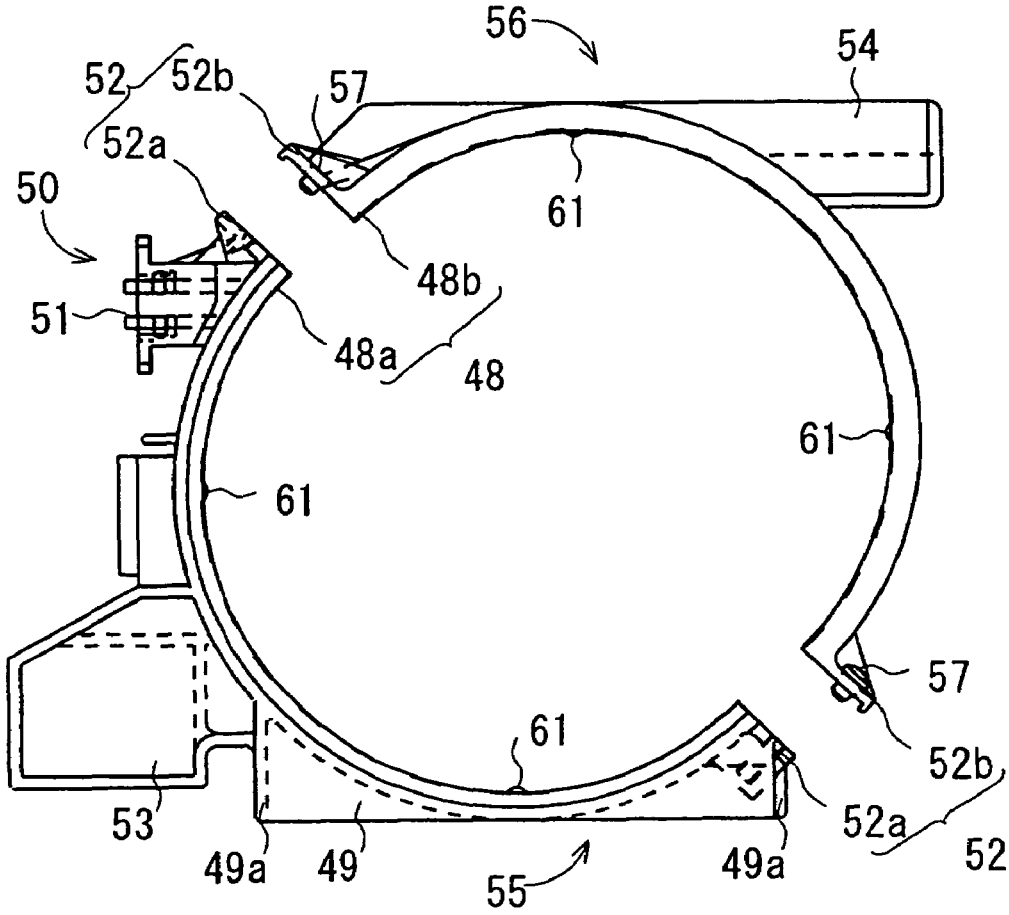
FIG. 12 is an exploded right side view illustrating the supporting member.

FIG. 12 is an exploded right side view illustrating the supporting member 32. When placed on the horizontal plane, the supporting member 32 can be divided in two by a virtual plane passing the axial line L32 and inclining upward as it goes in the one first horizontal direction F1. In detail, the supporting member can be divided into a first supporting portion 55 below the virtual plane and a second supporting portion 56 above the virtual plane. The first supporting portion 55 includes, of the supporting member 32, the first guide piece 53, the discharge portion 50, one coupling protruding portion 52*a* of the coupling protruding portions 52, the supporting base 49, and a portion 48*a* on the side of the first guide piece 53 of the inner periphery portion 48. The second supporting portion 56 includes, of the supporting member 32, the second guide piece 54, the other coupling protruding portion 52*b* of the coupling protruding portions 52, and a portion 48*b* on the side of the second guide piece 54 of the inner periphery portion 48.

The first supporting portion 55 and the second supporting portion 56 are coupled by a screw member 57 so as to be attached and detached. In detail, the one coupling protruding portion 52*a* of the coupling protruding portions 52 of the first supporting portion 55 and the other coupling protruding portion 52*b* of the coupling protruding portions 52 of the second supporting portion 56 are coupled by the screw member 57. Consequently, when supporting the container main body 31, it is possible to support the container main body 31 over circumferences thereof, by dividing the supporting member 32 in advance and making the divided supporting member 32 to support a part including the concavities 41, 42 and the discharge hole 43 of the container main body 31 from outside in the radial direction, and it is possible to easily carryout such an assembly operation.

Figure 13:
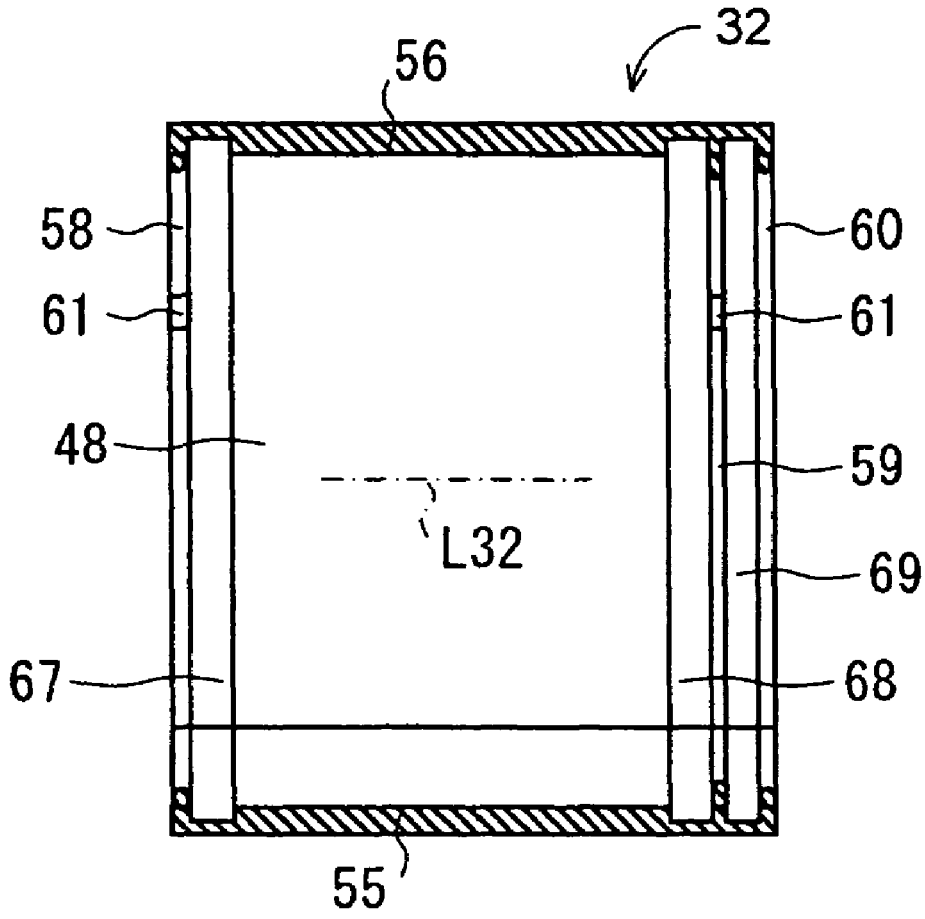
FIG. 13 is a cross section view taken on a cutting plane line S13-S13 of FIG. 11.

FIG. 13 is a cross section view taken on a cutting plane line S13-S13 of FIG. 11. FIG. 11 will be also referred to. On the axial one end portion of the inner periphery portion 48 of the supporting member 32 is formed a first supporting convexity 58 protruding inwardly in the radial direction and extending over circumferences thereof in the circumferential direction. On the axial other end portion of the inner periphery portion 48 of the supporting member 32 is formed a second supporting convexity 59 protruding inwardly in the radial direction and extending over circumferences thereof in the circumferential direction. Moreover, on the axial other end portion of the inner periphery portion 48 of the supporting member 32, a third supporting convexity 60 protruding inwardly in the radial direction and extending over circumferences thereof in the circumferential direction is disposed apart from the second supporting convexity 59 so as to be closer to the axial other end portion than the second supporting convexity 59. An axial interval between the second supporting convexity 59 and the third supporting convexity 60 is set so as to be slightly larger than the axial size of the guiding projection piece 40 of the second container segment 34 of the container main body 31, and may be 3 mm, for example.

On each of the first supporting convexity 58 and the second supporting convexity 59, a plurality of, in the present embodiment, four supporting projection pieces 61 protruding inwardly in the radial direction are formed at equal intervals in the circumferential direction. A front end portion on an inward side in the radial direction of the supporting projection piece 61 has a supporting face curved into a cylindrical outer periphery face. A diameter of a virtual circle centering on the axial line L32 and passing the front end portions of the supporting projection pieces 61 is set so as to be slightly larger than an outer diameter of the outer periphery portion of the first container segment 33 and an outer diameter of the outer periphery portion of the second container segment 34 excluding the guiding projection pieces 40, and may be 107 mm, for example. An inner diameter of the third supporting convexity 60 is set so as to be slightly larger than the outer diameter of the outer periphery portion of the second container segment 34 excluding the guiding projection pieces 40, and may be 107 mm, for example.

A first supporting concavity 67 depressed outwardly in the radial direction and extending over circumferences thereof in the circumferential direction is disposed adjacent to an axial other end portion of the first supporting convexity 58 at the axial one end portion of the inner peripheral portion 48 of the supporting member 32. A second supporting concavity 68 depressed outwardly in the radial direction and extending over circumferences thereof in the circumferential direction is disposed adjacent to an axial one end portion of the second supporting convexity 59 at the axial other end portion of the inner peripheral portion 48 of the supporting member 32. Moreover, a third supporting concavity 69 depressed outwardly in the radial direction and extending over circumferences thereof in the circumferential direction is disposed between the second supporting convexity 59 and the third supporting convexity 60 at the axial other end portion of the inner peripheral portion 48 of the supporting member 32. An axial size of each of the first and second supporting concavities 67 and 68 may be 7 mm, for example. An axial size of the third supporting concavity 69 is set so as to be slightly larger than the axial size of the guiding projection piece 40 of the second container segment 34 of the container main body 31, and may be 3 mm, for example.

Figure 14:
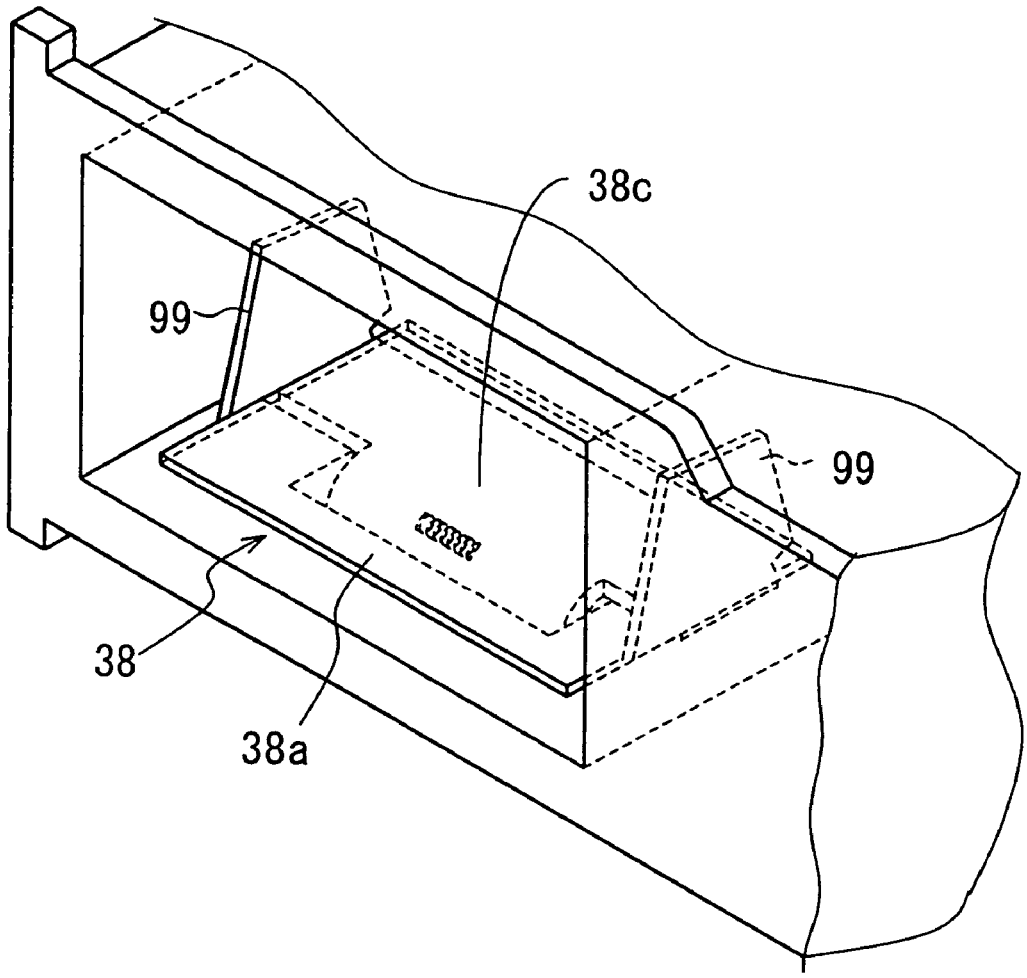
FIG. 14 is a perspective view illustrating a developer guiding member seen from the outside of the supporting member.
Figure 15:
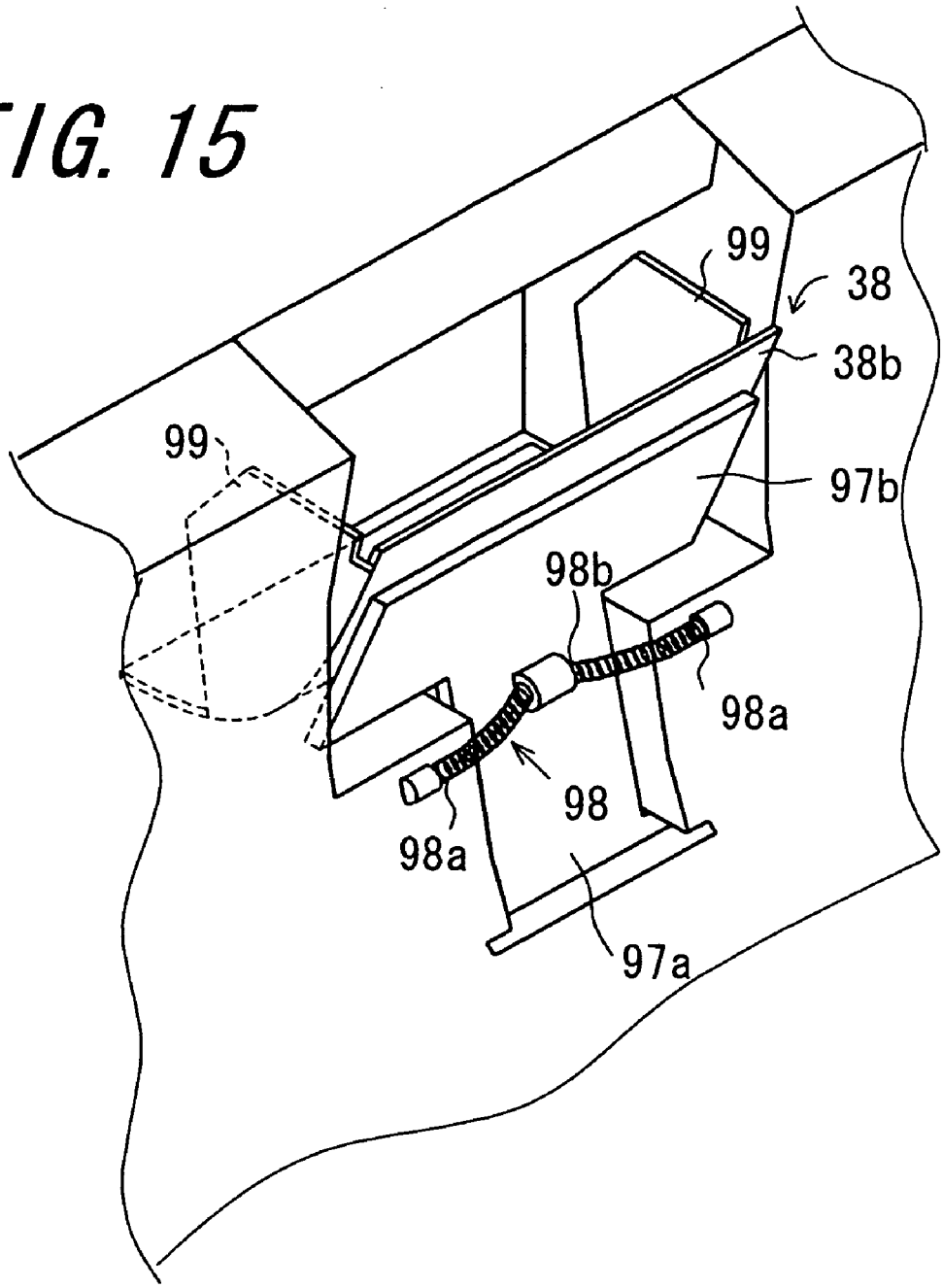
FIG. 15 is a perspective view illustrating the developer guiding member, a deformation preventing member and a spring member 98 seen from an inner periphery portion of the supporting member.

FIG. 14 is a perspective view illustrating the developer guiding member 38 seen from the outside of the supporting member 32. FIG. 15 is a perspective view illustrating the developer guiding member 38, a deformation preventing member 97 and a spring member 98 seen from the inner periphery portion 48 of the supporting member 32. The developer container 30 further comprises the developer guiding member 38, the deformation preventing member 97 and the spring member 98. The developer guiding member 38 is formed like a sheet and formed facing a moving path of the concavities 41, 42 and the depressed portions 100, 101 at the time of rotation of the container main body 31 in the supporting member 32, and extends upstream in the rotation direction from the leading through hole 51. The developer guiding member 38 guides the developer discharged from the discharge hole 43 of the container main body 31 to the leading through hole 51. Of the developer guiding member 38, at least an upstream end portion 38*b* in the rotation direction may be made of a material having flexibility and springiness, such as polyethylene terephthalate (abbreviated to PET). On both axial end portions of the developer guiding member 38, guide walls 99 protruding outwardly in the radial direction are formed. The upstream end portion 38*b* in the rotation direction of the developer guiding member 38 is, namely, a free end portion opposite to a proximal end portion.

The deformation preventing member 97 prevents plastic deformation of a middle portion 38*c* between a downstream end portion 38*a* in the rotation direction and the upstream end portion 38*b* in the rotation direction of the developer guiding member 38. Describing in detail, a proximal end portion 97*a* of the deformation preventing member 97 is coupled to the leading through hole 51 of the supporting member 32 on the side of the supporting base 49 so as to freely make an angular displacement. Moreover, a free end portion 97*b* of the deformation preventing member 97 is formed like a plate extending in parallel to the rotation axial line L31, placed in a position more upstream in the rotation direction than the proximal end portion 97*a* and facing the leading through hole 51 of the supporting member 32, and fixed to the whole surface on the downstream side in the rotation direction of the middle portion 38*c* of the developer guiding member 38. Consequently, the deformation preventing member 97 is coupled to the supporting member 32 so as to freely make an angular displacement about an angular displacement axial line that passes the proximal end portion 97*a* and is parallel to the rotation axial line L31. At least the free end portion 97*b* of the deformation preventing member 97 is made of a material having sufficiently higher rigidity than the developer guiding member 38 enough to prevent plastic deformation of the developer guiding member 38, and may be made of polymeric resin such as polyacetal resin.

The spring member 98 serving as a spring force generating portion applies a spring force to the developer guiding member 38 so that the upstream end portion 38*b* in the rotation direction of the developer guiding member 38 resiliently abuts on the outer periphery face of the container main body 31 at the first and second concavities 41 and 42. For example, the spring member 98 is realized by a helical extension spring, a torsion spring and the like, and a helical extension spring is used in the present embodiment. The spring member 98 is fixed to the inner periphery portion 48 of the supporting member 32 at both end portions 98*a* in a stretching direction thereof, and fixed in the vicinity of the free end portion 97*b* of the deformation preventing member 97 at a middle portion 98*b* in the stretching direction. Thus, a spring force by which the upstream end portion 38*b* in the rotation direction of the developer guiding member 38 resiliently abuts on the outer periphery face of the container main body 31 at the first and second concavities 41, 42 and the first and second depressed portions 100, 101 is applied to the developer guiding member 38 via the deformation preventing member 97.

Figure 16A:
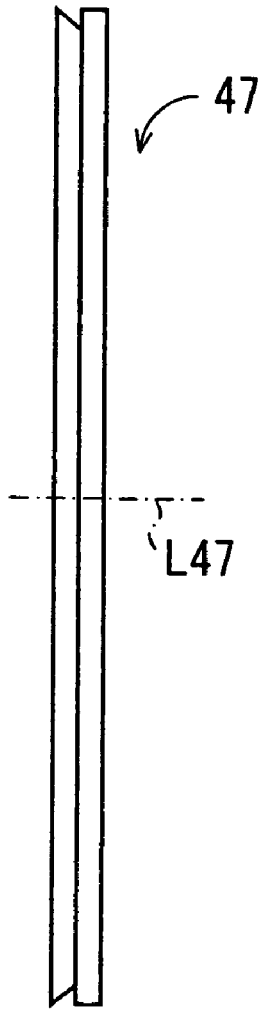
FIG. 16A is a front view illustrating a seal member.
Figure 16B:
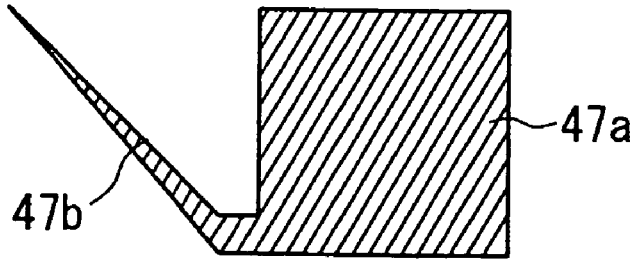
FIG. 16B is a view illustrating a cross section perpendicular to a circumferential direction of the seal member.

FIG. 16A is a front view illustrating a seal member 47, and FIG. 16B is a view illustrating a cross section perpendicular to the circumferential direction of the seal member 47. The seal member 47 serving as seal means is made of a material having flexibility and springiness, for example, a synthetic resin such as silicon rubber. The seal member 47 is formed into a substantially annular shape as illustrated in FIG. 16A. The seal member 47 includes a base portion 47*a* and an abutting portion 47*b* as illustrated in FIG. 16B. The base portion 47*a* of the seal member 47 is formed into a rectangular shape in cross section perpendicular to the circumferential direction about the axial line L35. The abutting portion 47*b* of the seal member 47 protrudes from an axial one end portion of the base portion 47*a*, which is an inward portion in the radial direction, so as to incline outwardly in the radial direction as it goes from the axial other end portion to the axial one end portion.

A diameter of an inner periphery portion of the base portion 47*a* of the seal member 47 is set so as to be smaller than an outer diameter of the outer periphery portion of the first container segment 33 of the container main body 31 and an outer diameter of the outer periphery portion of the second container segment 34 excluding the guiding projection pieces 40, and may be 99 mm, for example. Moreover, diameters of outer periphery portions of the base portion 47*a* and the abutting portion 47*b* of the seal member 47 are set so as to be equal to or larger than a diameter of a virtual circle centering on the rotation axial line L31 and passing outer periphery portions of the respective discharge guide pieces 44 of the third container segment 35 of the container main body 31, and may be 115 mm, for example. Furthermore, an axial size of the seal member 47 is set so as to be equal to or less than axial sizes of the first and second supporting concavities 67 and 68 of the supporting member 32, and may be 6 mm, for example.

Figure 17:
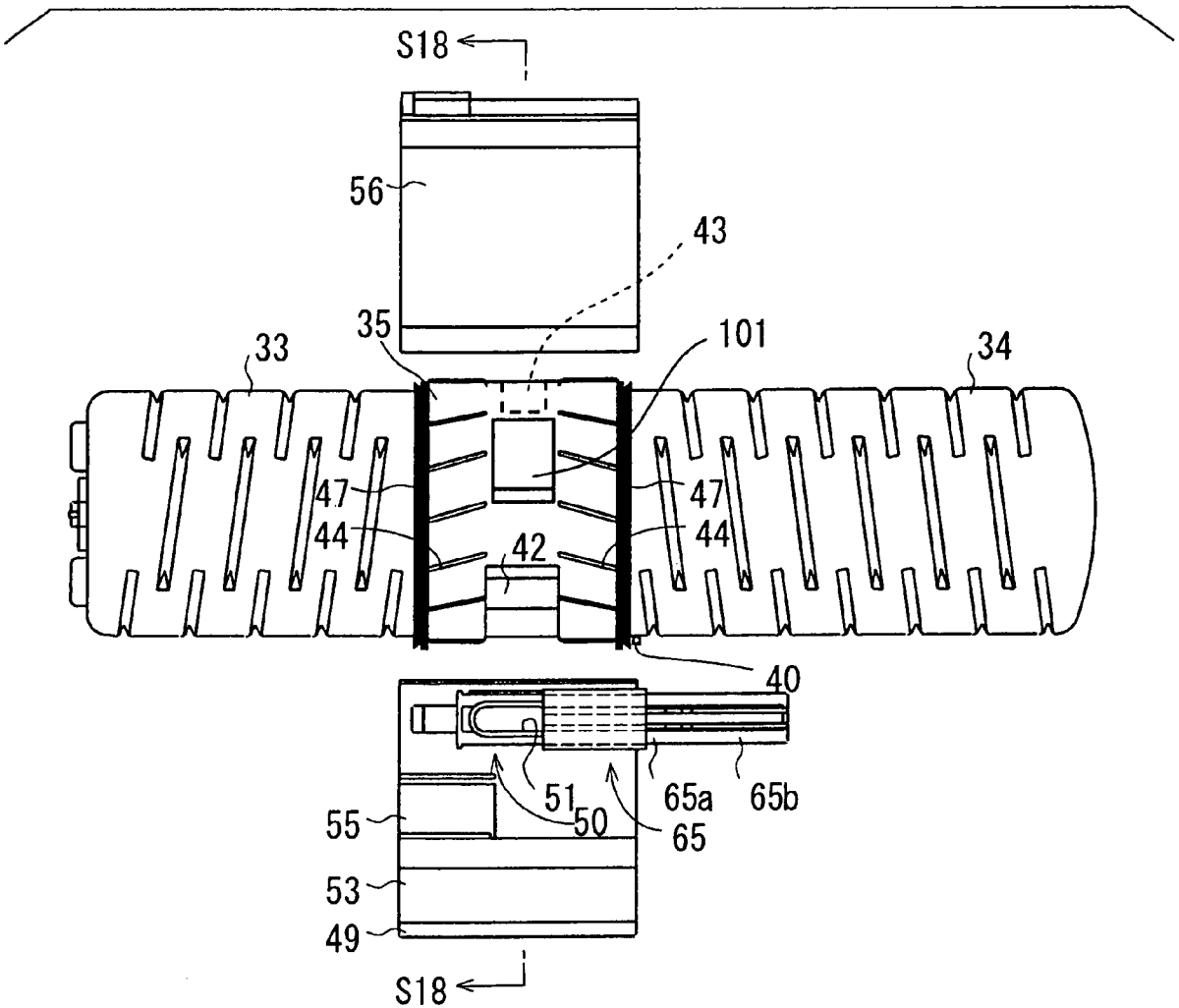
FIG. 17 is a front view illustrating assembly of the developer container.
Figure 18:
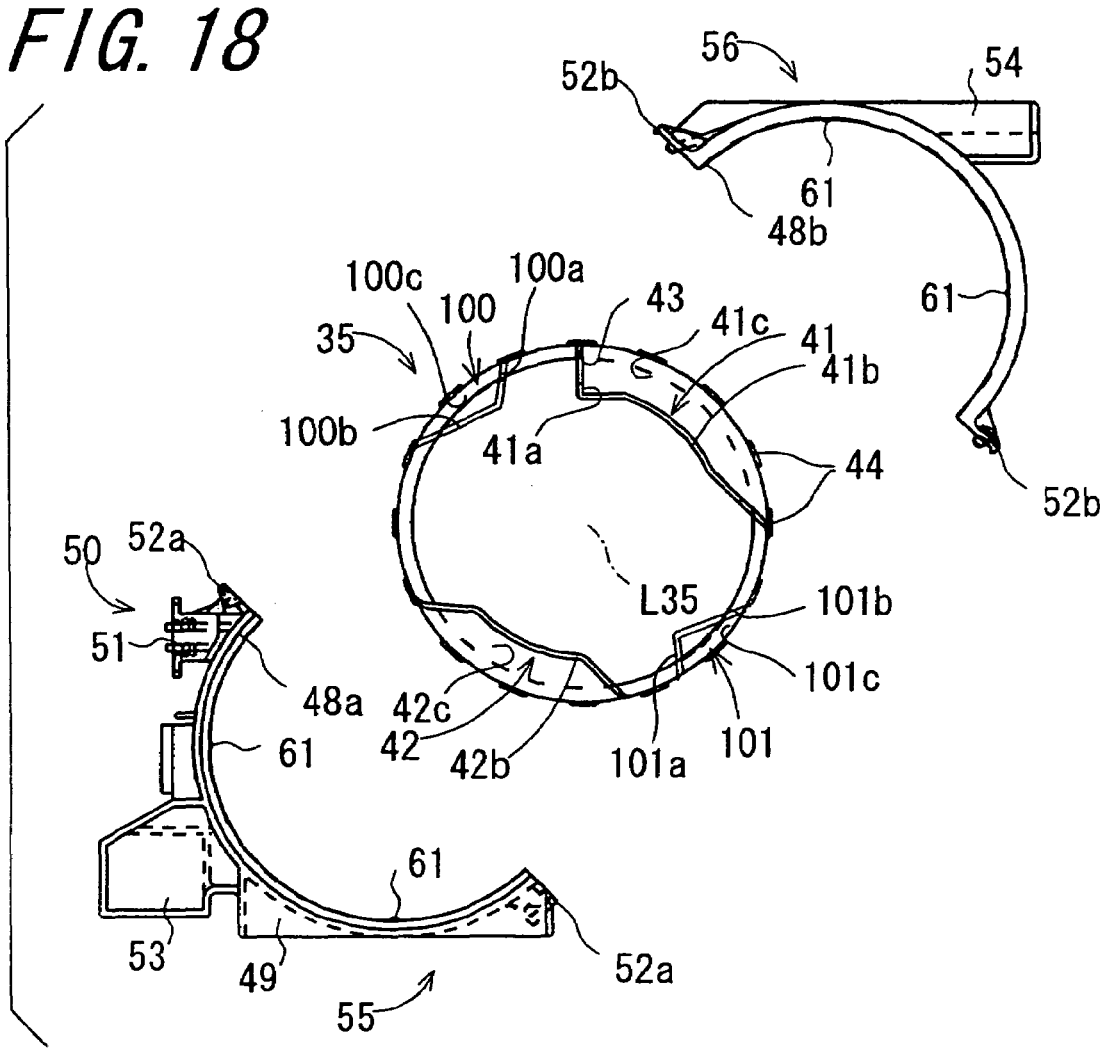
FIG. 18 is a cross section view taken on a cutting plane line S18-S18 of FIG. 17.

FIG. 17 is a front view illustrating assembly of the developer container 30. FIG. 18 is a cross section view taken on a cutting plane line S18-S18 of FIG. 17. Before assembly of the developer container 30, the supporting member 32 is divided into the first supporting portion 55 and the second supporting portion 56. Moreover, at this moment, one seal member 47 of the two seal members 47 is wound around the opening end portion 33*b* of the first container segment 33 so as to firmly adhere thereto, and the base portion 47*a* of the seal member 47 is attached to the first container segment 33 of the container main body 31 so as to firmly adhere to an end face of the axial one end portion of the third container segment 35. Furthermore, the other seal member 47 is wound around the opening end portion 34*b* of the second container segment 34 in a position closer to the axial one end portion than the guiding projection pieces 40 so as to firmly adhere thereto, and the base portion 47*a* of the seal member 47 is attached to the second container segment 34 of the container main body 31 so as to firmly adhere to an end face of the axial other end portion of the third container segment 35. A part including the third container segment 35 of the container main body 31 is held by the first supporting portion 55 and the second supporting portion 56 from outside in the radial direction. In this state, the first supporting portion 55 and the second supporting portion 56 are coupled by the screw member 57.

Figure 19:
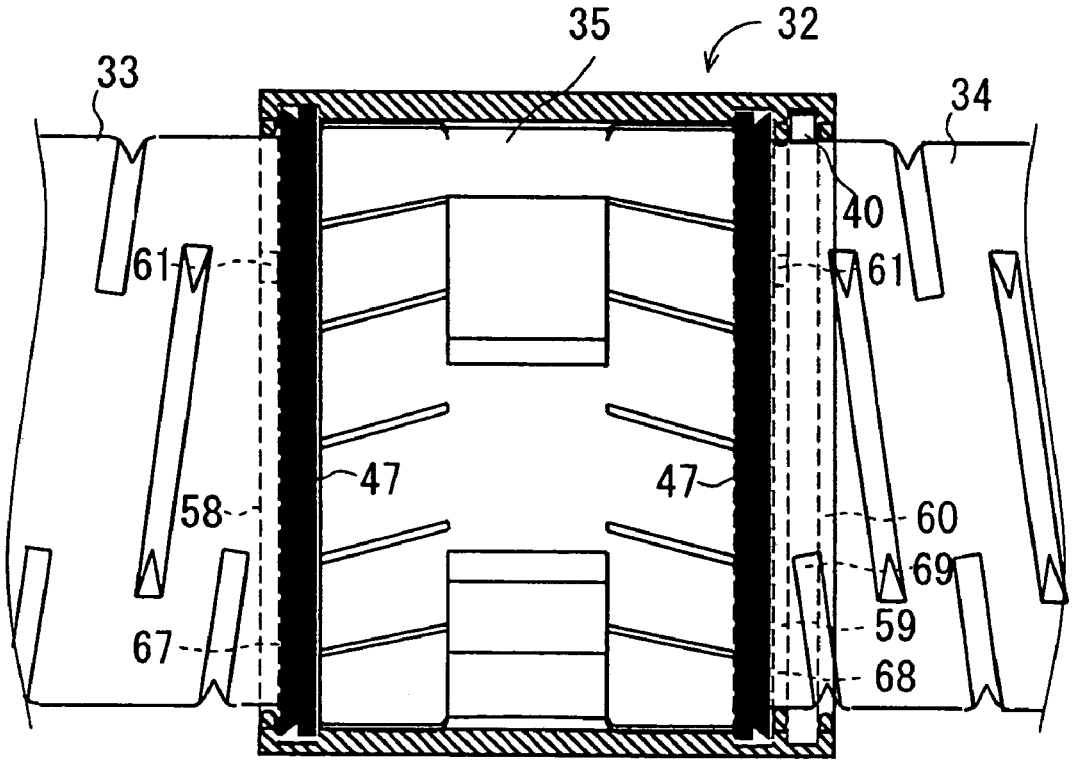
FIG. 19 is a cross section view taken on a cutting plane line S19-S19 of FIG. 3.

FIG. 19 is a cross section view taken on a cutting plane line S19-S19 of FIG. 3. When the container main body 31 is supported by the supporting member 32, the axial line L31 of the container main body 31 completely matches or substantially matches the axial line L32 of the inner periphery portion 48 of the supporting member 32, and the container main body 31 freely rotates about the axial line L31 in the supporting member 32. In a case where the supporting base 49 of the supporting member 32 is placed on the horizontal plane in this state, the first and second container segments 33 and 34 of the container main body 31 are spaced from the horizontal plane, and the horizontal plane and the rotation axial line L31 are parallel.

Describing the supporting member 32 in detail, each of the supporting projection pieces 61 of the first supporting convexity 58 abuts on the outer periphery portion of the first container segment 33, and each of the supporting projection pieces 61 of the second supporting convexity 59 abuts on the outer periphery portion of the second container segment 34 excluding the guiding projection pieces 40. Thus, the outer periphery portion of the first container segment 33 is supported by the supporting projection pieces 61 of the first supporting convexity 58 substantially at four spots equally spaced in the circumferential direction, and the outer periphery portion of the second container segment 34 is supported by the supporting projection pieces 61 of the second supporting convexity 59 substantially at four spots equally spaced in the circumferential direction. Consequently, it is possible to significantly reduce friction force opposing rotation of the container main body 31, between the outer periphery portion of the first container segment 33 and the first supporting convexity 58, and between the outer periphery portion of the second container segment 34 and the second supporting convexity 59.

The seal member 47 of the first container segment 33 fits into the first supporting concavity 67 of the supporting member 32, and the abutting portion 47*b* of the seal member 47 resiliently abuts on an axial other end face of the first supporting convexity 58 over circumferences there of. The seal member 47 of the second container segment 34 fits into the second supporting concavity 68 of the supporting member 32, and the abutting portion 47*b* of the seal member 47 resiliently abuts on an axial one end face of the second supporting convexity 59 over circumferences thereof. By the two seal members 47, sealing between the container main body 31 and the supporting member 32 over circumferences thereof in the circumferential direction is achieved in positions closer to the axial one end and closer to the axial other end of the container main body 31 than the first and second concavities 41, 42 and the discharge hole 43 of the container main body 31 and the leading through hole 51 of the supporting member 32.

The guiding projection pieces 40 of the second container segment 34 of the container main body 31 fit into the third supporting concavity 69 of the supporting member 32 so as to be restrained from slidingly moving in the axial direction in the supporting member 32. Consequently, the container main body 31 is restrained from slidingly moving in the axial direction in the supporting member 32. An outer periphery portion of each of the discharge guide pieces 44 of the third container segment 35 of the container main body 31 abuts on the inner periphery portion 48 of the supporting member 32. Thus, the supporting member 32 supports a part including at least the first concavity 41 of the container main body 31 over circumferences thereof from outside in the radial direction so as to be rotatable about the rotation axial line L31.

Figure 20:
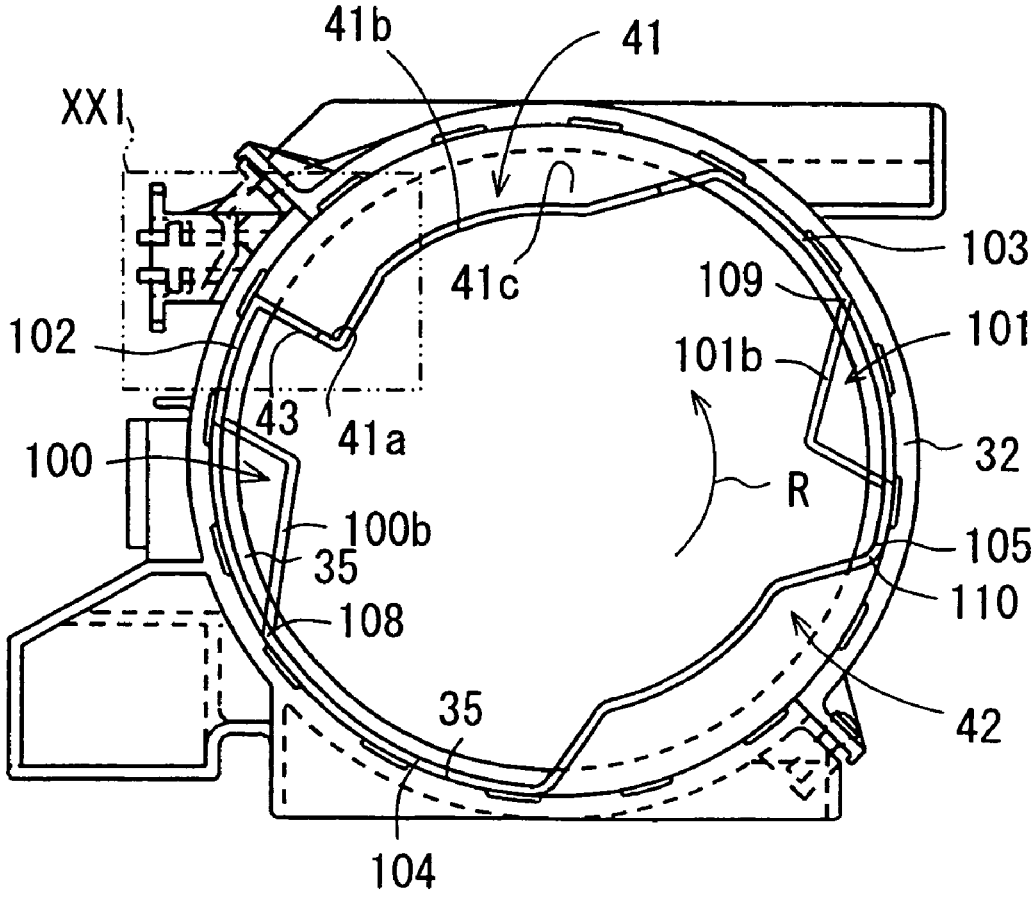
FIG. 20 is a cross section view taken on a cutting plane line S20-S20 of FIG. 2.
Figure 21A:
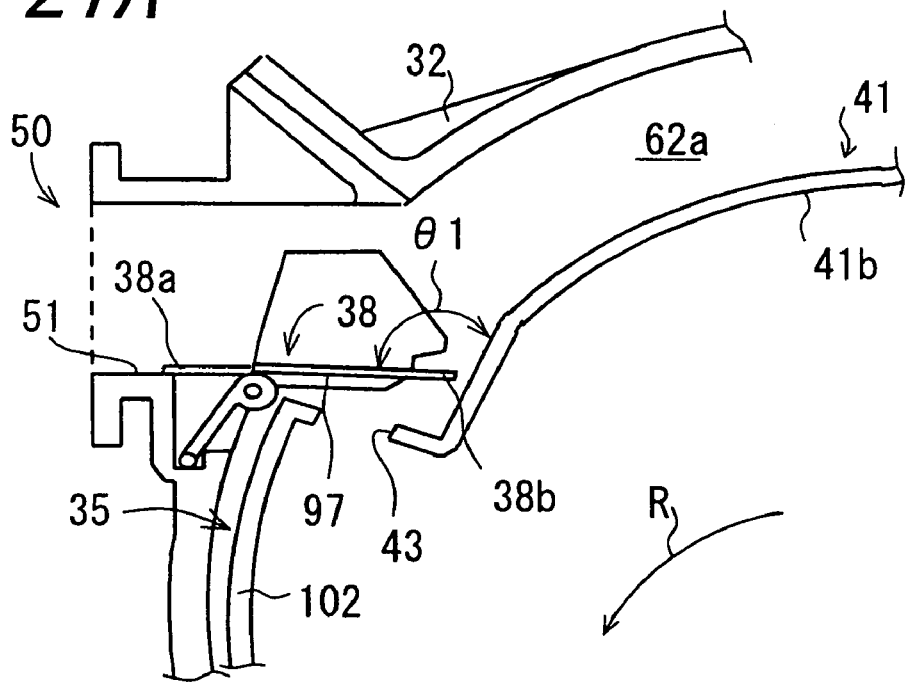
FIGS. 21A and 21B are magnified views illustrating a section XXI of FIG. 20.
Figure 21B:
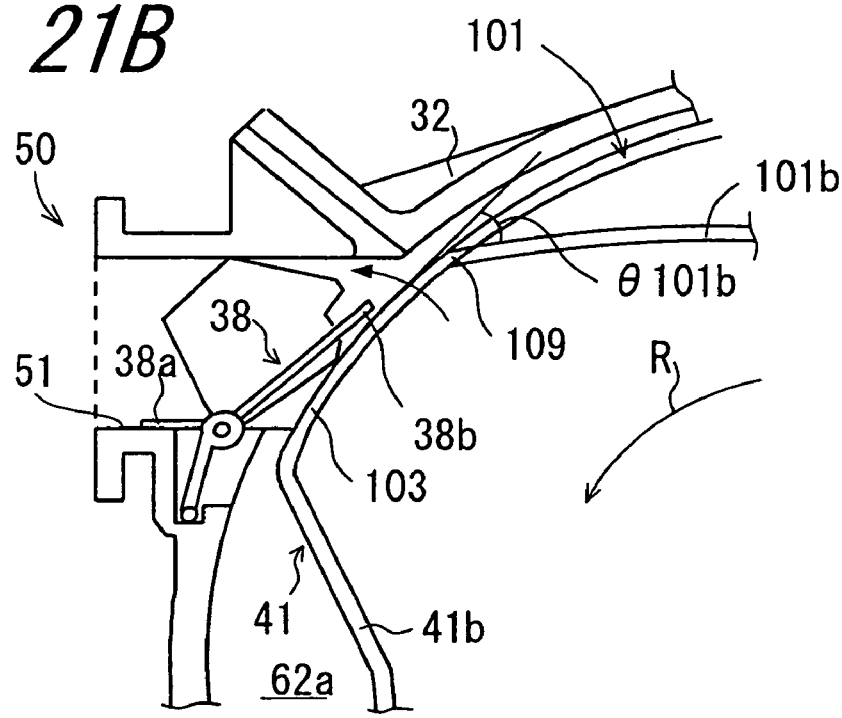

FIG. 20 is a cross section view taken on a cutting plane line S20-S20 of FIG. 2. FIGS. 21A to 26B are magnified views illustrating a section XXI of FIG. 20. FIGS. 20 to 26B are views illustrating the container main body 31 rotating in the rotation direction R in order. The developer guiding member 38 makes an angular displacement as described before, and the upstream end portion 38*b* in the rotation direction thereof abuts on the outer periphery faces of at least the bottom wall portion 41*b* of the first concavity 41, at least the bottom wall portion 42*b* of the second concavity 42, the bottom wall portion 100*b* of the first depressed portion 100 and the bottom wall portion 101*b* of the second depressed portion 101 of the third container segment 35 of the container main body 31, at a second angle θ1 larger than 90 degrees. In detail, the second angle θ1 is an angle formed by an upward-facing face of the upstream end portion 38*b* in the rotation direction of the developer guiding member 38, and the outer periphery face of each of the bottom wall portions 41*b*, 42*b*, 100*b*, 101*b* of the concavities 41, 42 and the depressed portions 100, 101.

As described before, the end wall portions 100*a* and 101*a* of the depressed portions 100 and 101 are formed so as to steeply rise outwardly in the radial direction from the bottom wall portions 100*b* and 101*b*, as compared with the upstream end portions in the rotation direction R of the bottom wall portions 41*b* and 42*b* of the first and second concavities 41 and 42. The developer guiding member 38 makes an angular displacement, and the upstream end portion 38*b* in the rotation direction thereof abuts on the outer periphery faces of the end wall portions 100*a* and 101*a* of the first and second depressed portions 100 and 101 of the third container segment 35 of the container main body 31, at a third angle θ2. The third angle θ2 is an angle smaller than the second angle θ1. In more specific, the third angle θ2 is an angle smaller than the second angle θ1 formed by the upward-facing face of the upstream end portion 38*b* in the rotation direction of the developer guiding member 38, and the outer periphery face of each of the bottom wall portions 41*b* and 42*b* of the concavities 41 and 42. The third angle θ2 is an angle larger than 90 degrees.

Figure 22A:
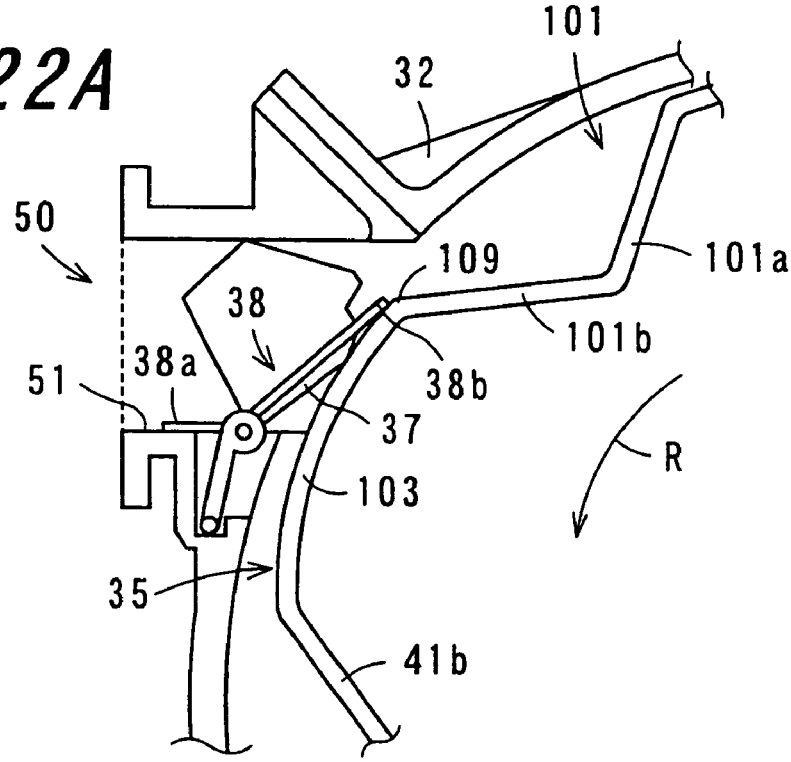
FIGS. 22A and 22B are magnified views illustrating the section XXI of FIG. 20.

When the second outer periphery portion 103 opposes an opening of the leading through hole 51 on the side of the container main body 31, the developer guiding member 38 narrows the opening of the leading through hole 51 on the side of the container main body 31, thereby bringing in to a closed state as illustrated in FIG. 22A. When the container main body 31 rotates in the rotation direction R from the state illustrated in FIG. 22A, and the second depressed portion 101 opposes the opening of the leading through hole 51 on the side of the container main body 31, the developer guiding member 38 makes an angular displacement at predetermined angular velocity or more, and collides with the bottom wall portion 101*b* of the second depressed portion 101. In specific, while a second boundary point 109 abuts on the developer guiding member 38, the developer guiding member is kept in a fixed angle position. When the developer guiding member 38 is released from abutting thereon, the developer guiding member 38 makes an angular displacement at predetermined angular velocity or more, and collides with the bottom wall portion 101*b* of the second depressed portion 101.

Figure 22B:
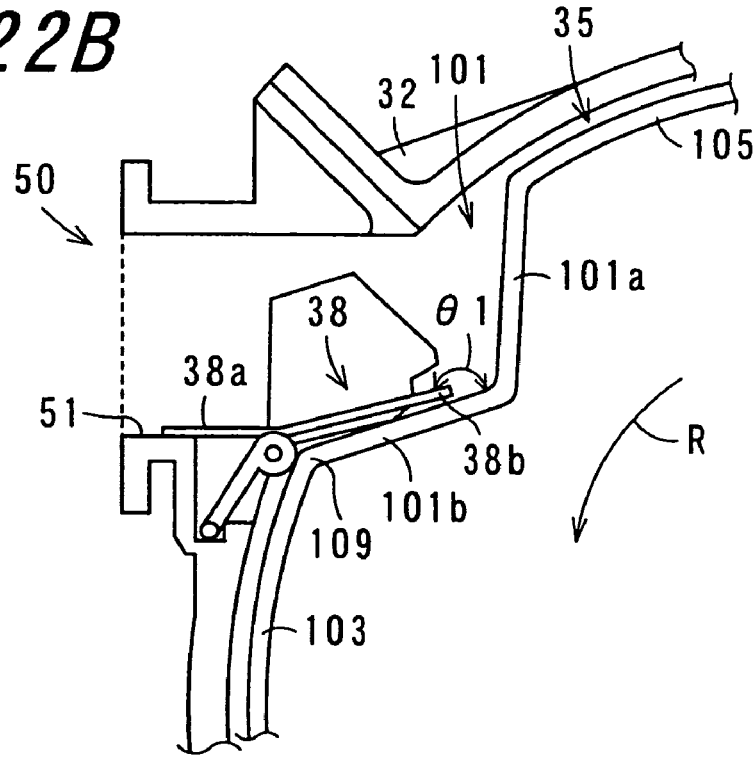
Figure 23A:
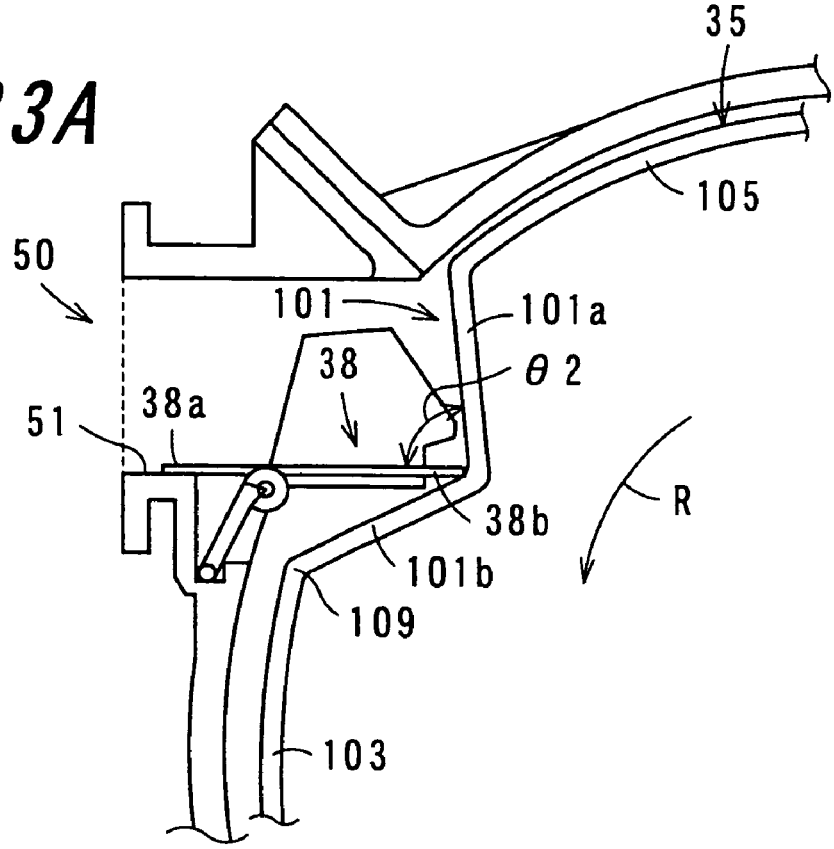
FIGS. 23A and 23B are magnified views illustrating the section XXI of FIG. 20.
Figure 23B:
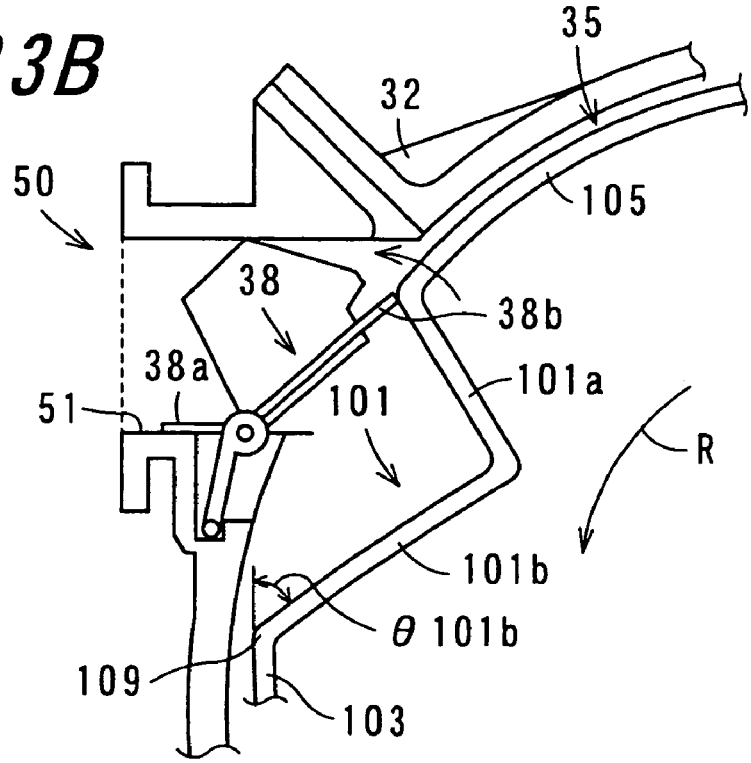
Figure 24A:
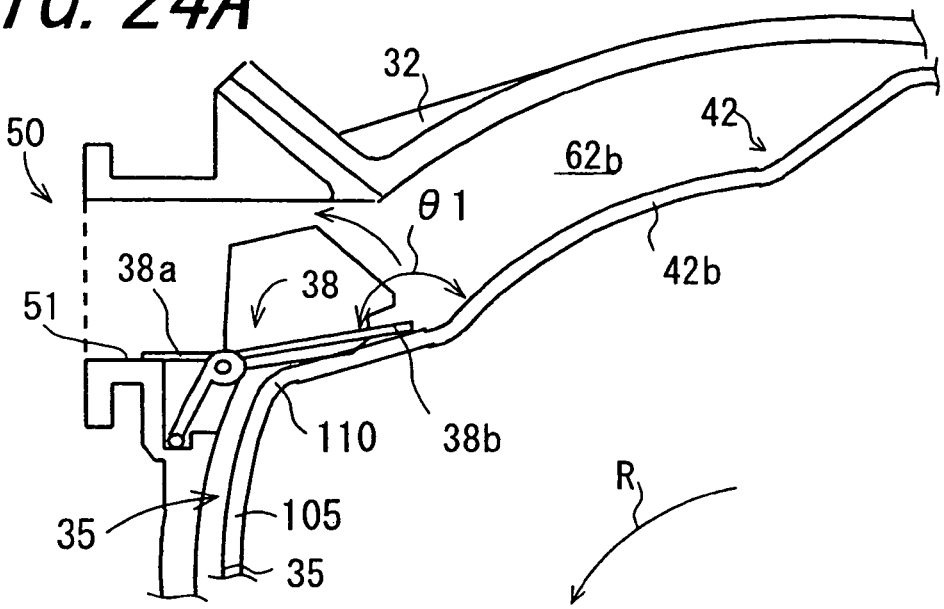
FIGS. 24A and 24B are magnified views illustrating the section XXI of FIG. 20.

When the container main body 31 rotates in the rotation direction R from the state illustrated in FIG. 22B, the upstream end portion 38*b* in the rotation direction of the developer guiding member 38 slides on the bottom wall portion 101*b* of the second depressed portion 101, and abuts on a part where the bottom wall portion 101*b* and the end wall portion 101*a* are connected. When the container main body 31 further rotates in the rotation direction R, the upstream end portion 38*b* in the rotation direction of the developer guiding member 38 slides on the end wall portion 101*a* of the second depressed portion 101 as illustrated in FIGS. 23A and 23B. At this moment, the developer guiding member 38 makes an angular displacement at predetermined angular velocity or more, and collides with the discharge portion 50 of the supporting member 32, whereby the developer guiding member 38 closes the opening of the leading through hole 51 on the side of the container main body 31. When the container main body further rotates from the state illustrated in FIG. 23B, the upstream end portion 38*b* in the rotation direction of the developer guiding member 38 enters a second storage space 62*b*, and slides on the bottom wall portion 42*b* of the second concavity 42 as illustrated in FIGS. 24A and 24B.

Figure 24B:
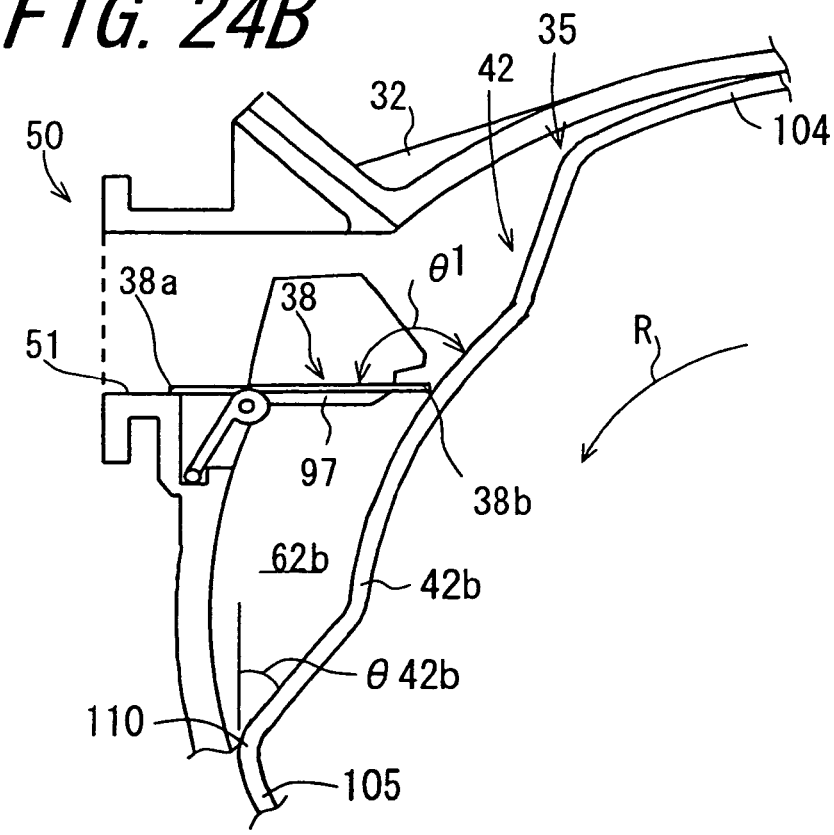

When the container main body 31 rotates in the rotation direction R from the state illustrated in FIG. 24B, the third outer periphery portion 104 opposes the opening of the leading through hole 51 on the side of the container main body 31. When the third outer periphery portion 104 opposes the opening of the leading through hole 51 on the side of the container main body 31, the developer guiding member 38 closes the opening of the leading through hole 51 on the side of the container main body 31 as illustrated in FIG. 25A.

Figure 25A:
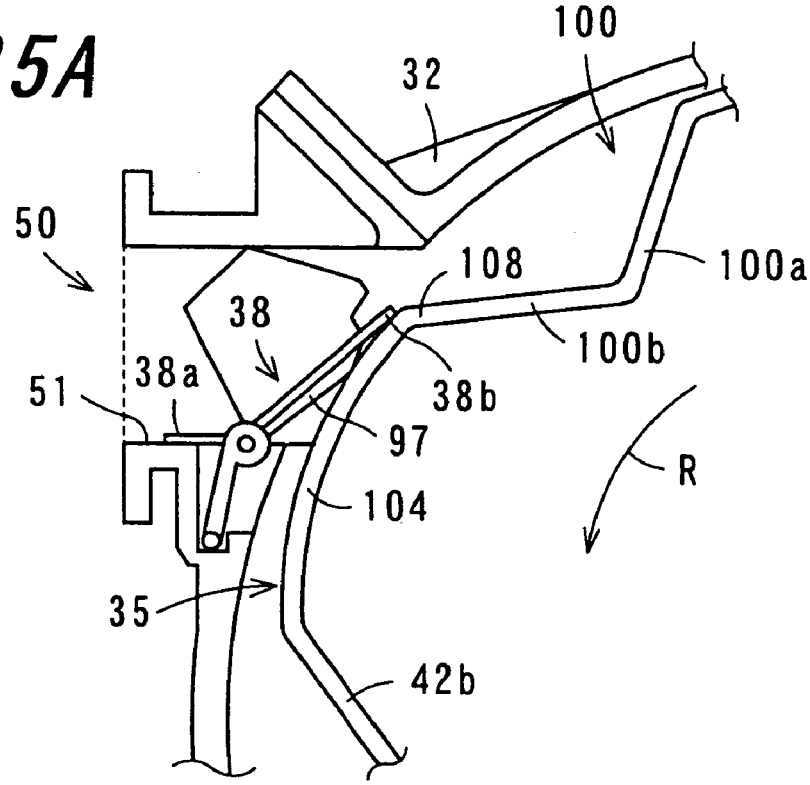
FIGS. 25A and 25B are magnified views illustrating the section XXI of FIG. 20.

When the container main body 31 rotates in the rotation direction R from the state illustrated in FIG. 25A, and the first depressed portion 100 opposes the opening of the leading through hole 51 on the side of the container main body 31, the developer guiding member 38 makes an angular displacement at predetermined angular velocity or more, and collides with the bottom wall portion 100*b* of the first depressed portion 100.

Figure 25B:
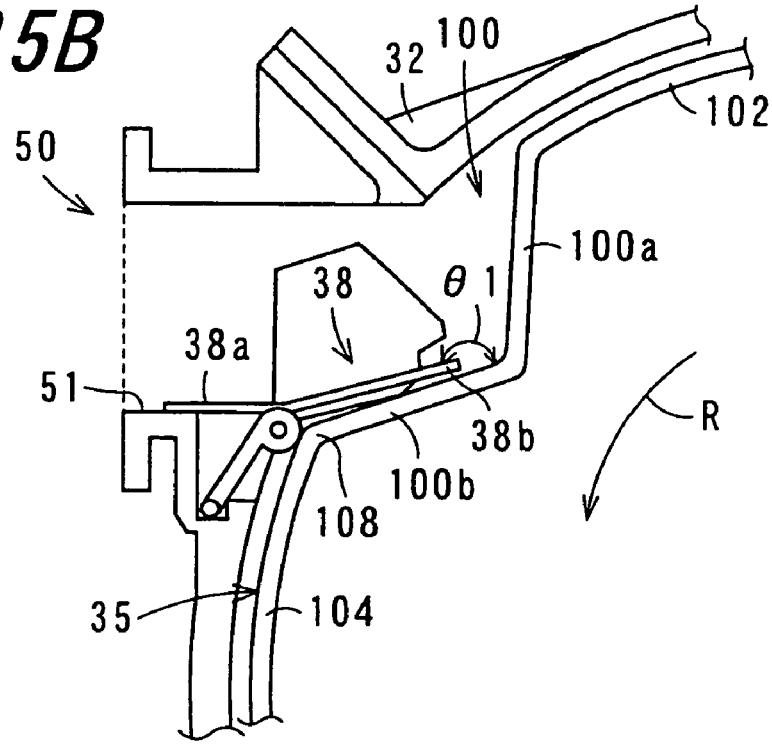
Figure 26A:
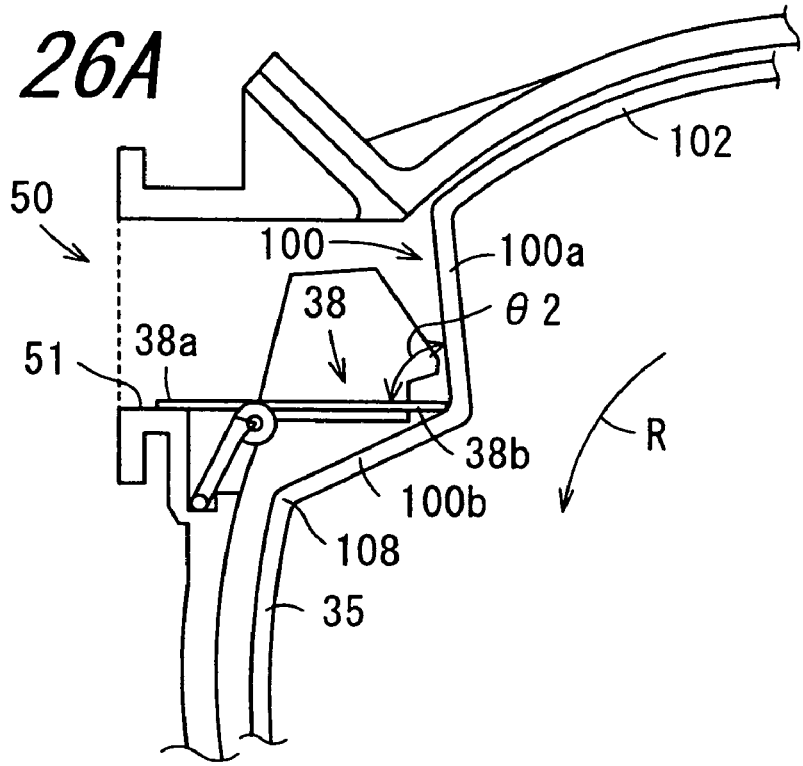
FIGS. 26A and 26B are magnified views illustrating the section XXI of FIG. 20.
Figure 26B:
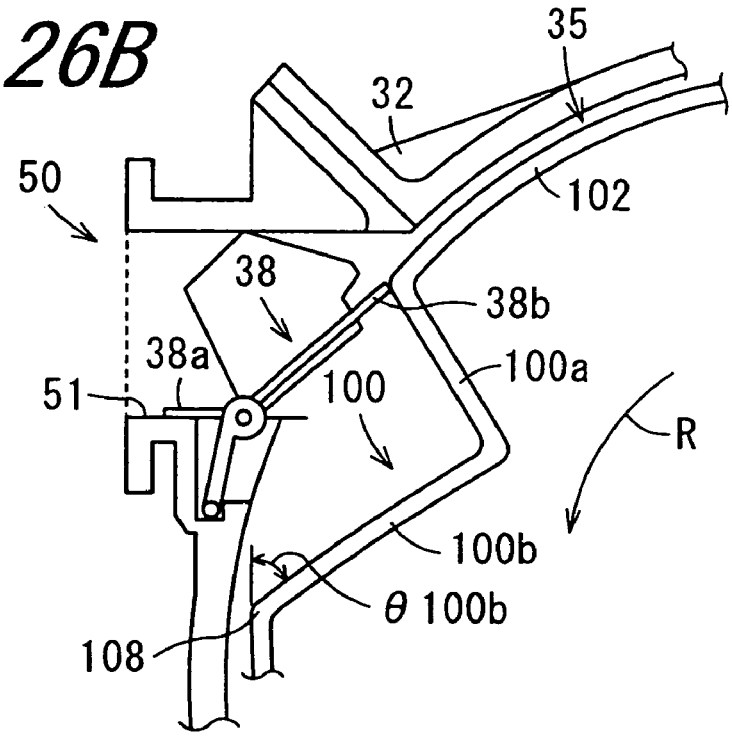

When the container main body 31 rotates in the rotation direction R from the state illustrated in FIG. 25B, the upstream end portion 38*b* in the rotation direction of the developer guiding member 38 slides on the bottom wall portion 100 of the first depressed portion 100, and abuts on a part where the bottom wall portion 100*b* and the end wall portion 100*a* are connected. When the container main body 31 rotates in the rotation direction R from the state where the upstream end portion 38*b* in the rotation direction of the developer guiding member 38 abuts on the part where the bottom wall portion 100*b* and the end wall portion 100*a* of the first depressed portion 100 are connected, the upstream end portion 38*b* in the rotation direction of the developer guiding member 38 slides on the end wall portion 100*a* of the first depressed portion 100 as illustrated in FIGS. 26A and 26B. At this moment, the developer guiding member 38 makes an angular displacement at predetermined angular velocity or more, and collides with the discharge portion 50 of the supporting member 32.

The predetermined angular velocity is such angular velocity that the developer adhering to the developer guiding member 38 is separated from the developer guiding member 38 by the inertial force, when the developer guiding member 38 collides with the respective bottom wall portions 100*b* and 101*b* of the depressed portions 100 and 101, or when the upstream end portion 38*b* in the rotation direction of the developer guiding member 38 finishes sliding on the end wall portions 100*a* and 101*a*.

The outer periphery face of the bottom wall portion 100*b* of the first depressed portion 100 forms a fourth angle θ100*b* with a tangent line of the outer periphery face of the third container segment 35 at a first boundary point 108 that is a boundary between the third outer periphery portion 104 and the bottom wall portion 100*b*. The outer periphery face of the bottom wall portion 101*b* of the second depressed portion 101 forms a fifth angle θ101*b* with a tangent line of the outer periphery face of the third container segment 35 at the second boundary point 109 that is a boundary between the second outer periphery portion 103 and the bottom wall portion 101*b*. The outer periphery face of the downstream end portion in the rotation direction of the bottom wall portion 42*b* of the second concavity 42 forms a sixth angle θ42*b* with a tangent line of the outer periphery face of the third container segment 35 at a third boundary point 110 between the fourth outer periphery portion 105 and the bottom wall portion 42*b*. In the present embodiment, the fourth angle θ100*b* and the fifth angle θ101*b* are set to angles larger than the sixth angle θ42*b*.

In specific, it is preferred that the fourth angle θ100*b* and the fifth angle θ101*b* are within a range of 45 degrees or more and 90 degrees or less. In a case where the fourth angle θ100*b* and the fifth angle θ101*b* are less than 45 degrees, the developer aggregating and adhering to the developer guiding member 38 may not be resolved when the developer guiding member 38 collides with the bottom wall portion 100*b* of the first depressed portion 100. On the contrary, in a case where the fourth angle θ100*b* and the fifth angle θ101*b* are more than 90 degrees, it may be impossible to perform a scraping operation of scraping the developer by making the upstream end portion 38*b* in the rotation direction of the developer guiding member 38 abut on the respective bottom wall portions 100*b* and 101*b* of the depressed portions 100 and 101. Therefore, with the fourth angle θ100*b* and the fifth angle θ101*b* of 45 degrees or more and 90 degrees or less, it is possible to resolve the developer aggregating and adhering to the developer guiding member 38 and reduce an adhering force thereof to the developer guiding member 38, and it is also possible to favorably scrape the developer by making the upstream end portion 38*b* in the rotation direction of the developer guiding member 38 abut on the respective bottom wall portions 100*b* and 101*b* of the depressed portions 100 and 101. In the present embodiment, the fourth angle θ100*b* and the fifth angle θ101*b* are 70 degrees.

In a state where the supporting base 49 of the supporting member 32 is placed on the horizontal plane and developer is stored, two layers including a developer layer occupied by the developer and a gas layer occupied by gas above the developer layer are formed in a space inside the container main body 31. The container main body 31 is rotated clockwise about the rotation axial line L31 when seen in a direction from the first container segment 33 to the second container segment 34. At this moment, the developer in the developer layer of the first container segment 33 is conveyed by the first projection pieces 36 along the rotation axial line L31 in a first conveyance direction C1 from the first container segment 33 toward the third container segment 35 (refer to FIG. 2). On the other hand, at this moment, the developer in the developer layer of the second container segment 34 is conveyed by the second projection pieces 39 along the rotation axial line L31 in a second conveyance direction C2 from the second container segment 34 toward the third container segment 35 (refer to FIG. 2). Thus, by rotating the container main body 31 about the rotation axial line L31, it is possible to convey the stored developer toward the discharge hole 43. Furthermore, the developer conveyed in the first conveyance direction C1 and the developer conveyed in the second conveyance direction C2 collide with each other in the third container segment 35, whereby the developer is agitated.

When the developer is conveyed, a force toward the third container segment 35 from the inner periphery portions of the first and second container segments 33 and 34 including the first and second projection pieces 36 and 39 is applied to the developer. When a large quantity of developer is stored in the container main body 31, the developer existing within the inward protrusion amount A2 in the radial direction of the first and second projection pieces 36 and 39 from the inner periphery portions of the first and second container segments 33 and 34 is agitated mainly by rotation of the container main body 31, so that the balance in the container main body 31 is maintained.

FIGS. 27A to 32B are views for describing an operation that the developer in the third container segment 35 of the container main body 31 is guided to the leading through hole 51 of the supporting member 32 while the container main body 31 is rotating in the rotation direction R about the rotation axial line L31. FIGS. 27A to 32B are views illustrating the container main body 31 rotating in the rotation direction R in order. FIGS. 7, 9A, 9B and 20 will be also referred to. In a state where the container main body 31 is supported by the supporting member 32 so as to be rotatable about the rotation axial line L31, a first storage space 62*a* facing the first concavity 41 of the third container segment 35 and the inner periphery portion 48 of the supporting member 32 is formed. The first storage space 62*a* is a substantially closed space except the discharge hole 43, and placed upstream of the discharge hole 43 in the rotation direction R, and communicates with a space inside the container main body 31 via the discharge hole 43. Moreover, the second storage space 62*b* facing the second concavity 42 of the third container segment 35 and the inner periphery portion 48 of the supporting member 32 is formed. The second storage space 62*b* is a substantially closed space.

A first adhesion eliminating operation space 111*a* facing the first depressed portion 100 of the third container segment 35 and the inner periphery portion 48 of the supporting member 32 is formed. The first eliminating operation space 111*a* is a substantially closed space. Moreover, a second eliminating operation space 111*b* facing the second depressed portion 101 of the third container segment 35 and the inner periphery portion 48 of the supporting member 32 is formed. The second eliminating operation space 111*b* is a substantially closed space, and formed into a substantially triangular pole shape.

Figure 27A:
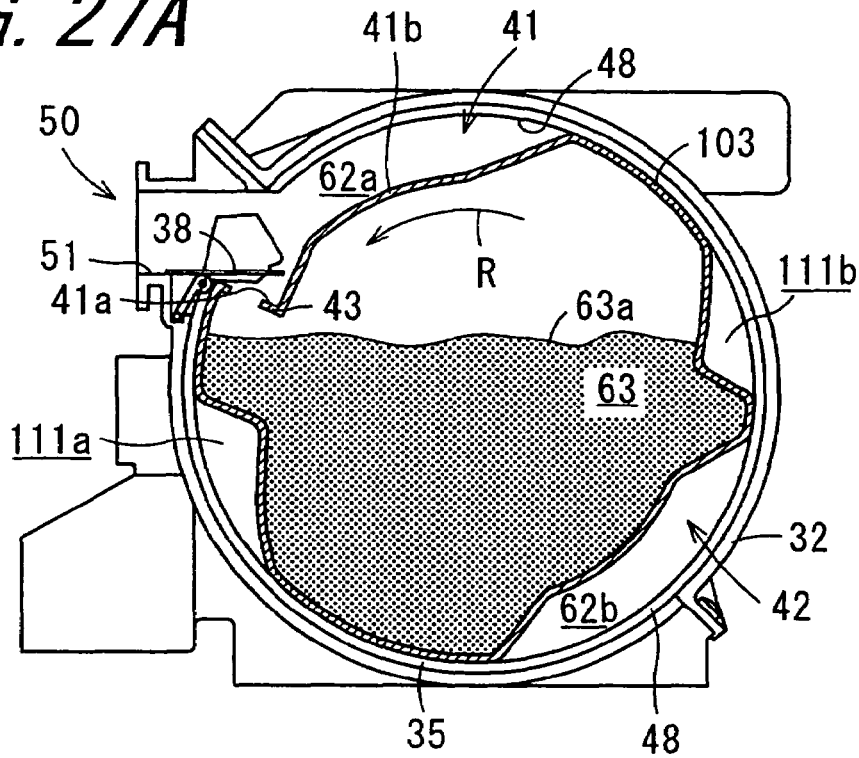
FIGS. 27A and 27B are views for describing an operation that developer inside the third container segment of the container main body is guided to a leading through hole of the supporting member while the container main body is rotating in a rotation direction R about a rotation axial line.

When the container main body 31 rotates in the rotation direction R from a state illustrated in FIG. 27A where the discharge hole 43 and the first storage space 62*a* are located above an upper face 63*a* of a developer layer 63 in the container main body 31, and is brought into a state illustrated in FIG. 27B where the discharge hole 43 and a downstream part of the first storage space 62*a* in the rotation direction R are located below the upper face 63*a* of the developer layer 63 in the container main body 31, the developer of the developer layer 63 in the container main body 31 flows into the downstream part in the rotation direction R of the first storage space 62*a* via the discharge hole 43 as illustrated with an arrow G1.

As described before, the discharge hole 43 is formed at an axial middle portion of the end wall portion 41*a* of the first concavity 41, outwardly in the radial direction, so as to be open like a rectangular shape whose longitudinal direction is the axial direction. Therefore, the discharge hole 43 is open on the end wall portion 41*a* of the first concavity 41, more outwardly in the radial direction than the downstream end portion in the rotation direction R of the bottom wall portion 41*b* of the first concavity 41, closer to the axial other end portion than the downstream end portion in the rotation direction R of the first side wall portion 41*c*, and closer to the axial one end portion than the downstream end portion in the rotation direction R of the second side wall portion 41*d*.

For example, in a case where the discharge hole 43 is open over the whole end wall portion 41*a*, the developer is discharged from the discharge hole 43 to the first storage space 62*a*, while being densely pressed out along the first concavity 41 of the container main body 31 and the inner periphery portion 48 of the supporting member 32 through rotation of the container main body 31 in the rotation direction R. In a case where the container main body 31 further rotates in the rotation direction R in this state, there is a possibility that the developer retained in the first storage space 62*a* is pressed by the first concavity 41 of the container main body 31 and the inner periphery portion 48 of the supporting member 32 and aggregates.

The discharge hole 43 is formed on part of the end wall portion 41*a* of the first concavity 41 as described before. In other words, since the discharge hole 43 is formed so that the opening area thereof is smaller than the area of the end wall portion 41*a*, the developer is discharged to the first storage space 62*a*, while diffusing around the discharge hole 43 in the first storage space 62*a*. Consequently, it is possible to make the developer discharged to the first storage space 62*a* powdery, and it is also possible to prevent as far as possible that the developer aggregates through rotation of the container main body 31 as described before.

Further, as described before, the first depressed portion 100 is disposed from a position close to the first concavity 41 to a position away from the first concavity 41, opposing the end wall portion 41*a* of the first concavity 41 on which the discharge hole 43 is formed from downstream in the rotation direction. Consequently, it is possible to form a projection in a position close to the discharge hole 43 so as to oppose the discharge hole 43 from downstream in the rotation direction R. Therefore, even when the fluidity of the developer is high, it is possible to prevent that the developer flows out to the downstream part in the rotation direction R of the first storage space 62*a* at once.

Further, for example, in a case where the developer aggregates, the developer adheres to the inner periphery face of the container main body 31 in the connected state. In the present embodiment, the projection formed by the first depressed portion 100 can limit the connection of the developer to a range between the discharge hole 43 and the projection. Consequently, an adhering force of the developer to the inner periphery face of the container main body 31 on the downstream side in the rotation direction of the discharge hole 43 becomes small, as compared with a case where the projection is not disposed. Therefore, even when the developer is in the aggregated state, it is possible to easily flow the developer out of the discharge hole 43.

Furthermore, an outward face in the radial direction of the discharge hole 43 is smoothly connected to the inner periphery face of the third container segment 35 excluding the concavities 41, 42 and the depressed portions 100, 101, on the downstream side in the rotation direction R of the first concavity 41. Consequently, even when the quantity of the developer stored in the container main body 31 becomes very small, it is possible to easily flow the developer into the downstream part in the rotation direction R of the first storage space 62*a* via the discharge hole 43.

Figure 27B:
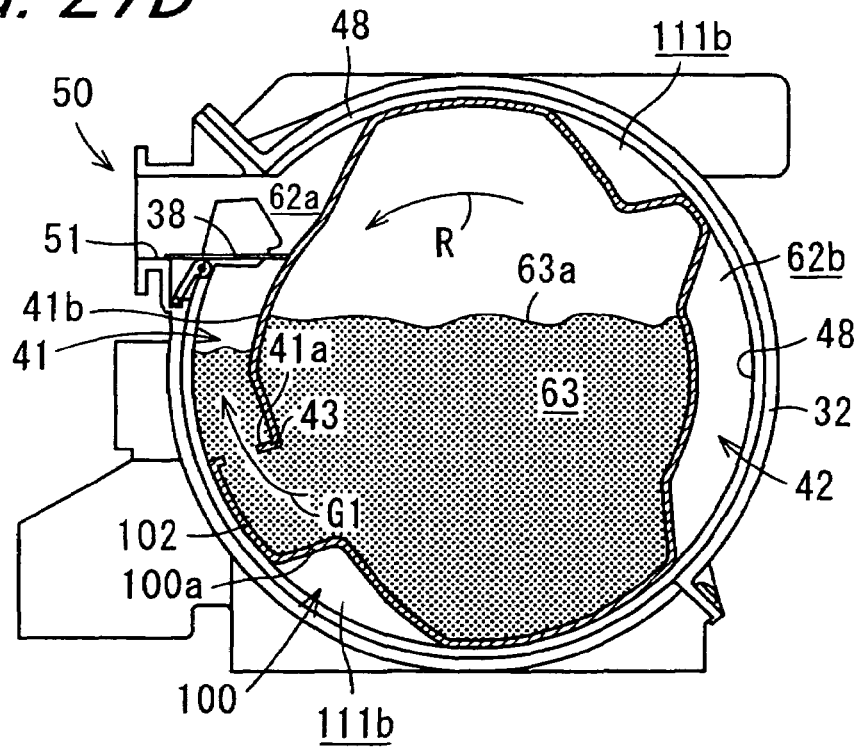
Figure 28A:
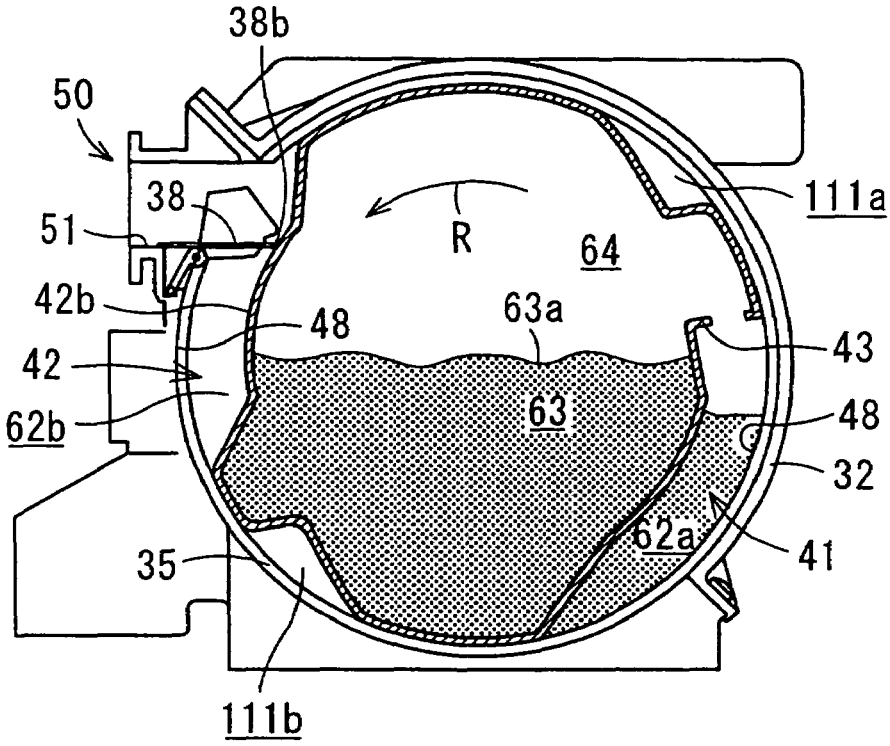
FIGS. 28A and 28B are views for describing the operation that the developer inside the third container segment of the container main body is guided to the leading through hole of the supporting member while the container main body is rotating in the rotation direction R about the rotation axial line.

When the container main body 31 further rotates in the rotation direction R from the state illustrated in FIG. 27B, the developer of the developer layer 63 in the container main body 31 flows into the downstream part in the rotation direction R of the first storage space 62*a* via the discharge hole 43. The discharge hole 43 is located above the upper face 63*a* of the developer layer 63 in the container main body 31, and the first storage space 62*a* is located below the upper face 63*a* of the developer layer 63 in the container main body 31. In such a state as illustrated in FIG. 28A, a predetermined quantity of developer is retained in the first storage space 62*a*. The quantity of the developer retained in the first storage space 62 may be 6 gram, for example.

Figure 28B:
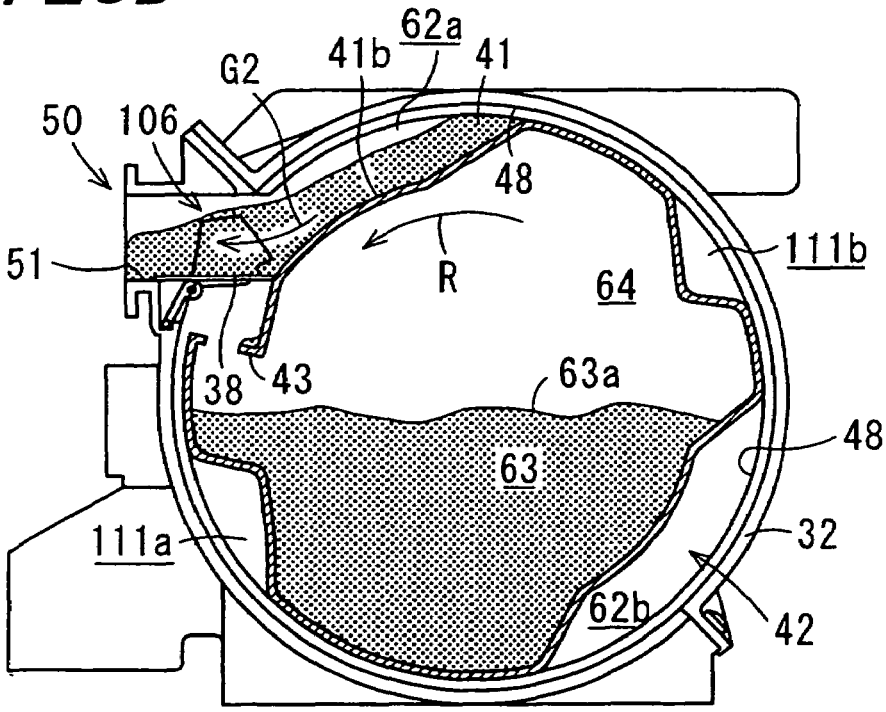

When the container main body 31 rotates in the rotation direction R from the state illustrated in FIG. 28A, the upstream end portion 38*b* in the rotation direction of the developer guiding member 38 of the supporting member 32 enters the first storage space 62*a* as illustrated in FIG. 28B. The upstream end portion 38*b* in the rotation direction of the developer guiding member 38 extends upstream in the rotation direction R, and slides on the outer periphery face of the bottom wall portion 41*b* of the first concavity 41 while resiliently abutting on the outer periphery face at the second angle θ1 larger than 90 degrees with the outer periphery face. At this moment, a supply path for supplying the developer from the developer guiding member 38 to the leading through hole 51 is formed. The developer retained in the first storage space 62*a* on the upstream side of the developer guiding member 38 in the rotation direction R flows toward the supporting member 32 through rotation of the container main body 31 in the rotation direction R.

The developer guiding member 38 guides the developer flown in the above manner, that is, the developer discharged from the discharge hole 43 of the container main body 31, along the upper face of the developer guiding member 38, and guides to the leading through hole 51 as illustrated with an arrow G2. Since the developer guiding member 38 slides on the outer periphery face of the bottom wall portion 41*b* of the first concavity 41 while executing the scraping operation of scraping the developer off the outer periphery face, the developer guiding member can guide almost all of the developer retained in the first storage space 62*a* to the leading through hole 51. The developer guided to the leading through hole 51 in the above manner is led and discharged to the outside of the developer container 30. Thus, every time the container main body 31 rotates once in the rotation direction R about the rotation axial line L31, the predetermined quantity of developer is discharged outside.

When the container main body 31 further rotates in the rotation direction R from the state illustrated in FIG. 28B, the upstream end portion 38*b* in the rotation direction of the developer guiding member 38 passes the upstream one end portion in the rotation direction of the bottom wall portion 41*b* of the first concavity 41, and slides on the outer periphery face of the second outer periphery portion 103. The developer guiding member 38 makes an angular displacement toward the opening of the leading through hole 51 on the side of the container main body 31, and shifts from a state 106 where the developer guiding member 38 forms the supply path (may be referred to as "opened state" hereafter) to a state 107 where the developer guiding member closes the opening (may be referred to as "closed state" hereafter). At this moment, the developer guiding member 38 executes a pressing-out operation of pressing out the developer gathering around the opening of the leading through hole 51 on the side of the container main body 31, toward the opposite opening of the leading through hole 51. The discharge hole 43 and the downstream part in the rotation direction R of the first storage space 62*a* are located below the upper face 63*a* of the developer layer 63 in the container main body 31, and the developer of the developer layer 63 in the container main body 31 flows into the downstream part in the rotation direction R of the first storage space 62*a* via the discharge hole 43 again.

Figure 29A:
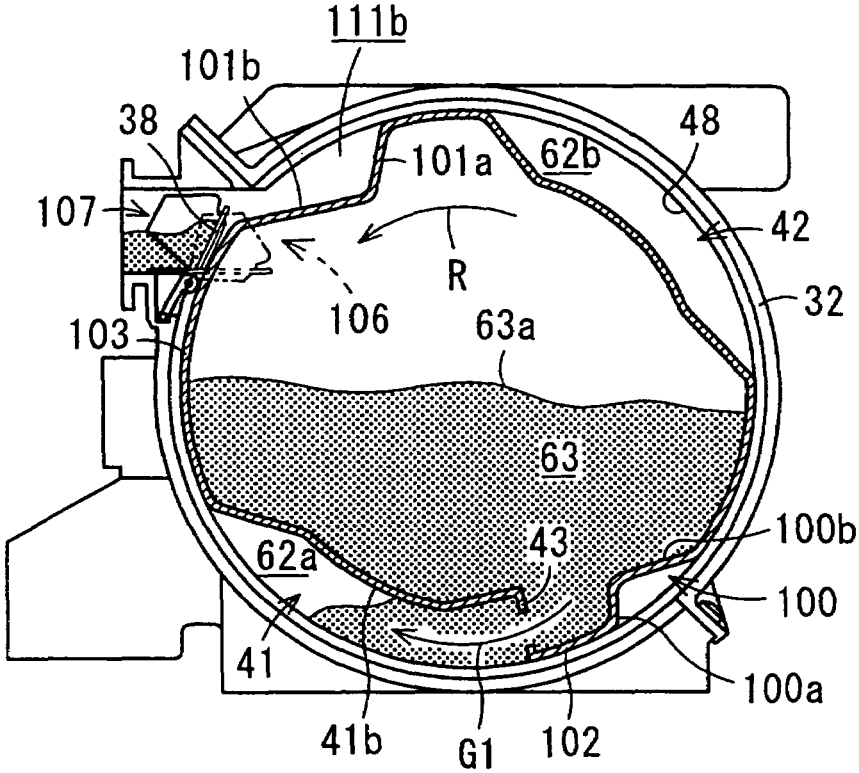
FIGS. 29A and 29B are views for describing the operation that the developer inside the third container segment of the container main body is guided to the leading through hole of the supporting member while the container main body is rotating in the rotation direction R about the rotation axial line.
Figure 29B:
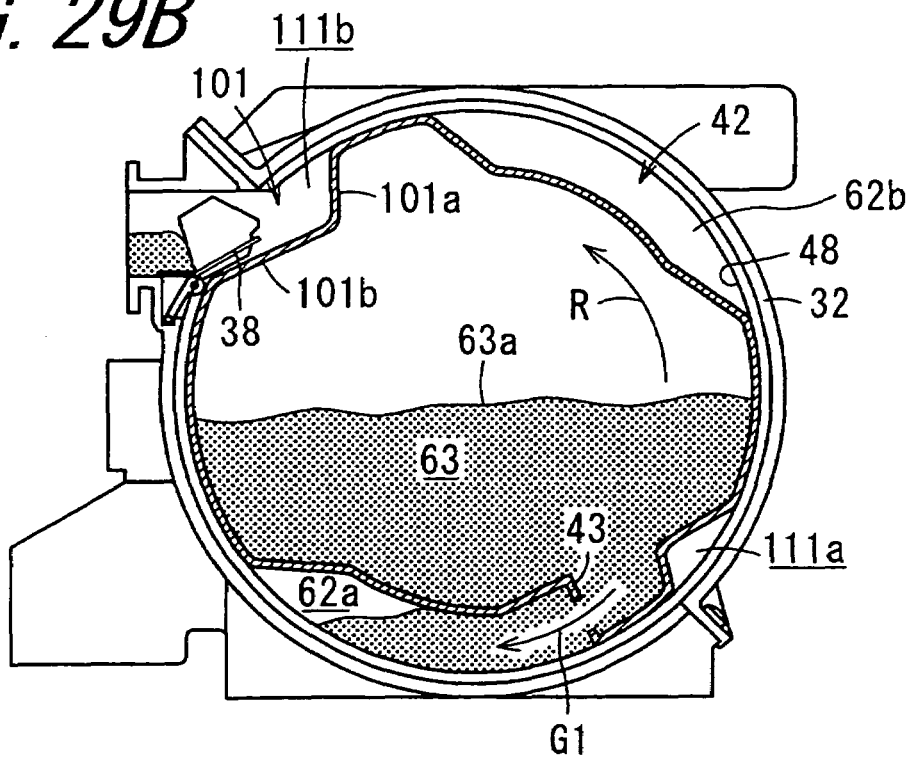

When the container main body 31 rotates in the rotation direction R from the state illustrated in FIG. 28B, the upstream one end portion 38*b* in the rotation direction of the developer guiding member 38 slides on the outer periphery face of the second outer periphery portion 103 in the closed state 107, and reaches an upstream end portion in the rotation direction R of the second outer periphery portion 103 as illustrated in FIG. 29A. When the container main body further rotates in the rotation direction R from the state illustrated in FIG. 29A, the developer guiding member 38 enters the second eliminating operation space 111*b* as illustrated in FIG. 29B. At this moment, as described before, the developer guiding member 38 collides with the bottom wall portion 101*b* of the second depressed portion 101. Consequently, it is possible to execute an eliminating operation of eliminating the developer adhering to the developer guiding member 38 by the inertial force. Moreover, even if the developer aggregates and adheres to the developer guiding member 38, it is possible to resolve the developer. Furthermore, in the present embodiment, the spring force generating portion is disposed, and the developer guiding member collides with great force when shifting from the closed state 106 to the opened state 107. Therefore, even if the developer adhering to the developer guiding member 38 is in the aggregated state, it is possible to securely resolve the developer.

Figure 30A:
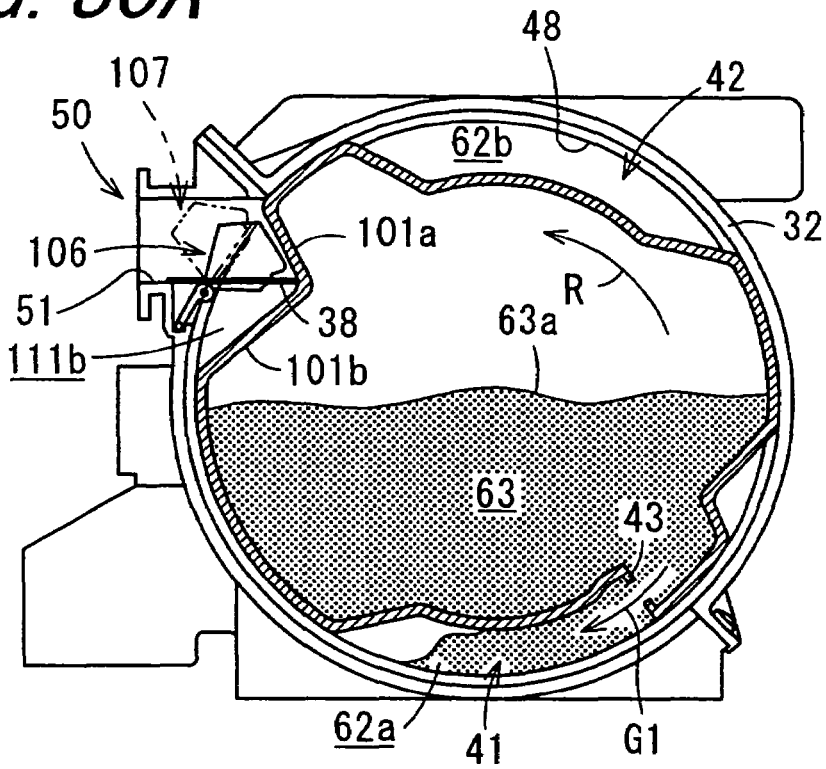
FIGS. 30A and 30B are views for describing the operation that the developer inside the third container segment of the container main body is guided to the leading through hole of the supporting member while the container main body is rotating in the rotation direction R about the rotation axial line.

When the container main body 31 rotates in the rotation direction R from the state illustrated in FIG. 29B, the upstream end portion 38*b* in the rotation direction of the developer guiding member 38 slides on the end wall portion 101*a* of the second depressed portion 101, and shifts from the opened state 106 to the closed state 107 as illustrated in FIG. 30A. At this moment, the developer guiding member 38 makes an angular displacement at the predetermined angular velocity or more, and collides with the discharge portion 50 of the supporting member 32. Consequently, it is possible to execute the eliminating operation. Moreover, the operation of pressing out the developer from the leading through hole 51 is executed.

Figure 30B:
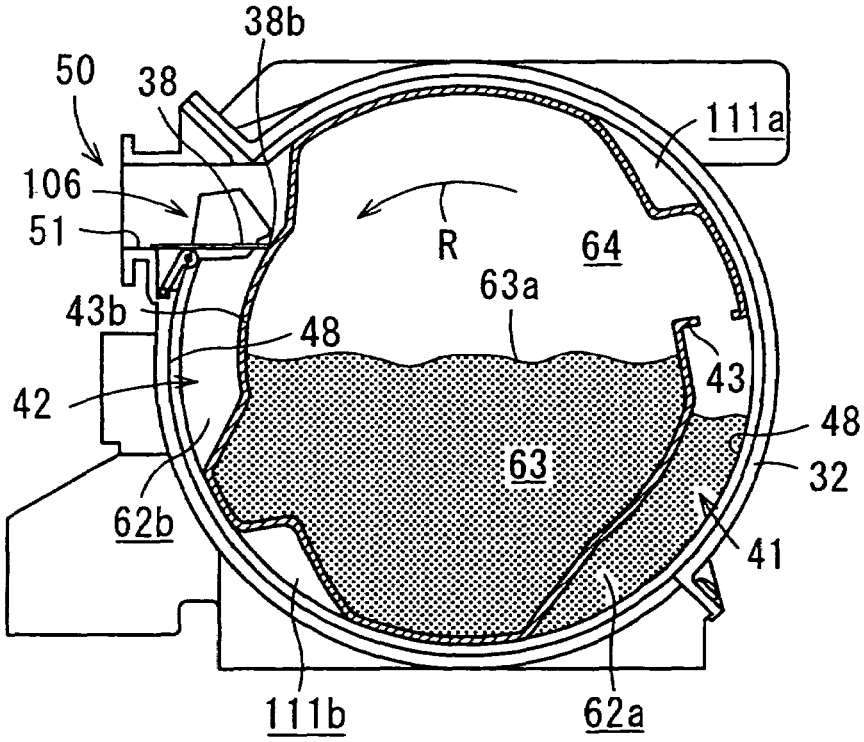

When the container main body 31 rotates from the state illustrated in FIG. 30A, the upstream end portion 38*b* in the rotation direction of the developer guiding member 38 of the supporting member 32 enters the second storage space 62*b*, extends upstream in the rotation direction R, and slides on the outer periphery face of the bottom wall portion 42*b* of the second concavity 42 while resiliently abutting on the outer periphery face at the second angle θ1 larger than 90 degrees with the outer periphery face as illustrated in FIG. 30B.

As described before, the part of the third container segment 35 excluding the first and second concavities 41, 42 and the inner periphery portion 48 of the supporting member 32 do not abut on each other over circumferences thereof in the circumferential direction, in order to reduce friction force that hinders rotation about the rotation axial line L31 of the container main body 31. In specific, there is a gap of 2 mm, for example. Therefore, there is no guarantee that the developer retained in the first storage space 62*a* as described before never leaks out of the first storage space 62*a*.

As described before, the discharge guide pieces 44 are disposed on the outer periphery portion of the third container segment 35 at the axial one end portion and the axial other end portion excluding the first concavity 41 and the second concavity 42. The discharge guide pieces 44 disposed at the axial one end portion of the third container segment 35 incline in the rotation direction R as they go from the axial other end portion to the axial one end portion, and the discharge guide pieces 44 disposed at the axial other end portion of the third container segment 35 incline in the rotation direction R as they go from the axial one end portion to the axial other end portion. Therefore, in a case where the developer retained in the first storage space 62*a* leaks out to one side or the other side of the rotation axial line L32, it is possible to gather in axial middle parts of the third container segment 35 and the supporting member 32 by the discharge guide pieces 44 while the container main body 31 is rotating in the rotation direction R.

Further, since the second storage space 62*b* is formed as described before, in a case where the developer retained in the first storage space 62*a* leaks out from the upstream part in the rotation direction R of the first storage space 62*a*, the developer leaked out and the developer gathered to the axial middle part by the discharge guide pieces 44 are retained in the second storage space 62*b*. When the container main body 31 rotates in the rotation direction R, the upstream end portion 38*b* in the rotation direction of the developer guiding member 38 of the supporting member 32 enters the second storage space 62*b*, extends upstream in the rotation direction R, and slides on the outer periphery face of the bottom wall portion 42*b* of the second concavity 42 while resiliently abutting on the outer periphery face at the second angle θ1 larger than 90 degrees with the outer periphery, as illustrated in FIG. 30B. At this moment, through rotation of the container main body 31 in the rotation direction R, the developer retained in the second storage space 62*b* on the upstream side of the developer guiding member 38 in the rotation direction R is flown toward the supporting member 32, guided to the leading through hole 51, and led and discharged to the outside of the developer container 30. Even if the developer leaks out of the first storage space 62*a* every time the container main body 31 rotates once in the rotation direction R about the rotational axial line L31, the leaked out developer is retained in the second storage space 62*b*, so that it is possible to discharge the predetermined quantity of developer to the outside as securely as possible.

When the container main body 31 further rotates in the rotation direction R from the state illustrated in FIG. 30B, the upstream end portion 38*b* in the rotation direction of the developer guiding member 38 passes an upstream one end portion in the rotation direction of the bottom wall portion 42*b* of the second concavity 42, and slides on the outer periphery face of the third outer periphery portion 104. The developer guiding member 38 makes an angular displacement toward the opening of the leading through hole 51 on the side of the container main body 31, and shifts from the opened state 106 to the closed state 107. At this moment, the pressing-out operation is executed again.

Figure 31A:
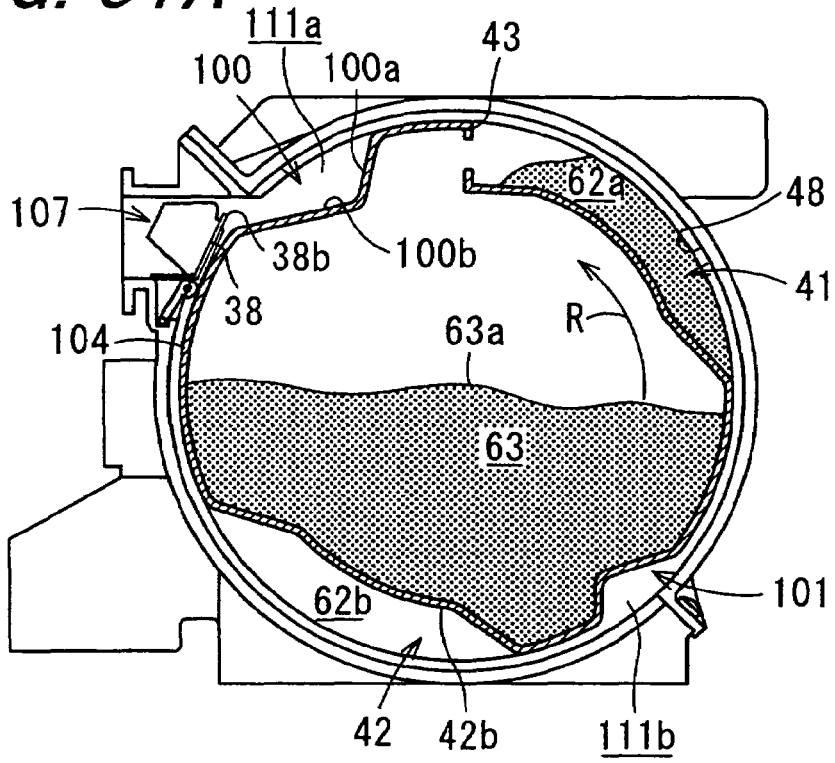
Figure 31B:
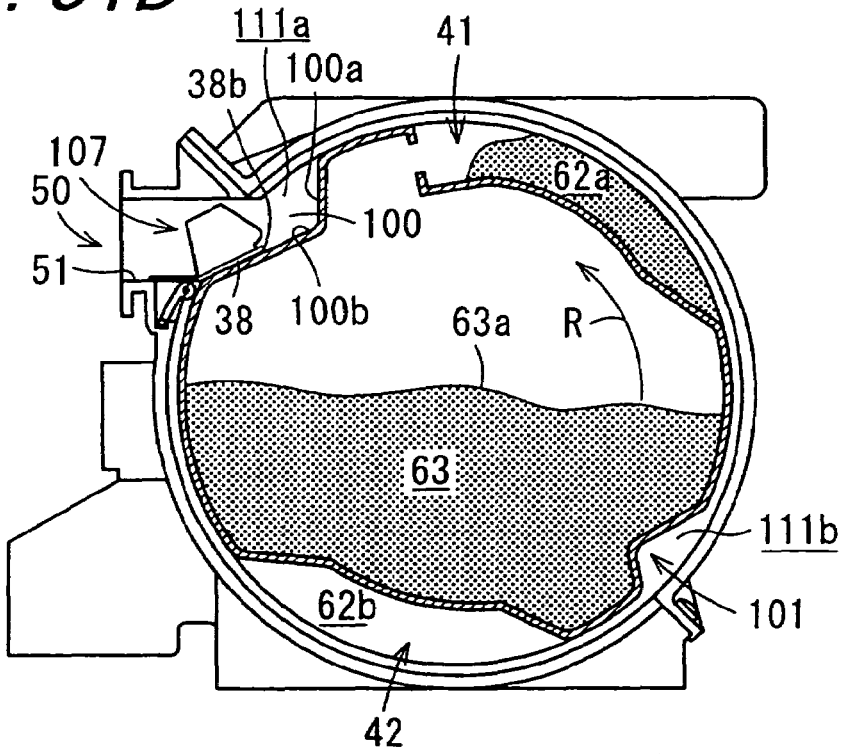

The upstream one end portion 38*b* in the rotation direction of the developer guiding member 38 slides on the outer periphery face of the second outer periphery portion 103 in the closed state 107, and reaches the upstream end portion in the rotation direction R of the third outer periphery portion 104 as illustrated in FIG. 31A. When the container main body further rotates in the rotation direction R from the state illustrated in FIG. 31A, the developer guiding member 38 enters the first eliminating operation space 111*a* as illustrated in FIG. 31B. At this moment, as described before, the developer guiding member 38 collides with the bottom wall portion 100*b* of the first depressed portion 100, and executes the eliminating operation.

Figure 32A:
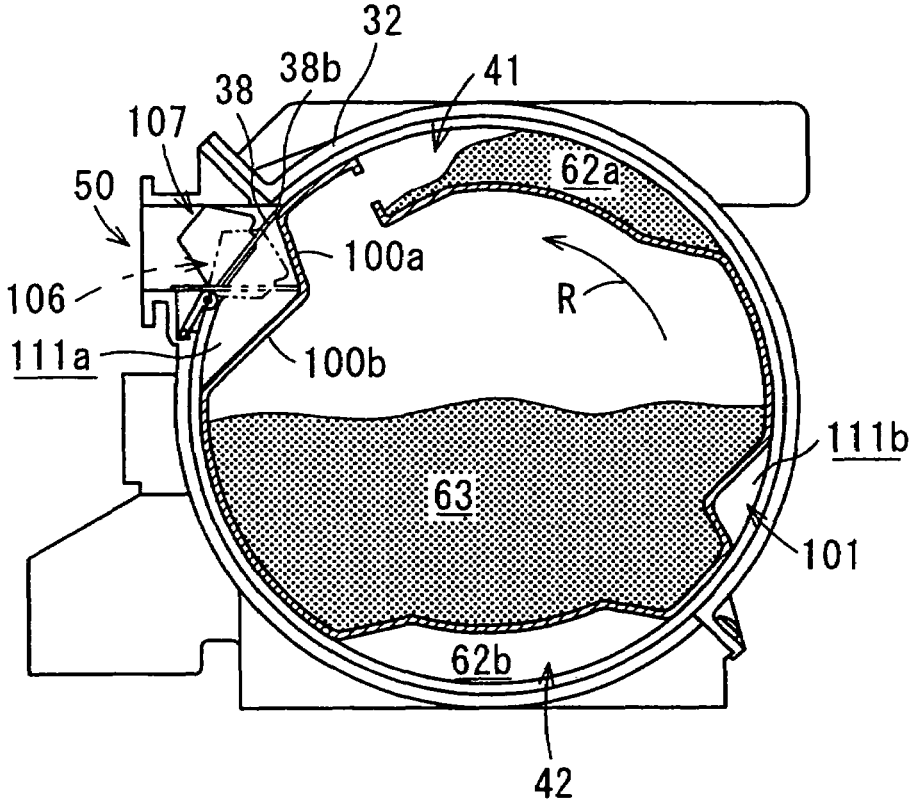
FIGS. 32A and 32B are views for describing the operation that the developer inside the third container segment of the container main body is guided to the leading through hole of the supporting member while the container main body is rotating in the rotation direction R about the rotation axial line.

When the container main body 31 rotates in the rotation direction R from the state illustrated in FIG. 31B, the developer guiding member 38 shifts from the opened state 106 to the closed state 107 as illustrated in FIG. 32A. At this moment, the developer guiding member 38 makes an angular displacement at the predetermined angular velocity or more, and executes the eliminating operation and the pressing-out operation.

Figure 32B:
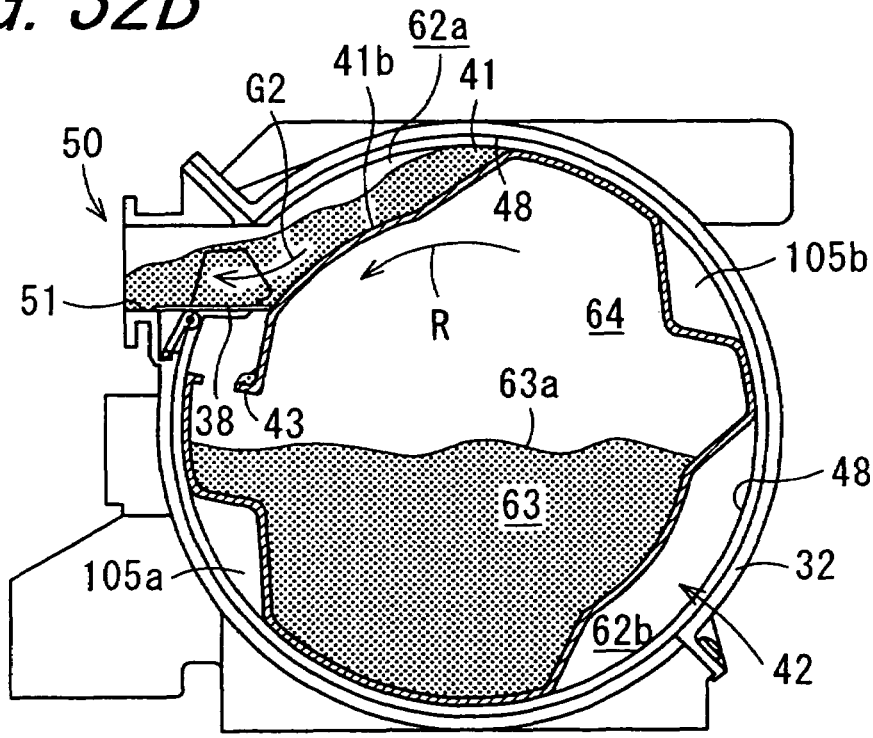

When the container main body 31 rotates in the rotation direction R from the state illustrated in FIG. 32A, the upstream end portion 38*b* in the rotation direction of the developer guiding member 38 of the supporting member 32 enters the first storage space 62*a* again, extends upstream in the rotation direction R, and slides on the outer periphery face of the bottom wall portion 41*b* of the first concavity 41 while resiliently abutting on the outer periphery at the second angle θ1 larger than 90 degrees with the outer periphery face, as illustrated in FIG. 32B. At this moment, the developer retained in the first storage space 62*a* on the upstream side of the developer guiding member 38 in the rotation direction R flows toward the supporting member 32 through rotation of the container main body 31 in the rotation direction R. Since the eliminating operation and the pressing-out operation are executed plural times as described before, even if developer having low fluidity is retained in the first storage space 62*a*, it is possible to eliminate the developer adhering to the developer guiding member 38 when the upstream one end portion 38*b* in the rotation direction of the developer guiding member 38 enters the first storage space 62*a* again. Moreover, since it is possible to reduce the developer remaining in the leading through hole 51 that becomes resistance when the developer is newly discharged from the leading through hole 51, it is possible to suppress increase of rotation torque, and prevent that the quantity of the developer discharged from the developer container 30 undesirably decreases.

As described before, the part of the third container segment 35 excluding the first and second concavities 41, 42 and the inner periphery portion 48 of the supporting member 32 do not abut on each other over circumferences thereof in the circumferential direction, in order to reduce friction force that hinders rotation of the container main body 31 about the rotation axial line L31. In specific, a gap of 2 mm is formed between the part of the third container segment 35 excluding the first and second concavities 41, 42 and the inner periphery portion 48 of the supporting member 32. Therefore, as described before, there is no guarantee that the developer retained in the first storage space 62*a* never leaks out of the first storage space 62*a*. As described before, the discharge guide pieces 44 are disposed on the outer periphery portion of the third container segment 35 at the axial one end portion and the axial other end portion excluding the first concavity 41 and the second concavity 42. The discharge guide pieces 44 disposed at the axial one end portion of the third container segment 35 incline in the rotation direction R as they go from the axial other end portion to the axial one end portion, and the discharge guide pieces 44 disposed at the axial other end portion of the third container segment 35 incline in the rotation direction R as they go from the axial one end portion to the axial other end portion. Therefore, in a case where the developer retained in the first storage space 62*a* leaks out to one side or the other side of the rotation axial line L32, it is possible to gather to the axial middle parts of the third container segment 35 and the supporting member 32 by the discharge guide pieces 44 while the container main body 31 is rotating in the rotation direction R.

Further, since the second storage space 62*b* is formed as described before, in a case where the developer retained in the first storage space 62*a* leaks out of the upstream part in the rotation direction R of the first storage space 62*a*, the developer leaked out and the developer gathered to the axial middle parts by the discharge guide pieces 44 are retained in the second storage space 62*b*.

When the container main body 31 rotates in the rotation direction R, the upstream end portion 38*b* in the rotation direction of the developer guiding member 38 of the supporting member 32 enters the second storage space 62*b*, extends upstream in the rotation direction R, and slides on the outer periphery face of the bottom wall portion 42*b* of the second concavity 42 while resiliently abutting on the outer periphery face at the angle θ1 larger than 90 degrees with the outer periphery face, as illustrated in FIG. 30B. At this moment, through rotation of the container main body 31 in the rotation direction R, the developer retained in the second storage space 62*b* on the upstream side of the developer guiding member 38 in the rotation direction R is flown toward the supporting member 32, guided to the leading through hole 51, and led and discharged to the outside of the developer container 30.

Thus, even if the developer leaks out of the first storage space 62*a* every time the container main body 31 rotates once in the rotation direction R about the rotational axial line L31, the leaked out developer is retained in the second storage space 62*b*, so that it is possible to discharge the predetermined quantity of developer as securely as possible.

Further, as described before, in a state where the supporting base 49 is placed on the horizontal plane, the supporting member 32 is provided with, on an upper part thereof, the discharge portion 50 protruding in the one first horizontal direction F1 that is one direction of one horizontal direction. The discharge portion is provided with, at the middle portion thereof in the axial direction of the supporting member 32, the leading through hole 51 that passes along the one first horizontal direction F1 and is open like an ellipse shape extending in a direction parallel to the axial line L32 of the supporting member. Consequently, even when the container main body 31 is filled with the developer, the upper face 63*a* of the developer layer 63 is located at the same height as the leading through hole 51 or below the leading through hole 51, so that it is possible to securely prevent that the developer undesirably flows out of the container main body 31 to the leading through hole 51.

Figure 33:
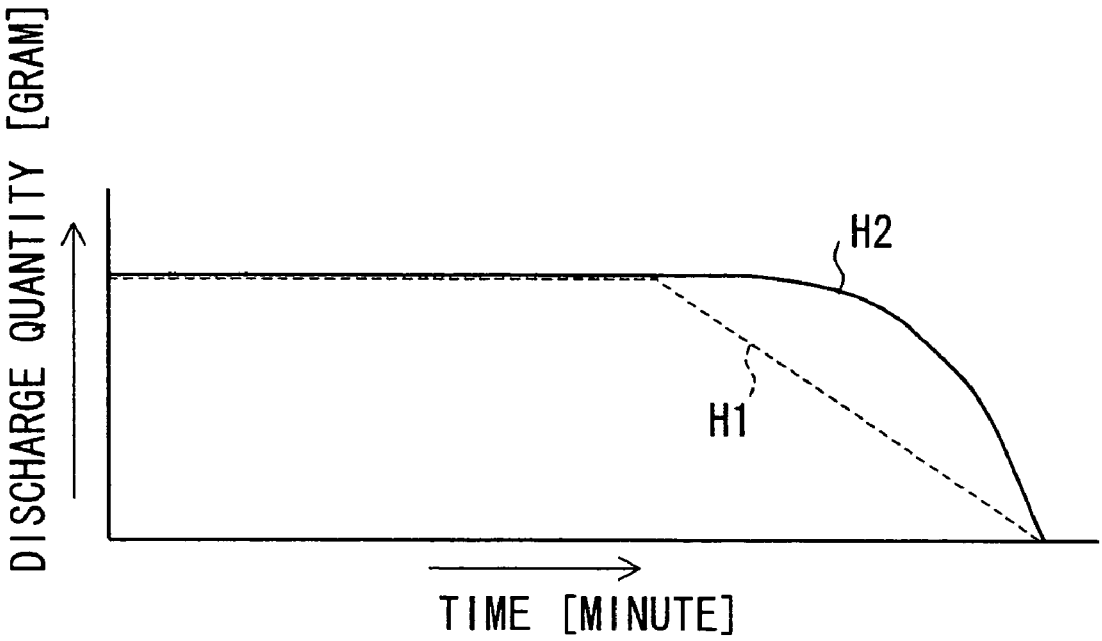
FIG. 33 is a graph displaying a relationship between the quantity of developer discharged from the developer container and time.

FIG. 33 is a graph displaying a relationship between the quantity of the developer discharged from the developer container 30 and time. In FIG. 33, a curved line H1 indicates a relationship between the quantity of the developer discharged from the developer container 30 and time in a case where the third container segment 35 of the container main body 31 is formed so that the inner diameter D35 thereof is equal to or less than the inner diameters D33 and D34 of the first and second container segments 33 and 34. A curved line H2 indicates a relationship between the quantity of the developer discharged from the developer container 30 and time in a case where the third container segment 35 of the container main body 31 is formed so that the inner diameter D35 thereof is larger than the inner diameters D33 and D34 of the first and second container segments 33 and 34. Powdery developer has the property of becoming like a gentle mountain soon even if piled like a steep mountain on the horizontal plane. For example, in a case where the third container segment 35 of the container main body 31 is formed so that the inner diameter D35 thereof is equal to or less than the inner diameters D33 and D34 of the first and second container segments 33 and 34, the developer conveyed to the discharge hole 43 through rotation of the container main body 31 is separated from the discharge hole 43 when the rotation of the container main body 31 stops. In this case, when the quantity of the developer stored in the container main body 31 is very small, it is difficult to convey a sufficient quantity of developer to the discharge hole 43 immediately after the rotation of the container main body 31 restarts.

Further, as illustrated in FIG. 8, the third container segment 35 is formed so that the inner diameter thereof is larger than the inner diameters D33 and D34 of the first and second container segments 33 and 34 that are the remaining parts. Therefore, it is possible to prevent that the developer once conveyed to the third container segment 35 is separated from the third container segment 35 as far as possible when the quantity of the developer stored in the container main body 31 is very small. Consequently, even when the quantity of the developer stored in the container main body 31 is very small, it is possible to convey a sufficient quantity of developer to the discharge hole 43 as far as possible immediately after rotation of the container main body 31 restarts. Furthermore, it is possible to discharge almost all of the developer stored in the container main body 31 to the outside.

As indicated by the curved line H1, in a case where the third container segment 35 of the container main body 31 is formed so that the inner diameter D35 thereof is equal to or less than the inner diameters D33 and D34 of the first and second container segments 33 and 34, when the quantity of the developer stored in the container main body 31 decreases, the quantity of the discharged developer decreases sharply responding to the decrease. On the other hand, as indicated by the curved line H2, in a case where the third container segment 35 of the container main body 31 is formed so that the inner diameter D35 thereof is larger than the inner diameters D33 and D34 of the first and second container segments 33 and 34, even when the quantity of the developer stored in the container main body 31 decreases, the quantity of the discharged developer remains substantially constant until the quantity of the developer becomes nearly zero, as compared with the curved line H1. Accordingly, the developer container 30 of the present embodiment is capable of stably discharging the developer for a longer period.

As described above, when the container main body 31 is rotated about the axial line L31, the stored developer is conveyed toward the discharge hole 43 and discharged from the discharge hole 43 to the first storage space 62*a*. Since the supporting member 32 covers a part including at least the first concavity 41 and the discharge hole 43 of the container main body 31 over circumferences thereof from outside in the radial direction, the developer discharged from the discharge hole 43 to the first storage space 62*a* is retained in the first storage space 62*a*. The developer retained in the first storage space 62*a* is guided to the leading through hole 51 by the developer guiding member 38 and discharged outside from the leading through hole 51. Thus, the developer discharged from the discharge hole 43 of the container main body 31 is not directly discharged from the developer container 30 but retained once in the first storage space 62*a* formed between the container main body 31 and the supporting member 32, so that it is possible to keep the quantity of the developer discharged from the leading through hole 51 constant. Since it is possible to keep the quantity of the discharged developer constant, it is possible, for example, in a case where the developer container 30 is installed in an image forming apparatus, to prevent that the shade of images undesirably changes.

For example, in a case where the fluidity of the developer is low, the developer may adhere to the developer guiding member 38 when the developer is discharged from the leading through hole 51. When the developer is again discharged from the leading through hole 51 in this state, there is a case where the developer adhering to the developer guiding member 38 becomes resistance and rotation torque of the container main body 31 increases. Since the quantity of the discharged developer from the container main body 31 via the discharge hole 43 changes depending on the number of rotations, there is a case where a rotation speed decreases due to the increase of the rotation torque and the discharge quantity undesirably decreases.

In a case where the developer adheres to the developer guiding member 38, the developer adhering to the developer guiding member 38 is eliminated by the adhesion eliminating portion. Consequently, it is possible to prevent that the supply path for supplying the developer from the developer guiding member 38 to the leading through hole 51 is narrowed by the developer, and prevent that the quantity of the developer guided to the leading through hole 51 is reduced, so that it is possible to keep the quantity of the developer discharged from the leading through hole 51 constant.

Further, the adhesion eliminating portion executes the eliminating operation plural times while the container main body 31 is rotating once, so that it is possible to securely eliminate the developer adhering to the developer guiding member 38. Consequently, it is possible to securely prevent that the quantity of the developer guided to the leading through hole 51 is reduced, and it is possible to keep the quantity of the developer discharged from the leading through hole 51 constant. Since the pressing-out operation is executed plural times, it is possible to reduce the developer the developer remaining in the leading through hole 51 that becomes resistance when the developer is newly discharged from the leading through hole 51. Thus, it is possible to suppress increase of rotation torque, and prevent that the quantity of the developer discharged from the developer container 30 undesirably decreases.

Further, it is possible to make the developer guiding member 38 collide with the container main body 31 or the supporting member 32, thereby eliminating the developer adhering to the developer guiding member 38 by the inertial force. Thus, it is possible to keep the quantity of the developer discharged from the leading through hole 51 constant with a simple configuration. Moreover, since it is possible to resolve the developer by impact at the time of collision, it is possible, even if the developer adhering to the developer guiding member 38 is the aggregated state, to securely eliminate. Accordingly, it is possible to securely prevent that the leading through hole 51 is narrowed by the developer, with the result that it is possible to keep the quantity of the developer discharged from the leading through hole 51 constant.

The adhesion eliminating portion can have the end wall portions 100*a* and 101*a* that are the respective upstream inner wall portions in the rotation direction of the depressed portions 100 and 101 depressed inwardly in the radial direction from the container main body 31. The developer guiding member 38 collides with the respective upstream end wall portions 100*a* and 101*a* in the rotation direction of the depressed portions 100 and 101, and makes an angular displacement while sliding on the end wall portions 100*a* and 101*a*. In this case, the developer adhering to the developer guiding member 38 is separated from the developer guiding member 38 by the inertial force, when the developer guiding member 38 makes an angular displacement, and when the developer guiding member finishes the angular displacement. Consequently, the developer adhering to the developer guiding member 38 is eliminated, and it is possible to keep the quantity of the developer discharged from the leading through hole 51 constant.

The discharge hole 43 can be formed on the end wall portion 41*a* that is the downstream inner wall portion in the rotation direction of the first concavity 41, and the first depressed portion 100 can be disposed in a position close to the first concavity 41 to a position away from the first concavity 41, so as to oppose a part of the inner wall portion having the discharge hole 43 from downstream in the rotation direction. Since the first depressed portion 100 is depressed inwardly in the radial direction of the container main body 31, it is possible to form a projection that protrudes inwardly in the radial direction, in a position close to the discharge hole 43 and opposing the part of the end wall portion 41*a* having the discharge hole 43 from downstream in the rotation direction. Consequently, it is possible to prevent that the developer spreads downstream in the rotation direction from the discharge hole 43 and aggregates, so that the developer is easily discharged from the discharge hole 43 to the first storage space 62*a*.

Further, for example, in a case where the fluidity of the developer is high, the first storage space 62*a* may be filled with the developer. In a case where the first storage space 62*a* is filled with the developer, there is a possibility that the scraping operation cannot be executed. Moreover, in a case where the first storage space 62*a* is filled with the developer, there is a possibility that the developer aggregated in the gap between the part excluding the first and second concavities 41, 42 of the third container segment 35 and the inner periphery portion 48 of the supporting member 32 jams and causes increase of rotation torque of the container main body 31.

A space near the discharge hole 43 of a space inside the container main body 31 can be made small because the projection is formed. Consequently, even when the fluidity of the developer is high, it is prevented that an excessive quantity of developer is discharged into the storage space from the discharge hole 43, and a proper quantity of developer is retained in the first storage space 62*a*. Consequently, the developer guiding member 38 can thoroughly execute the guiding operation of guiding the developer from the storage space to the leading through hole, and can keep the quantity of the developer discharged from the leading through hole 51 constant.

Further, since the projection is formed by disposing the first depressed portion 100, there is no need to form a new protruding portion downstream in the rotation direction of the discharge hole 43, and it is possible to realize the developer container 30 that is capable of keeping the quantity of the developer discharged from the leading through hole 51 constant with a simple configuration.

Further, the developer guiding member 38 can be formed like a sheet. Therefore, for example, there is a possibility that the developer guiding member causes plastic deformation by abutting on the outer periphery face of the container main body 31 rotating about the axial line. However, even if the developer guiding member causes plastic deformation, the spring force generating portion applies a spring force so that the upstream end portion 38*b* in the rotation direction of the developer guiding member 38 resiliently abuts on the outer periphery face of the container main body 31 at the concavities 41, 42 and the depressed portions 100, 101. Consequently, the upstream end portion 38*b* in the rotation direction of the developer guiding member 38 resiliently abuts on the outer periphery face of the container main body 31 at the concavities 41, 42 and the depressed portions 100, 101 with security, and can guide at least the developer retained in the storage spaces 62*a* and 62*b* to the leading through hole 51 by scraping off the outer periphery faces of the concavities 41 and 42. Accordingly it is possible to discharge and supply a steady quantity of developer from the leading through hole 51 for a long period.

Further, when the container main body 31 is rotated about the rotation axial line L31, the stored developer can be conveyed toward the discharge hole 43 and discharged from the discharge hole 43. Since the part including at least the first and second concavities 41, 42 and the discharge hole 43 of the container main body 31 is covered over circumferences thereof from outside in the radial direction by the supporting member 32, the developer discharged to the first concavity 41 from the discharge hole 43 is retained in the first storage space 62*a* facing the first concavity 41 and the inner periphery portion 48 of the supporting member 32. Since the spring member 98 causes the upstream end portion 38*b* in the rotation direction R to resiliently abut on the surfaces of the bottom wall portions 41*b* and 42*b* of the first and second concavities 41 and 42 of the container main body 31, the developer guiding member 38 can execute the scraping operation of scraping the developer retained in the first and second storage spaces 62*a* and 62*b* off the surfaces of bottom wall portions 41*b* and 42*b* of the first and second concavities 41 and 42 and guide to the leading through hole 51, through rotation of the container main body 31 about the rotation axial line L31. The developer thus guided to the leading through hole 51 is discharged outside from the leading through hole 51.

Further, the developer guiding member 38 can have flexibility and springiness, and the deformation preventing member 97 can prevent plastic deformation of the middle portion 38*c* of the developer guiding member 38 between both the end portions in the rotation direction R. Therefore, it is possible to securely prevent that the middle portion 38*c* of the developer guiding member 38 between both the end portions in the rotation direction R causes plastic deformation by abutting on the outer periphery face of the container main body 31 rotating about the rotation axial line L31. Furthermore, since at least at the upstream end portion 38*b* in the rotation direction R of the developer guiding member 38 has flexibility and springiness, the upstream end portion 38*b* in the rotation direction R of the developer guiding member 38 can resiliently abut on the surfaces of the bottom wall portions 41*b* and 42*b* of the first and second concavities 41 and 42 of the container main body 31 rotating about the rotation axial line L31 overall along the rotation axial line, with a uniform spring force. Consequently, through rotation of the container main body 31 about the rotation axial line L31, it is possible to scrape almost all of the developer retained in the first and second storage spaces 62*a* and 62*b* of the container main body 31 off the surfaces of the bottom wall portions 41*b* and 42*b* of the first and second concavities 41 and 42, thereby guiding to the leading through hole 51 and discharging outside from the leading through hole 51.

Further, the guide walls 99 protruding outwardly in the radial direction can be formed at both the axial end portions of the developer guiding member 38, so that it is possible to prevent that the developer that should be guided to the leading through hole 51 is guided to another place other than the leading through hole 51, and securely guide the developer to the leading through hole 51, and it is possible to discharge outside from the leading through hole 51.

Further, it is possible to carry the developer stored in the container main body 31 in the axial direction by the carrying means disposed to the inner periphery portion of the container main body 31, as the container main body 31 is driven to rotate about the axial line L31. In a case where the carrying means is formed into, for example, a projection piece protruding inwardly in the radial direction or a groove depressed outwardly in the radial direction, extending substantially along a helical direction about the axial line L31, there is a possibility that the developer aggregates near the carrying means because the developer around the carrying means abuts on the carrying means at all times. In this case, there is also a possibility that by twisting and bending external force and impact applied to the container main body, the container main body is easily cracked and broken at the carrying means substantially along the helical direction. In one or more embodiments, the carrying means has the plurality of first projection pieces 36 extending in the first extending direction and the plurality of second projection pieces 37 extending in the second extending direction, and the first projection pieces 36 and the second projection pieces 39 are formed apart in the circumferential direction and the axial direction, respectively. Therefore, the developer near the carrying means abuts on and leaves from the first and second projection pieces 36 and 39 alternately while the container main body 31 is rotating, so that the developer does not abut on the carrying means at all times, and it is possible to prevent cohesion of the developer near the carrying means as far as possible. Moreover, since the projection pieces 36 and 39 are formed apart in the first and second extending directions, respectively, it is possible to prevent as far as possible that the container main body 31 is easily cracked and broken at the carrying means substantially along the helical direction by the twisting and bending external force and impact applied to the container main body 31.

Further, it is possible to rotate the container main body 31 about the rotation axial line L31 while stably supporting by the supporting member 32. For example, in a case where a cylindrical container for storing developer is installed upright so that an axial line thereof becomes perpendicular to the horizontal plane and left in this state, there is a danger that the developer in a lower part of the container aggregates. Moreover, in a case where the container is installed on the horizontal plane so that the axial line thereof becomes parallel to the horizontal plane in order to prevent the cohesion of the developer as far as possible, the container will roll. The developer container 30 of the example embodiment(s) can be stably placed with the axial line L31 of the container main body 31 parallel to the horizontal plane, by installing the supporting base 49 of the supporting member 32 on the horizontal plane. Moreover, even if the developer stored in the developer container 30 partially aggregates, for example, the user can shift the shutter 65*a* of the shutter portion 65 to the closed position P1 and rotate the container main body 31, thereby easily agitating and making the developer powdery.

Furthermore, since each of the faces 33*c* and 34*c* where the outer periphery faces and the end faces are connected at both the axial end portions 33*a* and 34*a* of the container main body 31 is formed into a curved shape inclining inwardly in the radial direction as described before, the developer container easily falls even if the user tries to place one of the axial end portions 33*a* and 34*a* of the container main body 31 on the horizontal plane and install the developer container 30 upright on the horizontal plane so that the axial line L31 becomes perpendicular to the horizontal plane. Consequently, it is possible to prevent that the user installs the developer container 30 upright so that the axial line L31 becomes perpendicular to the horizontal plane and leaves in this state, thereby reducing the factors in cohesion of the stored developer. Accordingly, there is no need to agitate the developer excessively, and hence, it is possible to prevent that the life of the developer becomes short.

Further, the fourth angle θ100*b* and the fifth angle θ101*b* are set to angles larger than the sixth angle θ42*b*. Consequently, the developer guiding member 38 collides with the respective bottom wall portions 100*b* and 101*b* of the depressed portions 100 and 101 at large angular velocity when entering the eliminating operation spaces 111*a* and 111*b*, so that it is possible to resolve developer aggregating and adhering to the developer guiding member 38. Moreover, conversely, the sixth angle θ42*b* is set to an angle smaller than the fourth angle θ100*b* and the fifth angle θ101*b*. Consequently, in the second storage space 62*b*, it is possible to securely make the developer guiding member 38 abut on the bottom wall portion 42*b* of the second concavity 42 from the downstream end portion in the rotation direction R thereof, so that it is possible to securely execute the scraping operation. Furthermore, since a plurality of spaces to execute the eliminating operations are formed, it is possible to securely eliminate the developer adhering to the developer guiding member 38. Thus, it is possible to resolve the developer adhering to the developer guiding member 38, eliminate the resolved developer, and securely execute the scraping operation, so that it is possible to realize the developer container 30 that can keep the quantity of the developer discharged from the leading through hole 51 constant.

Further, when the developer guiding member 38 enters the first eliminating operation space 111*a* and the second eliminating operation space 111*b*, the developer guiding member 38 collides with the bottom wall portion 100*b* of the first depressed portion 100, thereby executing the eliminating operation. Moreover, even if the developer aggregates and adheres to the developer guiding member 38, it is possible to resolve the developer as described before. Furthermore, in the example embodiment(s), the spring force generating portion is disposed, so that the developer guiding member collides with great force when shifting from the opened state 106 to the closed state 107. Therefore, even if the developer adhering to the developer guiding member 38 is in the aggregated state, it is possible to securely resolve the developer. Since the aggregated developer is thus resolved, it is possible to securely eliminate the developer adhering to the developer guiding member 38 in the eliminating operation.

Further, not only the first storage space 62*a* and the second storage space 62*b* but also the first eliminating operation space 111*a* and the second eliminating operation space 111*b* are formed. Consequently, in a case where the developer retained in the storage spaces 62*a* and 62*b* leaks out from upstream parts in the rotation direction R of the storage spaces 62*a* and 62*b*, the developer leaked out and the developer gathered to the axial middle parts by the discharge guide pieces 44 are retained in the eliminating operation spaces 111*a* and 111*b*.

When entering the eliminating operation spaces 111*a* and 111*b*, the developer guiding member 38 slides on the outer periphery faces of the bottom wall portions 100*b* and 101*b* of the depressed portions 100 and 101 while resiliently abutting on the outer periphery faces at the second angle θ1 larger than 90 degrees with the outer periphery faces. At this moment, as the container main body 31 rotates in the rotation direction R, the developer retained in the eliminating operation spaces 111*a* and 111*b* on the upstream side in the rotation direction R of the developer guiding member 38 is flown toward the supporting member 32, guided to the leading through hole 51, and led and discharged to the outside of the developer container 30.

Thus, even if the developer leaks out from the storage spaces 62*a* and 62*b* every time the container main body 31 rotates once in the rotation direction R about the rotation axial line L31, the leaked out developer is retained in the eliminating operation spaces 111*a* and 111*b*, so that it is possible to discharge a predetermined quantity of developer as securely as possible. Thus, by disposing the depressed portions 100 and 101, it is possible to retain the developer leaked out from the storage spaces 62*a*, 62*b* and discharge a predetermined quantity of developer as securely as possible, and moreover, it is possible to eliminate the developer adhering to the developer guiding member 38 and keep the quantity of the developer discharged from the leading through hole 51 constant.

Further, a plurality of depressed portions to form the eliminating operation spaces are disposed. In specific, two depressed portions including the first depressed portion 100 and the second depressed portion 101 are disposed. Therefore, for example, even if the second eliminating operation space 111*b* is filled with the developer, it is possible to have a space for executing the eliminating operation in the eliminating operation space 111*a* formed on the upstream side in the rotation direction R of the second eliminating operation space 111*b*. Accordingly, it is possible to securely execute the eliminating operation.

Further, the supporting member 32 supports the part including at least the third container segment 35 of the container main body 31 over circumferences thereof from outside in the radial direction. Moreover, since the two seal members 47 are disposed between the container main body 31 and the supporting member 32, and sealing is achieved as described before, it is possible to prevent that the developer leaks out from between the container main body 31 and the supporting member 32 while the container main body 31 is rotating.

Further, the quantity of the discharged developer depends on the capacity of the first storage space 62*a* and the rotation speed of the container main body 31. The developer container 30 of the present embodiment has such a configuration that two concavities including the first and second concavities 41 and 42 are disposed and only the first concavity 41 is provided with the ejection hole 43, but the configuration is not limited thereto. For example, in a case where there is a need to increase the quantity of the discharged developer per rotation of the container main body 31, the second concavity 42 may be formed into the same shape as the first concavity 41 and provided with the ejection hole 43. The number of the concavities and the number of the ejection holes may be increased.

Further, the concavities 41, 42 and the depressed portions 100, 101 are formed on the third container segment 35 so that the cross sections of the axial middle part of the third container segment 35 perpendicular to the axial line L35 become substantially symmetrical with respect to a point as illustrated in FIGS. 9A and 9B. By thus forming so as to become substantially symmetrical with respect to a point, it is possible to easily form the container main body 31 when forming by blow molding, and it is also possible to balance rotation torque at the time of rotation of the container main body 31, so that it is possible to keep the rotation speed of the container main body 31 constant. Therefore, when the container main body 31 rotates in the rotation direction R, it is possible to make the quantity of the developer flowing out via the discharge hole 43 constant. Consequently, it is possible to keep the quantity of the developer discharged from the leading through hole 51 constant.

Further, the developer container 30 can have such a configuration that two depressed portions including the first and second depressed portions 100 and 101 are disposed, but the configuration is not limited thereto. For example, the number of the depressed portions may be one, and the number of the depressed portions may be increased.

The carrying means can be configured so as to have the first projection pieces 36 extending in the first extending direction about the axial line L31 and protruding inwardly in the radial direction and the second projection pieces 39 extending in the second extending direction about the axial line L31 and protruding inwardly in the radial direction, but the configuration is not limited thereto. For example, the carrying means may be grooves depressed outwardly in the radial direction, extending in the first and second extending directions, and spaced in the diameter direction and in the axial direction.

Further, regarding the respective projection pieces 36 and 39 of the developer container 30, the projection pieces 36 and 39 formed close to the discharge hole 43 may be formed so that inward protrusion amounts in the radial direction thereof are larger than those of the projection pieces 36 and 39 formed far from the discharge hole 43. Consequently, an axial carrying quantity of the developer close to the discharge hole 43 while the container main body 31 is rotating becomes larger than an axial carrying quantity of the developer far from the discharge hole 43, so that it is possible to make the carrying quantity of the developer non uniform with respect to the axial direction. In a case where the carrying quantity of the developer is uniform with respect to the axial direction, the developer stored in the container main body 31 is uniformly carried to the discharge hole 43 when the container main body 31 rotates, so that there is a bare possibility that the carried developer aggregates near the discharge hole 43. In the case of making the axial carrying quantity of the developer close to the discharge hole 43 larger than the axial carrying quantity of the developer far from the discharge hole 43 at the time of rotation of the container main body 31, only the developer close to the discharge hole 43 is carried directly to the discharge hole 43, so that it is possible to almost completely eliminate the possibility that the carried developer aggregates near the discharge hole 43.

In the example embodiment(s), each of the outer periphery faces of the bottom wall portions 100*b* and 101*b* of the depressed portions 100 and 101 can be formed into a rectangular shape. However, a middle portion in the rotation direction R between a downstream end portion in the rotation direction R and an upstream end portion in the rotation direction R of the bottom wall portion 100*b* of the first depressed portion 100 may be located more inwardly in the radial direction than the third container segment 35 excluding the concavities 41, 42 and the depressed portions 100, 101, and formed into a partly cylindrical shape whose axial line is substantially the axial line L35 of the third container segment 35. Similarly, a middle portion in the rotation direction R between a downstream end portion in the rotation direction R and an upstream end portion in the rotation direction R of the bottom wall portion 101*b* of the second depressed portion 101 may be located more inwardly in the radial direction than the third container segment 35 excluding the first and second concavities 41 and 42, and formed into a partly cylindrical shape whose axial line is substantially the axial line L25 of the third container segment 35.

Figure 34:
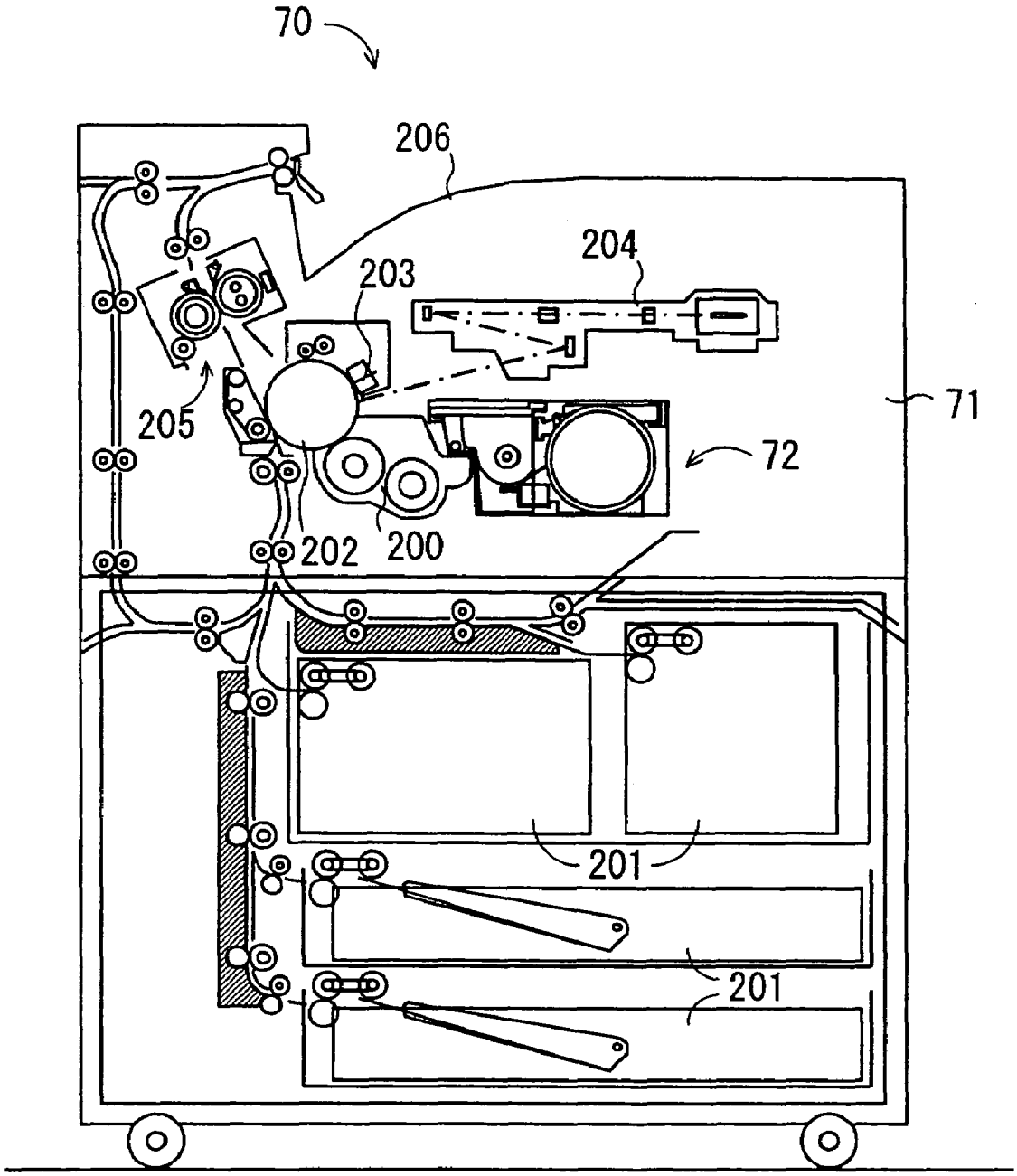
FIG. 34 is a cross section view illustrating an image forming apparatus 70 of another example embodiment.
Figure 35:
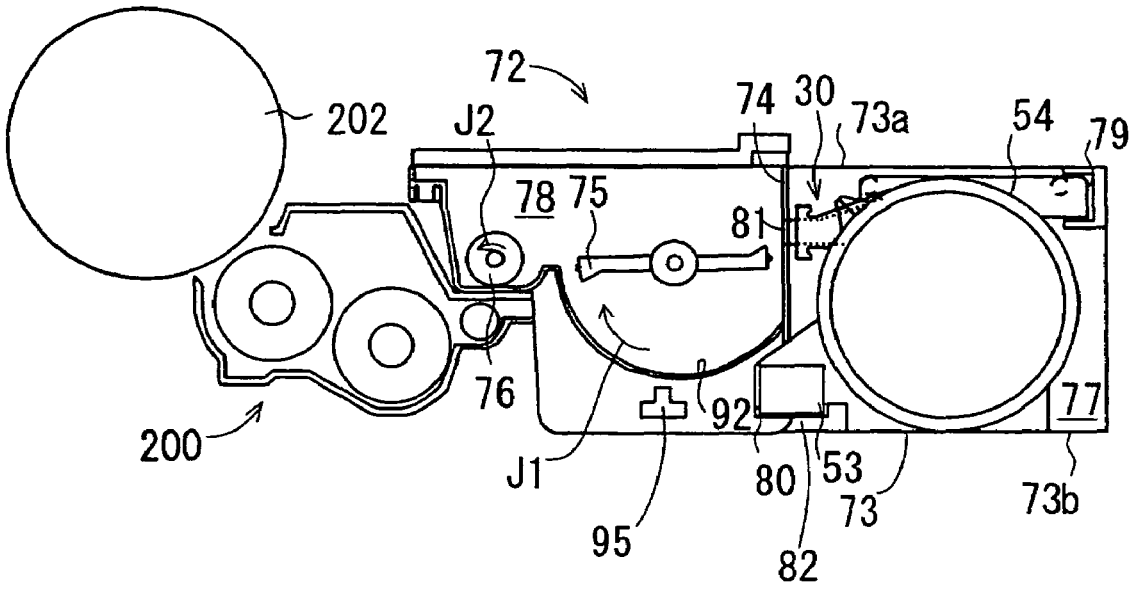
FIG. 35 is a magnified cross section view illustrating an area around a toner hopper.
Figure 36:
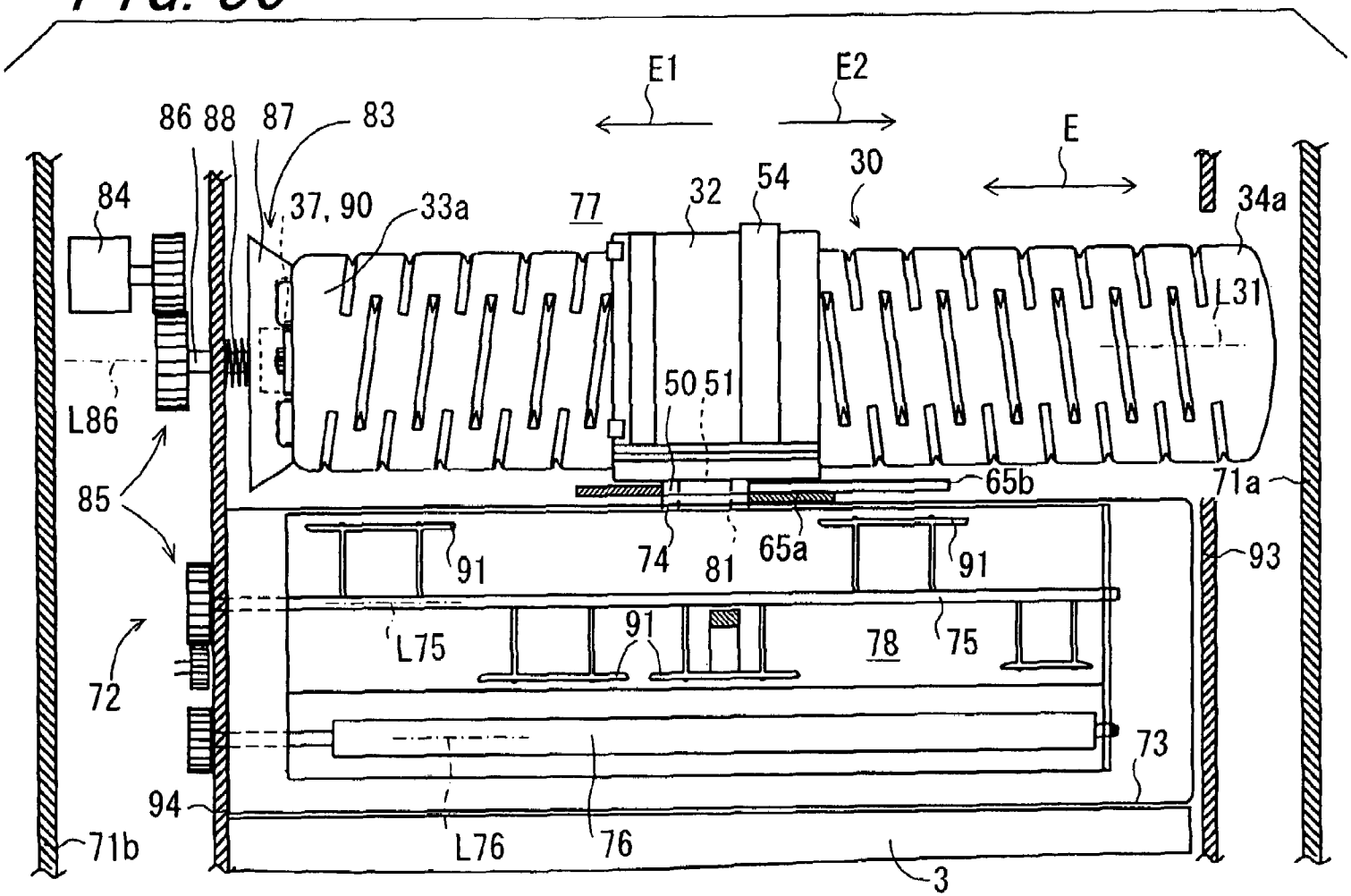
FIG. 36 is a magnified cross section view illustrating an area around the toner hopper.

FIG. 34 is a cross section view illustrating an image forming apparatus 70 of another example embodiment. FIG. 35 is a magnified cross section view illustrating an area around a toner hopper 72, FIG. 36 is a magnified cross section view illustrating an area around the toner hopper 72. FIG. 34 is across section view seen from a front-side exterior portion 71*a* of the image forming apparatus 70, where the thickness is omitted in order to make it easy to understand. The front-side exterior portion 71*a* is a portion that the user faces when using the image forming apparatus 70 usually. A back-side exterior portion 71*b* is a portion on the opposite side to the front-side exterior portion 71*a* of the image forming apparatus 70 for the user on the side of the front-side exterior portion 71*a*. The image forming apparatus 70 is placed on the horizontal plane, and a front-to-rear direction E that is a direction from the front-side exterior portion 71*a* toward the back-side exterior portion 71*b* is parallel to the horizontal plane.

The example electrophotographic image forming apparatus 70 such as a printer apparatus and a copying apparatus can comprise the aforementioned developer container 30 and an image forming apparatus main body (may be simply referred to as "apparatus main body" hereafter) 71. The developer container 30 is attached to the toner hopper 72 disposed to the apparatus main body 71, so as to be attachable and detachable via a container attachment/detachment opening (not illustrated) that is disposed to the front-side exterior portion 71*a* of the apparatus main body 71 so as to be freely opened and closed. The image forming apparatus main body 71 is provided with a casing front portion 93 on a side closer to the back-side exterior portion 71*b* than the front-side exterior portion 71*a*, and the casing front portion is provided with an opening portion passing through in the thickness direction in which the developer container 30 can be inserted. Moreover, the image forming apparatus main body 71 is provided with a cabinet back portion 94 on a side closer to the front-side exterior portion 71*a* than the back-side exterior portion 71*b*. A casing, all of which is not illustrated, including the casing front portion 93 and the cabinet back portion 94 holds the various components of the image forming apparatus main body 71.

The toner hopper 72 includes a housing 73, a developer supply section 74, an agitation member 75, and a supply roller 76. An inner space of the housing 73 is divided into at least a container housing space 77 and an agitation space 78 by the developer supply section 74. The container housing space 77 is open facing the front-side exterior portion 71*a* of the apparatus main body 71. The agitation space 78 is a substantially closed space. The developer container 30 is placed in the container housing space 77.

On an upper wall portion 73*a* of the housing 73 facing the container housing space 77 is formed a first guide concavity 79 which extends in the front-to-rear direction E of the apparatus main body 71 and into which the second guide piece 54 of the supporting member 32 of the developer container 30 can fit. Into the first guide concavity 79, the second guide piece 54 of the supporting member 32 of the developer container 30 can fit so as to be capable of sliding in the longitudinal direction, that is, in an attachment direction E1 that is a direction parallel to the front-to-rear direction E of the apparatus main body 71 from the front-side exterior portion 71*a* toward the back-side exterior portion 71*b* and a detachment direction E2 that is a direction opposite to the attachment direction E1. Moreover, on a lower wall portion 73*b* opposing the upper wall portion 73*a* of the housing 73 facing the container housing space 77 is formed a second guide concavity 80 which extends in the front-to-rear direction E of the apparatus main body 71 and into which the first guide piece 53 of the supporting member 32 of the developer container 30 can fit. Into the second guide concavity 80, the first guide piece 53 of the supporting member 32 of the developer container 30 can fit so as to be capable of sliding in the longitudinal direction, that is, in the attachment direction E1 and the detachment direction E2 of the apparatus main body 71.

The developer supply section 74 is a plate-like member that divides the space inside the housing 73 into the container housing space 77 and the agitation space 78, and provided with a communication hole 81 passing through in the thickness direction and making the container housing space 77 and the agitation space 78 communicate with each other. Moreover, below the communication hole 81 of the developer supply section 74 is formed a guiding member 82 protruding into the container housing space 77.

Figure 37:
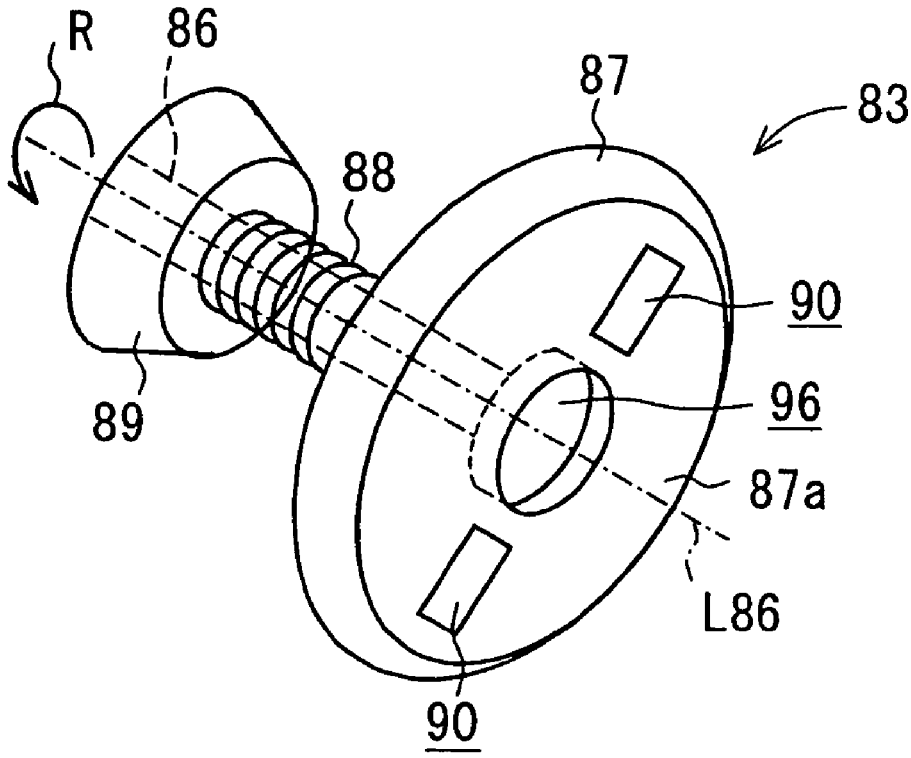
FIG. 37 is a magnified perspective view illustrating a main-body coupling portion.
Figure 38A:
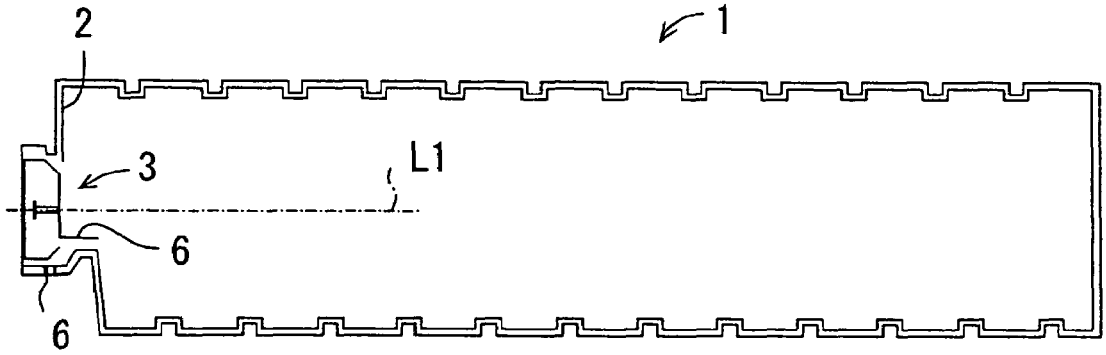
FIGS. 38A and 38B are views illustrating a first related art toner bottle.
Figure 38B:
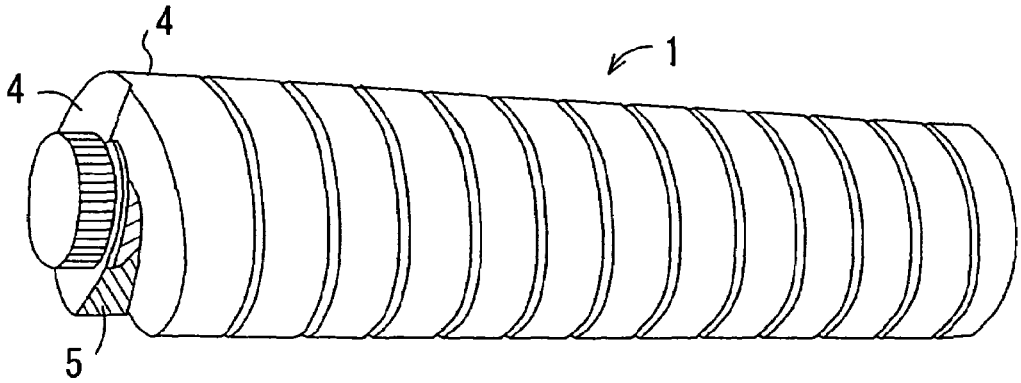
Figure 39:
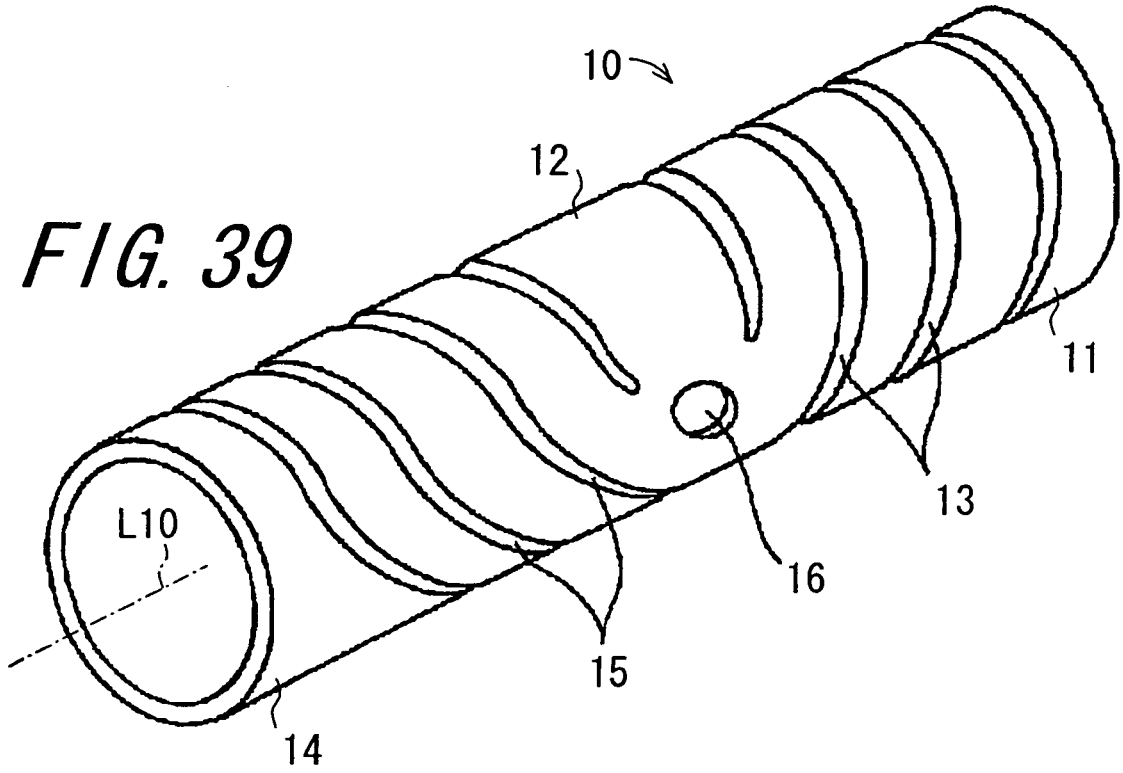
FIG. 39 is a view illustrating a second related art developer supplying container.
Figure 40A:
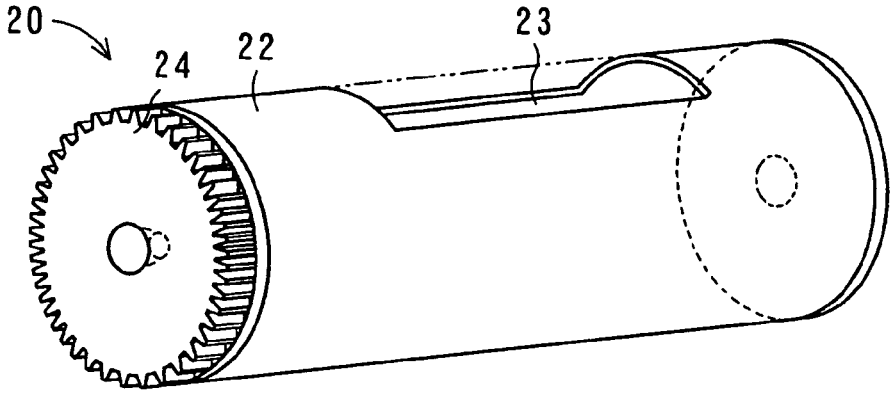
FIGS. 40A and 40B are views illustrating a third related art toner supplying device.
Figure 40B:
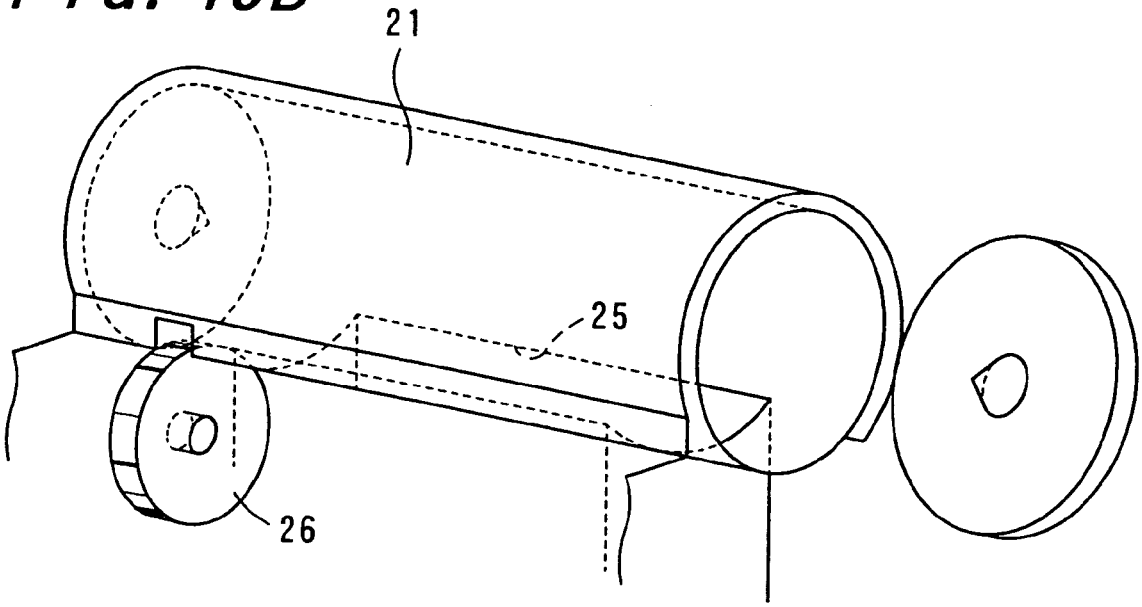

FIG. 37 is a magnified perspective view illustrating a main body-side coupling portion 83. A driving force for rotating the container main body 31 of the developer container 30 from a driving source 84 such as a motor of the apparatus main body 71 is transmitted to the main body-side coupling portion 83 via a speed reduction device 85 such as a gear. A driving portion includes the main body-side coupling portion 83, the driving source 84 and the speed reduction device 85. The main body-side coupling portion 83 includes a rotation shaft 86, a coupling support 87 and a spring member 88. The rotation shaft 86 is rotatably inserted, in a state where an axial line L86 thereof is parallel to the front-to-rear direction E of the apparatus main body 71, into a bearing 89 which is provided penetrating the cabinet back portion 94, which is the rear wall portion of the housing 73 on the back-side exterior portion 71*b* side of the apparatus main body 71, in the thickness direction. A free end portion of the rotation shaft is placed in the container housing space 77.

The coupling support 87 is formed into a substantially disk-like shape, faces the container housing space 77, and is coupled to the free end portion of the rotation shaft 86 so as to be rotatable about the axial line L86 together with the rotation shaft 86. In a middle portion of a surface portion 87*a* of the coupling support 87 opposite to a surface portion thereof facing the cabinet back portion 94 is formed an auxiliary concavity 96 which is depressed toward the cabinet back portion 94 centering on the axial line L86 of the rotation shaft 86 and into which a replenishment port 45 with a replenishment lid 46 of the developer container 30 attached thereto can fit. Moreover, a plurality of two concave fits 90 located symmetrically with each other with respect to the axial line L86 of the rotation shaft 86 and depressed toward the cabinet back portion 94 are formed on the surface portion 87*a* of the coupling support 87, more outwardly in the radial direction than the auxiliary concavity 96. The concave fits 90 are formed so as to correspond to the respective convex fits 37 of the container main body 31, and the respective convex fits 37 of the container main body 31 fit into the concave fits 90, whereby the convex fits 37 and the concave fits 90 fit with each other.

Further, the coupling support 87 freely makes a displacement in the axis direction of the rotation shaft 86 without dropping out from the free end portion of the rotation shaft 86. Moreover, a spring member 88 realized by a compression coil spring or the like is placed between the cabinet back portion 94 and the coupling support 87, and applies a spring force in a direction that the coupling support 87 is spaced from the cabinet back portion 94, without hindering rotation of the rotation shaft 86 and the coupling support 87. The axial one end portion 33*a* including the convex fits 37 of the container main body 31 of the developer container 30 and the coupling support 87 of the main body-side coupling portion 83 form a coupling structure. Therefore, the convex fits 37 of the container main body 31 can be coupled to the coupling support 87 of the main body-side coupling portion 83 so as to be attachable and detachable.

When the developer container 30 is installed into the apparatus main body 71, the developer container 30 is inserted into the container housing space 77 of the toner hopper 72 from the front-side exterior portion 71*a* of the apparatus main body 71 in a state where the rotation axial line L31 and the attachment direction E1 are parallel. At this moment, by fitting the first guide piece 53 of the supporting member 32 of the developer container 30 into the first guide concavity 79 of the housing 73, and fitting the second guide piece 54 of the supporting member 32 into the second guide concavity 80 of the housing 73, it is hindered that the supporting member 32 makes a displacement in a direction other than the attachment direction E1 and the detachment direction E2. In this state, the developer container 30 is displaced in the attachment direction E1, and placed in an attachment position that is a position where the leading through hole 51 of the discharge portion 50 of the supporting member 32 and the communication hole 81 of the developer supply section 74 communicate with each other. At this moment, the coupling support 87 of the main body-side coupling portion 83 is pressed and degenerated in the attachment direction E1 by the convex fit 37 of the container main body 31, and the spring member 88 is compressed.

The toner hopper 72 is provided with a restraining member (not illustrated) that restrains displacement of the supporting member 32 in the attachment direction E1 and the detachment direction E2 and releases the restraint in a state where the developer container 30 is placed in the attachment position. When all the developer stored in the developer container 30 is discharged, the user makes the restraining member release the restraint on the supporting member 32, displaces the developer container 30 in the detachment direction E2, and removes the developer container 30 from the apparatus main body 71.

The toner hopper 72 is provided with, at an area around the communication hole 81 facing the container housing space 77 of the developer supply section 74, shutter displacing means (not illustrated) for slidingly displacing the shutter 65*a* of the shutter portion 65 of the developer container 30. When the developer container 30 is inserted into the container housing space 77 of the toner hopper 72 from the front-side exterior portion 71*a* of the apparatus main body 71 in a state where the rotation axial line L31 is parallel to the attachment direction E1, the shutter 65*a* placed in the closed position P1 is slidingly displaced by the shutter displacing means in the one second horizontal direction B1, and when the developer container 30 is placed in the attachment position, the shutter 65*a* is placed in the opened position P2. On the contrary, when the developer container 30 attached to the apparatus main body 71 and placed in the attachment position is displaced in the detachment direction E2, and the developer container 30 is detached from the apparatus main body 71, the shutter 65*a* placed in the opened position P2 is slidingly displaced by the shutter displacing means in the other second horizontal direction B2, and placed in the closed position P1.

Further, a seal member (not illustrated) for preventing that the developer flowing from the leading through hole 51 to the communication hole 81 leaks out to a space other than the agitation space 78 is provided in at least one of an area around the leading through hole 51 of the discharge portion 50 of the supporting member 32 of the developer container 30 and an area around the communication hole 81 facing the container housing space 77 of the developer supply section 74 of the toner hopper 72.

As illustrated in FIG. 34, a developing section 200 is placed in a middle part in the front-to-rear direction E of the apparatus main body 71. This is because a photo conductive drum 202 of the apparatus main body 71 is placed in the middle part in the front-to-rear direction E of the apparatus main body 71. Moreover, a driving section including the driving source 84 and the speed reduction device 85 for rotating the main body-side coupling portion 83, the agitation member 75 and the supply roller 76 are placed between the cabinet back portion 94 and the back-side exterior portion 71*b* in the apparatus main body 71. Therefore, when the developer container 30 placed in the attachment position, the supporting member 32 of the developer container 30 is placed in the middle part in the front-to-rear direction E of the apparatus main body 71. In the developer container 30, as illustrated before, the container main body 31 is formed so that the length from the supporting member 32 to the end face of the axial one end portion 33*a* provided with the convex fit 37 is shorter than the length from the supporting member 32 to the end face of the axial other end portion 34*a*.

Since the supporting member 32 is placed on the axial middle portion of the container main body 31 in the developer container 30 in the image forming apparatus 70, the supporting member 32 is placed in the middle part in the front-to-rear direction E of the apparatus main body 71 when the developer container is attached in the attachment position in the image forming apparatus main body 71. Consequently, it is possible to make the container main body 31 extend from the middle part to a front part in the front-to-rear direction E as well as from the middle part to a rear part in the front-to-rear direction E in the apparatus main body 71, thereby making the capacity considerably large. In the present embodiment, as illustrated in FIG. 36, the axial other end portion 34*a* of the developer container 30 projects from the casing front portion 93 toward the front-side exterior portion 71*a*.

Further, by making the length from the supporting member 32 to the end face of the axial one end portion 33*a* of the container main body 31 shorter than the length from the supporting member 32 to the end face of the axial other end portion 34*a* of the container main body, it is possible to secure a region for disposing the driving section including the driving source 84 and the speed reduction device 85 coupled to the convex fit 37 of the axial one end portion 33*a* of the container main body 31, in the rear face portion of the apparatus main body 71. Thus, the developer container 30 produces two unique effects of effectively using a space inside the apparatus main body 71 and making the quantity of stored developer as large as possible.

When the driving source 84 is driven and the coupling support 87 is rotated in a state where the developer container 30 is placed in the attachment position, in a case where the concave fit 90 of the coupling support 87 and the convex fit 37 of the developer container 30 fit with each other, the container main body 31 rotates about the rotation axial line L31 in this state. On the other hand, in a case where the concave fit 90 of the coupling support 87 and the convex fit 37 of the developer container 30 do not fit with each other, only the coupling support 87 makes an angular displacement for a while until the concave fit 90 of the coupling support 87 and the convex fit 37 of the developer container 30 fit with each other. Then, when the concave fit 90 of the coupling support 87 and the convex fit 37 of the developer container 30 fit with each other, a spring force by the spring member 88 is applied, and the concave fit 90 of the coupling support 87 and the convex fit 37 of the developer container 30 fit with each other so as to firmly adhere. The container main body 31 rotates about the rotation axial line L31. The container main body 31 of the developer container 30 thus rotates about the rotation axial line L31, whereby the developer stored in the developer container 30 is supplied and stored into the agitation space 78 via the leading through hole 51 of the discharge portion 50 of the supporting member 32 and the communication hole 81 of the developer supply section 74 of the toner hopper 72.

The agitation member 75 and the supply roller 76 are placed in the agitation space 78 so as to be spaced from each other and extend in the front-to-rear direction E in the apparatus main body 71. The agitation member 75 freely rotates about an agitation axial line L75 parallel to the front-to-rear direction E, and has a scraper member 91 that extends along the agitation axial line L75 and has flexibility. Moreover, the agitation member 75 is rotated by a driving force from the driving source 84 disposed to the apparatus main body 71, in a clockwise direction j1 about the agitation axial line L75 when seen from the front of the apparatus main body 71. The supply roller 76 freely rotates about a supply axial line L76 parallel to the front-to-rear direction E, and has an outer periphery portion made of a porous resin such as sponge, for example. Moreover, the supply roller 76 is rotated by a driving force from the driving source 84 disposed to the apparatus main body 71, in a counterclockwise direction j2 about the supply axial line L76 when seen from the front of the apparatus main body 71.

An agitation wall portion 92 is formed so as to face the agitation space 78 of the toner hopper 72, be connected to the developer supply section 74, extend in the front-to-rear direction E in the apparatus main body 71, have a substantially U-letter shape in cross section perpendicular to the agitation axial line L75 of the agitation member 75, and be formed into a partly cylindrical inner periphery face opened upwardly. Developer is supplied from the single communication hole 81 to the agitation space 78. However, as described before, the developer discharged from the developer container 30 is not only agitated but also mixed with gas and finely powdered, and has considerably fine fluidity, so that the developer diffuses along the agitation axial line L75 in the agitation space 78 when just supplied from the communication hole 81. The developer held in the agitation space 78 is agitated by the agitation member 75, thereby further diffusing along the agitation axial line L75 in the agitation space 78.

When the agitation member 75 rotates, the agitation member agitates the developer supplied from the communication hole 81 and held in the agitation space 78, and also the scraper member 91 scrapes out the developer held in the agitation space 78 and supplies to the supply roller 76 while a free end portion thereof abuts on the agitation wall portion 92. Therefore, the finely powdered developer is supplied to the supply roller 76 almost uniformly along the axial line L76. Moreover, even when the remaining quantity of the developer held in the agitation space 78 is small, the scraper member 91 scrapes and supplies the developer to the supply roller 76, so that it is possible to make developer remaining in the agitation space 78 without supplied to the supply roller 76 as small as possible. The developer supplied to the supply roller 76 is supplied in a good state to the developing section 200 through rotation of the supply roller 76.

The apparatus main body 71 further comprises the developing section 200, a recording sheet cassette 201, the photo conductive drum 202, a charging section 203, a laser exposure section 204 and a fixing section 205. The developing section 200 produces a two-component developer by agitating toner that is developer supplied from the toner hopper 72 and carriers that are particles having magnetism prepared in advance.

The recording sheet cassette 201 holds recording sheets on which images are formed. The photo conductive drum 202 is a cylindrical drum having a photosensitive element on an outer periphery portion thereof, and rotated about an axial line thereof by a driving force from the driving portion. The charging section 203 applies electrical charge to the photosensitive element of the photo conductive drum 202 to achieve the photo sensitization. In the laser exposure section 204, the photosensitive element of the photo conductive drum 202 bearing electrical charge is exposed to laser light to form an electrostatic latent image on the photosensitive element.

In the developing section 200, the two-component developer is agitated and supplied to the photosensitive element of the photo conductive drum 202 on which the electrostatic latent image is formed, and the electrostatic latent image is developed, whereby a toner image corresponding to the electrostatic latent image is formed. From the photo conductive drum 202, the toner image formed on the photo conductive drum 202 is transferred onto a recording sheet supplied from the recording sheet cassette 201. In the fixing section 205, the toner image formed on the recording sheet is fixed onto the recording sheet. The recording sheet on which the toner image is fixed and an image is formed is discharged to a discharge tray 206. In order to keep the toner density of the two-component developer in the developing section 200 constant, the outer periphery portion of the supply roller 76 is made of sponge, and rotation of the supplying roller is controlled. Consequently, the supply roller 76 supplies a proper quantity of finely powdered toner to the developing section 200.

Control of the container main body 31 of the developer container 30 and the agitation member 75 and supply roller 76 of the toner hopper 72 will be briefly described below. When a residual toner detecting portion 95 disposed to the agitation wall portion 92 detects that the developer (may be referred to as "toner" hereafter) held in the agitation space 78 of the toner hopper 72 is getting small, a control section (not illustrated) controls the driving source 84 so as to rotate the container main body 31 of the developer container 30 and supply the toner to the agitation space 78. When the residual toner detecting portion 95 detects that the agitation space 78 is not filled with toner though the container main body 31 is rotated for a predetermined time, the control section stops rotation of the container main body 31, and also displays a message to replace the developer container 30 on a display section (not illustrated), thereby informing the user. At this moment, a considerable quantity of developer is stored in the agitation space 78 of the toner hopper 72. While the developer is held in the agitation space 78 of the toner hopper 72, the user detaches the empty developer container 30 from the apparatus main body 71, and attaches a new developer container 30 storing developer to the apparatus main body 71. Consequently, even when the image forming apparatus 70 is executing image formation onto recording sheet, it is possible to replenish developer to the apparatus main body 71 without interrupting the image formation operation because a necessary quantity of developer for the image formation is held in the agitation space 78 of the toner hopper 72.

In one or more example embodiment(s), the user can replenish developer by replacing only the developer container 30, and the user merely grips, for example, the supporting member 32 and the second container segment 34 of the developer container 30, and inserts, with the first container segment 33 having the convex fit 37 at the head, into the container housing space 77 of the toner hopper 72 in the attachment direction E1 from the casing front portion 93 of the apparatus main body 71, which is very simple and convenient. On the contrary, when detaching the developer container 30 from the apparatus main body 71, the user merely grips the second container segment 34 of the developer container 30, and pulls out in the detachment direction E2, which is also very simple and convenient.

Further, conventionally, the user needs to swing a heavy and large toner cartridge from side to side and up and down in order to agitate stored developer and prevent cohesion. However, with the developer container 30 of the present embodiment, the user needs to merely rotate the container main body 31 about the rotation axial line L31, which is very easy. Moreover, in the developer container 30 of the present embodiment, a configuration for agitating stored developer is very simple. Moreover, with the developer container 30, sealing between the container main body 31 and the supporting member 32 is achieved, and sealing at least one of the area around the leading through hole 51 of the discharge portion 50 and the area around the communication hole 81 of the developer supply section 74 that communicate with each other is achieved in a state where the developer container 30 is attached to the apparatus main body 71 in the attachment position, so that it is possible to prevent that developer leaks out from the container housing space 77 of the toner hopper 72 as far as possible. Therefore, it is possible to prevent that the user's hands get dirty by the developer as far as possible when the user replaces the developer container 30. Moreover, since the developer container 30 is substantially cylindrical, it is possible to store in a shipping carton having a slim and rectangular shape, which makes it considerably easy to transport and store.

Further, with the developer container 30, it is not necessary to make a rotation force for rotating the container main body 31 so large as illustrated before, and moreover, the quantity of developer discharged per rotation of the container main body 31 is kept as constant as possible. Consequently, there is no need to increase the rotation speed of the container main body 31, it is possible to supply developer to the agitation space 78 of the toner hopper 72 even at low speeds, and it is possible to supply developer to the agitation space 78 while keeping the quantity of developer discharged per rotation of the container main body 31 as constant as possible. Accordingly, it is possible to reduce torque of the driving source 84, and it is possible to realize the driving source 84 by a small-sized motor, for example.

Although a two-component developer is used in the developer container 30 and the image forming apparatus 70 of the embodiments described above, the invention can also be applied to a developing system using only toner.

The invention may be embodied in other specific forms without departing from the spirit or essential characteristics thereof. The present embodiments are there fore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developer container attachably/detachably mounted in an image forming apparatus, comprising:

a container main body formed into a cylindrical shape to store developer used for image formation, the container main body having a concavity, depressed inwardly in a radial direction thereof, to form a storage space on an outer periphery portion of the container main body, and a discharge hole for discharging the developer to the storage space, the container main body conveying the stored developer toward the discharge hole by rotating about an axial line thereof;

a supporting member that supports the container main body so that the container main body is rotatable about the axial line by covering a part of the container main body including at least the concavity and the discharge hole over circumferences of the container main body from outside in the radial direction, the supporting member being provided with a leading through hole that is formed so as to face a moving path of the concavity which is formed when the container main body rotates, and that leads the developer discharged from the discharge hole of the container main body to the outside;

a developer guiding member that is formed like a sheet, extends upstream in a rotation direction from the leading through hole, and guides the developer discharged from the discharge hole of the container main body to the leading through hole;

a deformation preventing member arranged to prevent a plastic deformation of a middle portion of the developer guiding member; and an adhesion eliminating portion for eliminating developer adhering to the developer guiding member, through rotation of the container main body, wherein the adhesion eliminating portion comprises a plurality of concavities, apart from the concavity forming the storage space, forming a corresponding plurality of depressed portions.

2. The developer container of claim 1, wherein the adhesion eliminating portion executes an eliminating operation plural times during one rotation of the container main body.

3. The developer container of claim 1, wherein the adhesion eliminating portion eliminates the adhering developer by making the developer guiding member collide with the container main body or the supporting member.

4. The developer container of claim 3, wherein the container main body is provided with a depressed portion depressed inwardly in the radial direction, and the adhesion eliminating portion has an inner wall portion, on an upstream side in the rotation direction, which defines the depressed portion.

5. The developer container of claim 4, wherein the discharge hole is formed on a downstream inner wall portion, in the rotation direction, of the concavity, and the depressed portion is disposed from a position close to the concavity to a position away from the concavity, so as to oppose a part where the discharge hole is formed on the inner wall portion, from downstream in the rotation direction.

6. The developer container of claim 1, further comprising a spring force generating portion for applying a spring force to the developer guiding member so that an upstream end portion in the rotation direction of the developer guiding member resiliently abuts on an outer periphery face of the concavity of the container main body.

7. The developer container of claim 1, further comprising guide walls formed on both axial end portions of the developing guiding member protruding outwardly in a radial direction.

8. The developer container of claim 1, wherein an upstream end portion in the rotation direction of the developer guiding member does not extend into a gap between an inner periphery of the supporting member and the outer periphery of the main body when the developer guiding member is in a closed state preventing discharge of the developer to the leading through hole of the supporting member.

9. The developer container of claim 1, wherein each depressed portion includes:

a bottom wall portion extending in the rotation direction from an inner portion thereof; and an end wall portion formed to rise outwardly in the radial direction from the bottom wall portion, wherein a steepness of the end wall portion is greater than a steepness of an upstream end portion in the rotation direction of the concavity forming the storage space.

10. The developer container of claim 1, wherein the concavity forming the storage space is a first concavity, the container main body having a second concavity depressed inwardly in the radial direction thereof, and wherein the first and second concavities are apart from the concavities forming the depression portions of the adhesion elimination portion.

11. The developer container of claim 10, wherein the plurality of depression portions include first and second depression portions, and wherein the first and second depression portions alternate with the first and second concavities in a circumferential direction of the container main body.

12. The developer container of claim 11, wherein around a circumference of the container main body, a first outer periphery portion body is formed between the first depressed portion and the first concavity, a second outer periphery portion is formed between the first concavity and the second depressed portion, a third outer periphery portion is formed between the second concavity and the first depressed portion, and a fourth outer periphery portion is formed between the second depressed portion and the second concavity, and wherein a proportion of the circumference of the container main body taken up by the first depressed portion, the first outer periphery portion, and the first concavity substantially ranges between ¼ and ½.

13. The developer container of claim 10, wherein the second concavity forms a second storage space on another output periphery portion of the container main body, and a second discharge hole being formed for discharging the developer to the second storage space, the container main body conveying the stored developer toward the second discharge hole by rotating about the axial line thereof.

* * * * *